US011433456B2

(12) United States Patent
Tang et al.

(10) Patent No.: US 11,433,456 B2
(45) Date of Patent: Sep. 6, 2022

(54) THERMOELECTRIC MATERIALS SYNTHESIZED BY SELF-PROPAGATING HIGH TEMPERATURE SYNTHESIS PROCESS AND METHODS THEREOF

(71) Applicant: WUHAN UNIVERSITY OF TECHNOLOGY, Wuhan (CN)

(72) Inventors: Xinfeng Tang, Wuhan (CN); Xianli Su, Wuhan (CN); Qiang Zhang, Wuhan (CN); Xin Cheng, Wuhan (CN); Dongwang Yang, Wuhan (CN); Gang Zheng, Wuhan (CN); Fan Fu, Wuhan (CN); Tao Liang, Wuhan (CN); Qingjie Zhang, Wuhan (CN)

(73) Assignee: WUHAN UNIVERSITY OF TECHNOLOGY, Hubei (CN)

( * ) Notice: Subject to any disclaimer, the term of this patent is extended or adjusted under 35 U.S.C. 154(b) by 412 days.

(21) Appl. No.: 16/667,180

(22) Filed: Oct. 29, 2019

(65) Prior Publication Data

US 2020/0171574 A1 Jun. 4, 2020

Related U.S. Application Data

(62) Division of application No. 14/441,446, filed as application No. PCT/CN2014/000287 on Mar. 17, 2014, now Pat. No. 10,500,642.

(30) Foreign Application Priority Data

Mar. 19, 2013 (CN) ..... 201310087520.6
Jun. 7, 2013 (CN) ..... 201310225419.2
(Continued)

(51) Int. Cl.
*B22F 3/23* (2006.01)
*B22F 9/16* (2006.01)
(Continued)

(52) U.S. Cl.
CPC ..... *B22F 3/23* (2013.01); *B22F 9/04* (2013.01); *B22F 9/16* (2013.01); *C22C 1/02* (2013.01);
(Continued)

(58) Field of Classification Search
None
See application file for complete search history.

(56) References Cited

FOREIGN PATENT DOCUMENTS

CN 1341576 3/2002
CN 101338386 1/2009
(Continued)

OTHER PUBLICATIONS

Godlewska et al., "Alternative route for the preparation of CoSb3 and Mg2Si derivatives," Journal of Solid State Chemistry, 2012, vol. 193, pp. 109-113. (Year: 2012).*
(Continued)

*Primary Examiner* — Anthony M Liang
(74) *Attorney, Agent, or Firm* — Hamre, Schumann, Mueller & Larson, P.C.

(57) ABSTRACT

The disclosure relates to thermoelectric materials prepared by self-propagating high temperature synthesis (SHS) process combining with Plasma activated sintering and methods for preparing thereof. More specifically, the present disclosure relates to the new criterion for combustion synthesis and the method for preparing the thermoelectric materials which meet the new criterion.

3 Claims, 31 Drawing Sheets

(30) Foreign Application Priority Data

| | | |
|---|---|---|
| Jun. 7, 2013 | (CN) | 201310225431.3 |
| Jun. 7, 2013 | (CN) | 2013102254173 |
| Aug. 16, 2013 | (CN) | 201310357955.8 |
| Aug. 16, 2013 | (CN) | 201310358162.8 |
| Sep. 22, 2013 | (CN) | 201310430713.7 |
| Nov. 15, 2013 | (CN) | 201310567679.8 |
| Nov. 15, 2013 | (CN) | 201310567912.2 |
| Jan. 20, 2014 | (CN) | 201410024796.4 |
| Jan. 20, 2014 | (CN) | 201410024929.8 |

(51) Int. Cl.

| | |
|---|---|
| ***C22C 1/04*** | (2006.01) |
| ***C22C 12/00*** | (2006.01) |
| ***C22C 9/00*** | (2006.01) |
| ***C22C 29/12*** | (2006.01) |
| ***C22C 28/00*** | (2006.01) |
| ***C22C 13/00*** | (2006.01) |
| ***C22C 11/00*** | (2006.01) |
| ***C22C 23/00*** | (2006.01) |
| ***B22F 9/04*** | (2006.01) |
| ***C22C 1/02*** | (2006.01) |

(52) U.S. Cl.

CPC ..... *C22C 1/0491* (2013.01); *C22C 9/00* (2013.01); *C22C 11/00* (2013.01); *C22C 12/00* (2013.01); *C22C 13/00* (2013.01); *C22C 23/00* (2013.01); *C22C 28/00* (2013.01); *C22C 29/12* (2013.01)

(56) References Cited

FOREIGN PATENT DOCUMENTS

| | | |
|---|---|---|
| CN | 101613814 | 12/2009 |
| CN | 102194989 | 9/2011 |
| CN | 102633239 | 8/2012 |
| CN | 102655204 | 9/2012 |
| CN | 103436723 | 12/2013 |
| CN | 103436724 | 12/2013 |

OTHER PUBLICATIONS

Functionally Graded Materials 1996: Proceedings of the 4th International Symposium on Functionally Graded Materials, AIST Tsukuba Research Center, Tsukuba, Japan, Oct. 21-24, 1996, by Ichiro Shiota and Yoshinari Miyamoto, Elsevier, 1997, p. 290. (Year: 1997).*

"Advanced Practical Inorganic and Metalorganic Chemistry." Advanced Practical Inorganic and Metalorganic Chemistry, by R. John. Errington, CRC Press, 1997, p. 178. (Year: 1997).*

"High Temperature Corrosion and Materials Chemistry IV: Proceedings of the International Symposium." High Temperature Corrosion and Materials Chemistry IV: Proceedings of the International Symposium, by Elisabeth J. Opila, Electrochemical Society, 2003, p. 51. (Year: 2003).*

International Search Report of PCT/CN2014/000287, dated Jun. 18, 2014, 8 pages total (English language translation provided).

Han et al., "Analysis of SHS Ni—Al reaction process and study on electrochemical corrosion resistance," Journal of Liaoning Teachers College, No. 3, vol. 14, 2012, pp. 94-96 (English language abstract provided; See also ISR in English).

Godlewska et al., "Alternative route for the preparation of CoSb3 and Mg2Si derivatives," Journal of Solid State Chemistry, 2012, vol. 193, pp. 109-113.

"Advanced Practical Inorganic and Metalorganic Chemistry." Advanced Practical Inorganic and Metalorganic Chemistry, by R. John Errington, CRC Press, 1997, p. 178. (Year: 1997).

"High Temperature Corrosion and Materials Chemistry IV: Proceedings of the International Symposium." High Temperature Corrosion and Materials Chemistry IV: Proceedings of the International Symposium, by Elisabeth J. Opila, Electrochemical Society, 2003, p. 51. (Year: 2003).

* cited by examiner

THERMOELECTRIC MATERIALS SYNTHESIZED BY SELF-PROPAGATING HIGH TEMPERATURE SYNTHESIS PROCESS AND METHODS THEREOF

FIELD

The present disclosure relates to thermoelectric materials prepared by self-propagating high temperature synthesis (SHS) process combining with plasma activated sintering (PAS) and a method for preparing the same. More specifically, the present disclosure relates to a new criterion for combustion synthesis and the method for preparing thermoelectric materials which can meet the new criterion.

BACKGROUND

In the heat flow of the energy consumption in the world, there is about 70% of the total energy wasted in the form of heat. If those large quantities of waste heat can be recycled effectively, it would relief the energy crisis in the world. Thermoelectric (TE) materials convert heat into electricity directly through the Seebeck effect. Thermoelectric materials offer many advantages including: no moving parts; small and lightweight; maintenance-free; no pollution; acoustically silent and electrically "quiet". Thermoelectric energy conversion has drawn a great attention for applications in areas such as solar thermal conversion, industrial waste heat recovery. The efficiency of a TE material is strongly related to its dimensionless figure of merit ZT, defined as $ZT=\alpha^2\sigma T/\kappa$, where $\alpha$, $\sigma$, $\kappa$ and T are the Seebeck coefficient, electrical conductivity, total thermal conductivity, and the absolute temperature, respectively. To achieve high efficiency, a large ZT is required. High electrical conductivity, large Seebeck coefficient, and low thermal conductivity are necessary for a high efficient TE material. However those three parameters relate with each other. Hence decoupling the connection of those parameters is key issue to improve the thermoelectric performance. A lot of investigation shows that nanostructure engineering can weak the coupling to enhance the thermoelectric property.

Until now, most researchers have utilized top down approach to obtain nanostructure (mechanic alloy, melt spinning, etc). But all those processing is of high energy consumption. In addition, some investigator used bottom up fabrication to synthesize low dimensional material (Wet chemical method). Efficient synthesis and its adaptability to a large-scale industrial processing are important issues determining the economical viability of the fabrication process. So far, thermoelectric materials have been synthesized mostly by one of the following methods: melting followed by slow cooling; melting followed by long time annealing, multi-step solid state reactions, and mechanical alloying. Each such processing is time and energy consuming and not always easily scalable. Moreover, it is often very difficult to control the desired stoichiometry and microstructure. All those difficulty is of universality in all those thermoelectric material. Hence developing a technology which not only can synthesize the samples in large scale and short period but also can control the composition and microstructure precisely is of vital importance for the large scale application.

Self-propagating high-temperature synthesis (SHS) is a method for synthesizing compounds by exothermic reactions. The SHS method, often referred to also as the combustion synthesis, relies on the ability of highly exothermic reactions to be self-sustaining, i.e., once the reaction is initiated at one point of a mixture of reactants, it propagates through the rest of the mixture like a wave, leaving behind the reacted product. What drives this combustion wave is exothermic heat generated by an adjacent layer. In contrast with some other traditional method, the synthesis process is energy saving, exceptionally rapid and industrially scalable. Moreover, this method does not rely on any equipment. Base on the experiments, Merzhanov suggested an empirical criterion, $T_{ad}>1800$ K, as the necessary precondition for self-sustainability of the combustion wave, where $T_{ad}$ is the maximum temperature to which the reacting compact is raised as the combustion wave passes through. It restricts the scope of materials that can be successfully synthesized by SHS processing.

SUMMARY

In order to solve the problem of existing technology, the objects of the present disclosure is to provide an ultra-fast fabrication method for preparing high performance thermoelectric materials. By using this method, it can control the composition very precisely, shorts the synthesis period, and is easy to scale up to kilogram. High thermoelectric performance can be obtained. Moreover, we found that the criterion often quoted in the literature as the necessary precondition for self-sustainability of the combustion wave, $T_{ad}\geq 1800$ K, where $T_{ad}$ is the maximum temperature to which the reacting compact is raised as the combustion wave passes through, is not universal and certainly not applicable to thermoelectric compound semiconductors. Instead, we offer new empirically-based criterion, $T_{ad}/T_{mL}>1$, i.e., the adiabatic temperature must be high enough to melt the lower melting point component. This new criterion covers all materials synthesized by SHS, including the high temperature refractory compounds for which the $T_{ad}\geq 1800$ K criterion was originally developed. Our work opens a new avenue for ultra-fast, low cost, mass production fabrication of efficient thermoelectric materials and the new insight into the combustion process greatly broadens the scope of materials that can be successfully synthesized by SHS processing.

In accordance with the present disclosure, the above objects of the present disclosure can be achieved by the following steps.

1. The new criterion for the combustion synthesis of binary compounds is as following.

1) The adiabatic temperatures $T_{ad}$ of the binary compounds are calculated by thermodynamic data (enthalpy of formation and the molar specific heat of the product) and Eq. (1). Where $\Delta_f H_{298K}$ is enthalpy of formation for the binary compounds, T is temperature, $H_{298K}^0$ is the enthalpy of the binary compounds at 298 K, and C is the molar specific heat of the product and the integral includes latent heats of melting, vaporization, and phase transitions, if any present. The reactants for the combustion reaction are pure elemental for the binary compounds.

$$-\Delta_f H_{298K}=H_T^0-H_{298K}^0=\int_{298K}^{T_{ad}} C\,dT \quad (1)$$

When there is no phase transition and the adiabatic temperature is lower than the melting point of the binary compound, Equation (1) can be simplified into Equation (2) shown below, where $C_p$ is the the molar specific heat of the product in solid state.

$$-\Delta_f H_{298K}=H_T^0-H_{298K}^0=\int_{298K}^{T_{ad}} C_p\,dT \quad (2)$$

When there is no phase transition and the adiabatic temperature is higher than the melting point of the binary compound and lower than the boiling point of of the binary compound, Equation (1) can be simplified into Equation (3) shown below, where $C_p$, $C''_p$ is the the molar specific heat of the product in solid state and liquid state respectively, $T_m$ is the melting point of the binary compound, $\Delta H_m$ is the enthalpy change during fusion processing.

$$-\Delta_f H_{298K} = H_T^0 - H_{298K}^0 = \int_{298K}^{Tm} C_p dT + \Delta H_m + \int_{Tm}^{Tad} C''_p dT \quad (3)$$

When there is no phase transition and the adiabatic temperature is higher than the boiling point of of the binary compound, Equation (1) can be simplified into Equation (4) shown below, where $C_p$, $C''_p$, $C'''_p$ is the the molar specific heat of the product in solid, liquid and gaseous state respectively, $T_m$, $T_b$ is the melting point and boiling point of the binary compound, respectively. $\Delta H_m$, $\Delta H_b$ is the enthalpy change during fusion and gasification processing repectively.

$$-\Delta_f H_{298K} = H_T^0 - H_{298K}^0 = \int_{298K}^{Tm} C_p dT + \Delta H_m + \int_{Tm}^{T_B} C''_p dT + \Delta H_B + \int_{T_B}^{T_{ad}} C'''_p dT \quad (4)$$

When phase transition exists during the heating processing and the adiabatic temperature is higher than the phase transition temperature of the binary compound, the Equation (1) can be simplified into Equation (5) as below, where $C_p$, $C'_p$ is the the molar specific heat of the product in solid before or after phase transition respectively, $T_{tr}$ is the phase transition temperature of the binary compound, $\Delta H_{tr}$ is the enthalpy change during phase transition processing.

$$-\Delta_f H_{298K} = H_T^0 - H_{298K}^0 = \int_{298K}^{Ttr} C_p dT + \Delta H_{tr} + \int_{Ttr}^{Tad} C'_p dT \quad (5)$$

When phase transition exists during the heating processing and the adiabatic temperature is higher than the phase transition temperature and the melting point of the binary compound, the Equation (1) can be simplified into Equation (6) as below, where $C_p$, $C'_p$, $C''_p$ is the molar specific heat of the product in solid before or after phase transition and the molar specific heat of the product in liquid state respectively, $T_{tr}$, $T_m$ is the phase transition temperature and melting point of the binary compound respectively, $\Delta H_{tr}$, $\Delta H_m$ is the enthalpy change during phase transition processing and fusion processing.

$$-\Delta_f H_{298K} = H_T^0 - H_{298K}^0 = \int_{298K}^{Ttr} C_p dT + \Delta H_{tr} + \int_{Ttr}^{Tm} C'_p dT + \Delta H_m + \int_{Tm}^{Tad} C''_p dT \quad (6)$$

When phase transition exists during the heating processing and the adiabatic temperature is higher than the phase transition temperature and the boiling point of the binary compound, the Equation (1) can be simplified into Equation (7) as below, where $C_p$, $C'_p$, $C''_p$ is the molar specific heat of the product in solid before or after phase transition and the molar specific heat of the product in liquid state respectively, $T_{tr}$, $T_m$ is the phase transition temperature and melting point of the binary compound respectively, $\Delta H_{tr}$, $\Delta H_m$ is the enthalpy change during phase transition processing and fusion processing.

$$-\Delta_f H_{298K} = H_T^0 - H_{298K}^0 = \int_{298K}^{T_{tr}} C_p dT + \Delta H_{tr} + \int_{T_{tr}}^{T_m} C'_p dT + \Delta H_m + \int_{T_m}^{T_B} C''_p dT + \Delta H_B + \int_{T_b}^{T_{ad}} C'''_p dT \quad (7)$$

2. $T_{mL}$ represents the melting point of the component with lower melting point. The SHS reaction to be self-sustaining, the value of $T_{ad}/T_{m,L}$ should be more than 1, i.e., the heat released in the reaction must be high enough to melt the component with the lower melting point, or the combustion wave can not be self propagated.

3. Based on the new criterion for combustion synthesis of thermoelectric compounds, the above and other objects can be accomplished by the provision of a method for preparing thermoelectric materials by SHS combining Plasma activated sintering which comprises following steps:

1) Choose two single elemental as the starting material for the reaction
2) The adiabatic temperatures $T_{ad}$ of the binary compounds are calculated by thermodynamic data (enthalpy of formation and the molar specific heat of the product) and Eq. (1). Where $\Delta_f H_{298K}$ is enthalpy of formation for the binary compounds, T is temperature, $H_{298K}^0$ is the enthalpy of the binary compounds at 298 K, and C is the molar specific heat of the product and the integral includes latent heats of melting, vaporization, and phase transitions, if any present. The reactants for the combustion reaction are pure elemental for the binary compounds.

$$-\Delta_f H_{298K} = H_T^0 - H_{298K}^0 = \int_{298K}^{Tad} C dT \quad (1)$$

When there is no phase transition and the adiabatic temperature is lower than the melting point of the binary compound, the Equation (1) can be simplified into Equation (2) as below, where $C_p$ is the the molar specific heat of the product in solid state.

$$-\Delta_f H_{298K} = H_T^0 - H_{298K}^0 = \int_{298K}^{Tad} C_p dT \quad (2)$$

When there is no phase transition and the adiabatic temperature is higher than the melting point of the binary compound and lower than the boiling point of of the binary compound, the Equation (1) can be simplified into Equation (3) as below, where $C_p$, $C''_p$ is the the molar specific heat of the product in solid state and liquid state respectively, $T_m$ is the melting point of the binary compound, $\Delta H_m$ is the enthalpy change during fusion processing.

$$-\Delta_f H_{298K} = H_T^0 - H_{298K}^0 = \int_{298K}^{Tm} C_p dT + \Delta H_m + \int_{Tm}^{Tad} C''_p dT \quad (3)$$

When there is no phase transition and the adiabatic temperature is higher than the boiling point of of the binary compound, the Equation (1) can be simplified into Equation (4) as below, where $C_p$, $C''_p$, $C'''_p$ is the the molar specific heat of the product in solid, liquid and gaseous state respectively, $T_m$, $T_b$ is the melting point and boiling point of the binary compound, respectively. $\Delta H_m$, $\Delta H_b$ is the enthalpy change during fusion and gasification processing repectively.

$$-\Delta_f H_{298K} = H_T^0 - H_{298K}^0 = \int_{298K}^{Tm} C_p dT + \Delta H_m + \int_{Tm}^{T_B} C''_p dT + \Delta H_B + \int_{T_B}^{T_{ad}} C'''_p dT \quad (4)$$

When phase transition exists during the heating processing and the adiabatic temperature is higher than the phase transition temperature of the binary compound, the Equation (1) can be simplified into Equation (5) as below, where $C_p$, $C'_p$ is the the molar specific heat of the product in solid before or after phase transition respectively, $T_{tr}$ is the phase transition temperature of the binary compound, $\Delta H_{tr}$ is the enthalpy change during phase transition processing.

$$-\Delta_f H_{298K} = H_T^0 - H_{298K}^0 = \int_{298K}^{Ttu} C_p dT + \Delta H_{tr} + \int_{Ttr}^{Tad} C'_p dT \quad (5)$$

When phase transition exists during the heating processing and the adiabatic temperature is higher than the phase transition temperature and the melting point of the binary compound, the Equation (1) can be simplified into Equation (6) as below, where $C_p$, $C'_p$, $C''_p$ is the molar specific heat of the product in solid before or after phase transition and the molar specific heat of the product in liquid state respectively, $T_{tr}$, $T_m$ is the phase transition temperature and melting point of the binary compound respectively, $\Delta H_{tr}$, $\Delta H_m$ is the enthalpy change during phase transition processing and fusion processing.

$$-\Delta_f H_{298K} = H_T^0 - H_{298K}^0 = \int_{298K}^{Tu} C_p dT + \Delta H_{tr} + \int_{Tr}^{Tm} C'_p dT + \Delta H_m \int_{Tm}^{Tad} C''_p dT \quad (6)$$

When phase transition exists during the heating processing and the adiabatic temperature is higher than the phase transition temperature and the boiling point of the binary compound, the Equation (1) can be simplified into Equation (7) as below, where $C_p$, $C'_p$, $C''_p$ is the molar specific heat of the product in solid before or after phase transition and the molar specific heat of the product in liquid state respectively, $T_{tr}$, $T_m$ is the phase transition temperature and melting point of the binary compound respectively, $\Delta H_{tr}$, $\Delta H_m$ is the enthalpy change during phase transition processing and fusion processing.

$$-\Delta_f H_{298K} = H_T^0 - H_{298K}^0 = \int_{298K}^{T_{tr}} C_p dT + \Delta H_{tr} + \int_{T_{tr}}^{T_m} C'_p dT + \Delta H_m + \int_{T_m}^{T_B} C''_p dT + \Delta H_B + \int_{T_b}^{T_{ad}} C'''_p dT \quad (7)$$

3) $T_{mL}$ represents the melting point of the component with lower melting point. The SHS reaction to be self-sustaining, the value of $T_{ad}/T_{m,L}$ should be more than 1, i.e., the heat released in the reaction must be high enough to melt the component with the lower melting point, or the combustion wave can not be self propagated.
4) Self propagating high temperature synthesis: Stoichiometric amounts of single elemental powders with high purity were weighed and mixed in the agate mortar and then cold-pressed into a pellet. The pellet obtained was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air. Single phase binary compounds are obtained after SHS.

According to the above step, the binary compounds are mostly thermoelectric material, high temperature ceramics and intermetallic.

According to the above step, the purity of the single elemental powder is better than 99.99%.

According to the above step, the pellet was sealed in a silica tube under the pressure of $10^{-3}$ Pa or Ar atmosphere. The components react under the pressure of $10^{-3}$ Pa or Ar atmosphere.

According to the above step, the pellet after SHS was crushed into powders and then sintered by spark plasma sintering to obtain the bulks.

Moreover, we found that the criterion suggested by Merzhanov as the necessary precondition for self-sustainability of the combustion wave, $T_{ad} \geq 1800$ K, where $T_{ad}$ is the maximum temperature to which the reacting compact is raised as the combustion wave passes through, is not universal and certainly not applicable to thermoelectric compound semiconductors. Instead, we offer new empirically-based criterion, $T_{ad}/T_{mL} > 1$, i.e., the adiabatic temperature must be high enough to melt the lower melting point component. When this happens, the higher melting point component rapidly dissolves in the liquid phase of the first component and generates heat at a rate high enough to sustain propagation of the combustion wave. This new criterion covers all materials synthesized by SHS, including the high temperature refractory compounds for which the $T_{ad} \geq 1800$ K criterion was originally developed. Our work opens a new avenue for ultra-fast, low cost, mass production fabrication of efficient thermoelectric materials and the new insight into the combustion process greatly broadens the scope of materials that can be successfully synthesized by SHS processing.

It is another object for present disclosure to provide a method for preparing ternary or quarternary thermoelectric materials. Choose elemental powder with high purity as the starting material for the reaction. Stoichiometric amounts of single elemental powders with high purity were weighed and mixed in the agate mortar and then cold-pressed into a pellet. The pellet obtained was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air. Single phase compounds are obtained after SHS. The pellet was crushed into powder and then sintered by spark plasma sintering to otain the bulk thermoelectric materials. The detailed synthesis procedure for ternary or quartemary thermoelectric materials is as following.

The ultra-fast synthesis method for preparing high performance Half-Heusler thermoelectric materials with low cost comprises the steps of 1) Stoichiometric amounts ABX of high purity single elemental A, B, X powders were weighed and mixed in the agate mortar and then cold-pressed into a pellet.
2) The pellet was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water.
3) The obtained pellet in step 2) was crushed, hand ground into a fine powder, and then sintered by PAS. The densely bulks half heusler with excellent thermoelectric properties is obtained after PAS.

In step 1), what we choose for elemental A can be the elemental in IIIB, IVB, and VB column of periodic Table, Such as one of or the mixture of the Ti, Zr, Hf, Sc, Y, La, V, Nb, Ta. What we choose for elemental B can be the elemental in VIIIB column of periodic Table, such as one of or the mixture of the Fe, Co, Ni, Ru, Rh, Pd, and Pt. What we choose for elemental B can be the elemental in IIIA, IVA, VA column of periodic Table, such as one of or the mixture of the Sn, Sb, and Bi. In step 3), the parameter for spark plasma sintering is with the temperature above 850° C. and the pressure around 30-50 MPa.

The detail of the ultra-fast preparation method of high performance BiCuSeO based thermoelectric material is as following.

1) Weigh $Bi_2O_3$, PbO, Bi, Cu, and Se according to the stoichiometric ratio (1-p):3p:(1-p):3:3(p=0, 0.02, 0.04, 0.06, 0.08, 0.1) and mix them in the agate mortar and then cold-pressed into a pellet.
2) The pellet obtained in step 1) was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water.
3) The obtained pellet $Bi_{1-p}Pb_pCuSe$ in step 2) was crushed, hand ground into a fine powder, and then sintered by PAS. The densely bulks $Bi_{1-p}Pb_pCuSe$ with excellent thermoelectric properties is obtained after PAS.

In step 3), the parameter for spark plasma sintering is with the temperature above 670° C. and the pressure of 30 MPa holding for 5-7 min.

The detail of the ultra-fast preparation method of high performance $Bi_2Te_3$ based thermoelectric material is as following.

1) Stoichiometric amounts $Bi_2Te_{3-x}Se_x$ of high purity single elemental Bi, Te, Se powders were weighed and mixed in the agate mortar and then cold-pressed into a pellet.
2) The pellet obtained in step 1) was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water.
3) The obtained pellet $Bi_2Te_{3-x}Se_x$ in step 2) was crushed, hand ground into a fine powder, and then sintered by PAS. The densely bulks $Bi_2Te_{3-x}Se_x$ with excellent thermoelectric properties is obtained after PAS.

In step 3), load the $Bi_2Te_{3-x}Se_x$ powder with single phase into the graph die. the parameter for spark plasma sintering is with the temperature around 420-480° C. and the pressure of 20 MPa holding for 5 min.

The detail of the ultra-fast preparation method of high performance $PbS_{1-x}Se_x$ thermoelectric material is as following.

1) Stoichiometric amounts $PbS_{1-x}Se_x$ of high purity single elemental Pb, S, Se powders were weighed and mixed in the agate mortar and then cold-pressed into a pellet.
2) The pellet obtained in step 1) was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water.
3) The obtained pellet $PbS_{1-x}Se_x$ in step 2) was crushed, hand ground into a fine powder, and then sintered by PAS. The densely bulks $PbS_{1-x}Se_x$ with excellent thermoelectric properties is obtained after PAS.

In step 3), load the $PbS_{1-x}Se_x$ powder with single phase into the graphite die. The parameter for spark plasma sintering is with the temperature of 550° C. and the pressure of 35 MPa holding for 7 min.

The detail of the ultra-fast preparation method of high performance $Mg_2Si$ based thermoelectric material is as following.

1) Stoichiometric amounts $Mg_{2(1+0.02)}Si_{1-n}Sb_n(0\leq n\leq 0.025)$ of high purity single elemental Mg, Si, Sb powders were weighed and mixed in the agate mortar and then cold-pressed into a pellet.
2) The pellet obtained in step 1) was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water.
3) The obtained pellet $Mg_{2(1+0.02)}Si_{1-n}Sb_n(0\leq n\leq 0.025)$ in step 2) was crushed, hand ground into a fine powder, and then sintered by PAS. The densely bulks $PbS_{1-x}Se_x$ with excellent thermoelectric properties is obtained after PAS.

In step 3), load the $Mg_{2(1+0.02)}Si_{1-n}Sb_n(0\leq n\leq 0.025)$ powder with single phase into the graphite die. The parameter for spark plasma sintering is with the temperature of 800° C. with the heating rate 100° C./min and the pressure of 33 MPa holding for 7 min. Since the content of Sb in $Mg_{2(1+0.02)}Si_{1-n}Sb_n(0\leq n\leq 0.025)$ is very low, the impact of Sb on the SHS processing can be ignored.

The detail of the ultra-fast preparation method of high performance $Cu_aMSn_bSe_4$ thermoelectric material is as following.

1) Stoichiometric amounts $Cu_aMSn_bSe_4$ (M=Sb, Zn, or Cd; a=2 or 3; b=1 or 0) of high purity single elemental Cu, M, Sn, Se powders were weighed and mixed in the agate mortar and then cold-pressed into a pellet. For $Cu_3SbSe_4$, Weigh the elemental Cu, Sb Se powder according to the ratio of Cu: Sb: Se=3: (1.01~1.02):4, and mixed in the agate mortar and then cold-pressed into a pellet. For $Cu_2ZnSnSe_4$, Weigh the elemental Cu, Zn, Sn, Se powder according to the ratio of Cu:Zn:Sn:Se=2:1:1:4, and mixed in the agate mortar and then cold-pressed into a pellet. For $Cu_2CdSnSe_4$, Weigh the elemental Cu, Cd, Sn, Se powder according to the ratio of Cu:Cd:Sn:Se=2:1:1:4, and mixed in the agate mortar and then cold-pressed into a pellet.
2) The pellet obtained in step 1) was sealed in a silica tube under the pressure of $1^{0-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water. The obtained pellet $Cu_aMSn_bSe_4$ in step 2) was crushed, hand ground into a fine powder.

The detail of the ultra-fast preparation method of high performance $Cu_2SnSe_3$ thermoelectric material is as following.

1) Weigh high purity single elemental Cu, Sn, Se powders according to the ratio of Cu:Se:Sn=2.02:3.03: 1 and mixed in the agate mortar and then cold-pressed into a pellet.
2) The pellet obtained in step 1) was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water.

3) The obtained pellet $Cu_2SnSe_3$ in step 2) was crushed, hand ground into a fine powder, and then sintered by PAS. The densely bulks $Cu_2SnSe_3$ with excellent thermoelectric properties is obtained after PAS.

In step 3), load the $Cu_2SnSe_3$ powder with single phase into the graphite die. The parameter for spark plasma sintering is with the temperature around 500-550° C. with the heating rate 50-100° C./min and the pressure around 30-35 MPa holding for 5-7 min.

The detail of the ultra-fast preparation method of high performance $CoSb_3$ based thermoelectric material is as following.

1) Stoichiometric amounts $Co_{4-e}M_eSb_{12-f}Te_f$ ($0 \le e \le 1.0$, $0 \le f \le 1.0$, M=Fe or Ni) of high purity single elemental Co, M, Sb, Te powders were weighed and mixed in the agate mortar and then cold-pressed into a pellet.
2) The pellet obtained in step 1) was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air or quenched in the salt water.
3) The obtained pellet $Co_{4-e}M_eSb_{12-31\ f}Te_f$ ($0 \le e \le 1.0$, $0 \le f \le 1.0$, M=Fe or Ni) in step 2) was crushed, hand ground into a fine powder, and then sintered by PAS. The densely bulks $Co_{4-e}M_eSb_{12-31\ f}Tef$ ($0 \le e \le 1.0$, $0 \le f \le 1.0$, M=Fe or Ni) with excellent thermoelectric properties is obtained after PAS.

In step 3), load the $Co_{4-e}M_eSb_{12-31\ f}Te_f$ ($0 \le e \le 1.0$, $0 \le f \le 1.0$, M=Fe or Ni) powder with single phase into the graphite die. The parameter for spark plasma sintering is with the temperature of 650° C. with the heating rate 100° C./min and the pressure of 40 MPa holding for 8 min.

Compared with the convetional synthesis technique, the advantage of the disclosure is as below.

1. SHS method is very convenient and does not rely on any equipment. But for some other methods such as Mechanic alloy, Melt spinning, etc all those processing demand complicated equipments. For chemical method, the yield is very low and it is very difficult to condense the sample. Moreover all those processing except SHS processing is energy consuming. Self-propagating high-temperature synthesis (SHS) is a method for synthesizing compounds by exothermic reactions. The SHS method, often referred to also as the combustion synthesis, relies on the ability of highly exothermic reactions to be self-sustaining, i.e., once the reaction is initiated at one point of a mixture of reactants, it propagates through the rest of the mixture like a wave, leaving behind the reacted product. What drives this combustion wave is exothermic heat generated by an adjacent layer. In contrast with some other traditional method, the synthesis process is energy saving, exceptionally rapid and industrially scalable.
2. Since Self-propagating high-temperature synthesis (SHS) can be finished in a very short time. It can control the composition very precisely. Moreover, the Non-equibrium microstructure can be obtained since large temperature gradient exists during the SHS processing.
3. It shortens the synthesis periods very significantly by about 90% in comparson with conventional method.

Based on the above content, without departing from the basic technical concept of the present disclosure, under the premise of ordinary skill in the art based on the knowledge and means of its contents can also have various forms of modification, substitution or changes, such as $T_{ad}>T_{mL}$, or $T_{mL}<T_{ad}$.

BRIEF DESCRIPTION OF THE DRAWING

FIG. 15(*b*) shows enlarged FESEM image of $Bi_2Te_{2.7}Se_{0.3}$ after SHS-PAS.

FIG. 23(*b*) shows SEM image of the powder after SHS (with the magnification5000 and 8000) in embodiment example 8.4. FIG. 23(*c*) shows the temperature dependence of ZT in compareson with the sample synthesized by melting method in embodiment example 8.4.

FIG. 24(*b*) shows SEM image of the powder after SHS (with the magnification5000 and 10000) in embodiment example 9.1. FIG. 24(*c*) shows SEM image of the bulks after SHS-PAS (with the magnification 2000 and 10000) in embodiment example 9.1.

FIG. 25(*b*) shows SEM image of the powder after SHS (with the magnification5000 and 10000) in embodiment example 9.2. FIG. 25(*c*) shows SEM image of the bulks after SHS-PAS (with the magnification 2000 and 10000) in embodiment example 9.2.

FIG. 26(*b*) shows SEM image of the powder after SHS (with the magnification5000 and 10000) in embodiment example 9.3. FIG. 26(*c*) shows SEM image of the bulks after SHS-PAS (with the magnification 2000 and 10000) in embodiment example 9.3.

FIG. 27(*b*) shows SEM image of the powder after SHS (with the magnification 5000 and 10000) in embodiment example 9.4. FIG. 27(*c*) shows SEM image of the bulks after SHS-PAS (with the magnification 2000 and 10000) in embodiment example 9.4.

FIG. 28(*b*) shows SEM image of the powder after SHS (with the magnification 5000 and 10000) in embodiment example 9.5. FIG. 28(*c*) shows SEM image of the bulks after SHS-PAS (with the magnification 2000 and 10000) in embodiment example 9.5. FIG. 28(*d*) shows the temperature dependence of ZT in compareson with the sample synthesized by other method in embodiment example 9.5.

FIG. 40(*b*) shows SEM image of the powder after SHS (with the magnification 5000 and 20000) in step 2 of embodiment example 12.1. FIG. 40(*c*) shows SEM image of the bulks after SHS-PAS (with the magnification 5000 and 20000) in step 3 of embodiment example 12.1.

FIG. 41(*b*) shows SEM image of the powder after SHS (with the magnification 5000 and 20000) in step 2 of embodiment example 12.2. FIG. 41(*c*) shows SEM image of the bulks after SHS-PAS (with the magnification 5000 and 20000) in step 3 of embodiment example 12.2.

FIG. 42(*b*) shows SEM image of the powder after SHS (with the magnification 5000 and 20000) in step 2 of embodiment example 12.3. FIG. 42(*c*) shows SEM image of the bulks after SHS-PAS (with the magnification 5000 and 20000) in step 3 of embodiment example 12.3.

FIG. 43(*b*) shows SEM image of the powder after SHS (with the magnification 5000 and 20000) in step 2 of embodiment example 12.4. FIG. 43(*c*) shows SEM image of the bulks after SHS-PAS (with the magnification 5000 and 20000) in step 3 of embodiment example 12.4.

FIG. 44(*b*) shows SEM image of the powder after SHS (with the magnification 5000 and 20000) in step 2 of embodiment example 12.5. FIG. 44(*c*) shows SEM image of the bulks after SHS-PAS (with the magnification 5000 and 20000) in step 3 of embodiment example 12.5.

FIG. 45(*b*) shows the temperature dependence of ZT for $Co_4Sb11.4Te_{0.6}$ in step 3 of embodiment example 12.5 compared with the data from reference. (In the reference, the sample is synthesized by Melt-annealing and PAS. It takes about 168 h)

DETAILED DESCRIPTION

Figure 1:
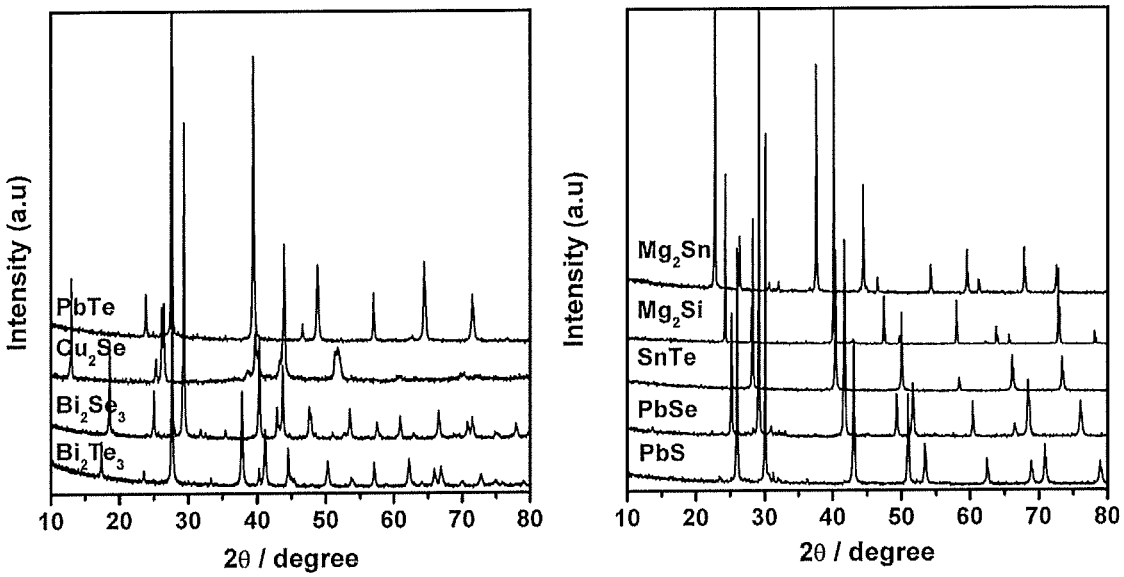
FIG. 1 shows Powder XRD pattern of compounds thermoelectric after SHS for embodiment example 1.

For a better understanding of the present disclosure, several embodiments are given to further illustrate the disclosure, but the present disclosure is not limited to the following embodiments

Embodiment Example 1

Embodiment Example 1.1

Based on the new criterion, the detailed synthesis procedure of $Bi_2Te_3$ is as following.

(1) Elemental Bi, Te powder with high purity were Chosen as starting material.

(2) The adiabatic temperature can be calculated by using molar enthalpy of forming $Bi_2Te_3$ and the molar heat capacity according to the following formula. The molar enthalpy of forming $Bi_2Te_3$ at 298K $\Delta_f H_{298K}$ is 78.659 kJ.mol$^{-1}$ $$-\Delta_f H_{298K} = H_T^0 - H_{298K}^0 = \int_{298K}^{T_{ad}} C dT$$

Assuming the adiabatic temperature is lower than the melting point of $Bi_2Te_3$, there is no phase transition during the combustion processing. The above formula can be simplified as below.

$$-\Delta_f H_{298K}=H_T^0-H_{298K}^0=\int_{298K}^{T_{ad}}C_p dT$$

The molar heat capacity of $Bi_2Te_3$ in solid state is $107.989+55.229\times10^{-3}T$ $JK^{-1}mol^{-1}$, solve the equation and then the adiabatic temperature can be obtained as 860 K. Since the calculated adiabatic temperature is 860 K, which is lower than the melting point of $Bi_2Te_3$. The result obtained is consistent with the assumption. Hence the adiabatic temperature is 860 K.

$$\Delta_f H_{298K}^0 = -78.659kJmol^{-1} = -\int_{298K}^{T_{ad}}(107.989+55.229\times10^{-3}T)dT = -[107.989\times(T_{ad}-298)+0.5\times55.229\times10^{-3}\times(T_{ad}^2-298^2)]$$

(3) Since the molten point of Te and Bi is 722.5 K, 544.44 K respectively. The component with lower melting point is Bi. The ratio between the adiabatic temperature and the melting point of the component with lower melting point is 1.58. According to the new criterion for combustion synthesis, self propogating high temperature reaction between Bi and Te can be self sustained.

(4) The SHS synthesis of $Bi_2Te_3$ can be achieved by the following steps.

a) Stoichiometric amounts of high purity Bi(4N), and Te(4N) powders were weighed and mixed in the agate mortar and then cold-pressed into a pellet with the dimension of $\phi15\times18$ mm under the pressure 8 MPa holding for 10 min.

b) The pellet obtained in the step a) was sealed in a silica tube under the pressure of $10^{-3}$ Pa and was initiated by point-heating a small part (usually the bottom) of the sample. Once started, a wave of exothermic reactions (combustion wave) passes through the remaining material as the liberated heat of fusion in one section is sufficient to maintain the reaction in the neighboring section of the compact. And then the pellet was cool down to room temperature in the air.

c) The obtained pellet in the step b) was crushed, hand ground into a fine powder, Single phase $Bi_2Te_3$ compounds is obtained.

Embodiment Example 1.2

Based on the new criterion, the detailed synthesis procedure of $Cu_2Se$ is as following.

(1) Elemental Cu, Se powder with high purity were Chosen as starting material.

(2) The adiabatic temperature can be calculated by using molar enthalpy of forming $Cu_2Se$ and the molar heat capacity according to the following formula. The molar enthalpy of forming $Cu_2Se$ at 298K $\Delta_f H_{298K}$ is $-66.107$ $kJmol^{-1}$.

$$-\Delta_f H_{298K}=H_T^0-H_{298K}^0=\int_{298K}^{T_{ad}}CdT$$

Assuming the adiabatic temperature is lower than the temperature of α-β phase transition of $Cu_2Se$, there is no phase transition during the combustion processing. The above formula can be simplified as below.

$$-\Delta_f H_{298K}=H_T^0-H_{298K}^0=\int_{298K}^{T_{ad}}C_p dT$$

The molar specific heat capacity in solid state of α phase $Cu_2Se$ is $58.576+0.077404T$ $Jmol^{-1}K^{-1}$. Substitute the equitation with the heat capacity and molar enthalpy of forming $Cu_2Se$. And solve the equation. The calculated adiabatic temperature can be obtained as 922.7 K, which is much higher than the temperature of α-β phase transition of $Cu_2Se$ corresponding to 395 K. it is inconsistent with the hypothesis.

Assuming the adiabatic temperature is higher than the phase transition temperature but is lower than the molten point of $Cu_2Se$, the formula can be simplified as below.

$$-\Delta_f H_{298K}=H_T^0-H_{298K}^0=\int_{298K}^{T_{tr}}C_p dT+\Delta H_{tr}+\int_{T_{tr}}^{T_{ad}}C'_p dT$$

The molar specific heat capacity in solid state of α phase and β phase $Cu_2Se$ are $58.576+0.077404T$ $Jmol^{-1}K^{-1}$, 84.098 $Jmol^{-1}K^{-1}$, respectively. The molar enthalpy of α-β phase transition of $Cu_2Se$ is 6.820 $KJ.mol^{-1}$. We substitute the equation with the specific heat capacity and molar enthalpy, and solve the equation. The adiabatic temperature can be obtained as 1001.5 K, which is higher than the α-β phase transition temperature and lower than the molten point of $Cu_2Se$. It is consistent with the hypothesis. Hence the adiabatic temperature is 1001.5 K.

$$66107=\int_{298K}^{395K}(58.576+0.077404T)dT+6820+\int_{395K}^{T_{ad}}84.098dT$$

(3) Since the molten point of Cu and Se is 1357 K, 494 K respectively. The component with lower melting point is Se. The ratio between the adiabatic temperature and the melting point of the component with lower melting point is 2.03. According to the new criterion for combustion synthesis, self propogating high temperature reaction between Cu and Se can be self sustained.

Embodiment Example 1.3

Based on the new criterion, the detailed synthesis procedure of PbS is as following.

(1) Elemental Pb, S powder with high purity were Chosen as starting material.

(2) The adiabatic temperature can be calculated by using molar enthalpy of forming PbS and the molar heat capacity according to the following formula. The molar enthalpy of forming PbS at 298K $\Delta_f H_{298K}$ is $-98.324$ $kJmol^{-1}$.

$$-\Delta_f H_{298K}=H_T^0-H_{298K}^0=\int_{298K}^{T_{ad}}CdT$$

Assuming the adiabatic temperature is lower than the molten temperature of PbS, there is no phase transition during the combustion processing. The above formula can be simplified as below.

$$-\Delta_f H_{298K}=H_T^0-H_{298K}^0=\int_{298K}^{T_{ad}}C_p dT$$

The molar specific heat capacity of PbS in solid state is $46.735+0.009205T$ $Jmol^{-1}K^{-1}$. Substitute the equitation with the heat capacity and molar enthalpy of forming PbS. And solve the equation.

$$98324=\int_{298K}^{T_{ad}}(46.4.5+0.009205T)dT$$

The calculated adiabatic temperature can be obtained as 2023 K, which is much higher than the molten point of PbS corresponding to 1392 K. it is inconsistent with the hypothesis.

Assuming the adiabatic temperature is higher than the molten point but is lower than the boiling point of PbS, the formula can be simplified as below.

$$-\Delta_f H_{298K}=H_T^0-H_{298K}^0=\int_{298K}^{T_m}C_p dT+\Delta H_m+\int_{T_m}^{T_{ad}}C''_p dT$$

The molar specific heat capacity of PbS in solid state is 46.735+0.009205T $Jmol^{-1}K^{-1}$. The molar specific heat capacity of PbS in liquid state is 61.923 $Jmol^{-1}K^{-1}$. The molar enthalpy between solid state and liquid state is 36.401 $KJmol^{-1}$. We substitute the equation with the specific heat capacity and molar enthalpy, and solve the equation. The adiabatic temperature can be obtained as 1427 K, which is higher than the molten point (1392 K) and lower than the boiling point (1609 K) of PbS. it is consistent with the hypothesis. Hence the adiabatic temperature is 1427 K.

$$98324=\int_{298K}^{1392K}(46.435+0.009205T)dT+36401+\int_{1392K}^{T_{ad}}61.923dT$$

(3) Since the molten point of Pb and S is 600 K, 388 K respectively. The component with lower melting point is S. The ratio between the adiabatic temperature and the melting point of the component with lower melting point is 3.68. According to the new criterion for combustion synthesis, self propogating high temperature reaction between Pb and S can be self sustained.

By using the method above, the ratio between adiabatic temperature and the molten point of lower molten point component of $Bi_2Se_3$, PbSe, $Mg_2Sn$ and $Mg_2Si$ are calculated as shown in table 1. The ratio between adiabatic temperature and the molten point of lower molten point component of those compounds thermoelectric is larger than unit. Hence, all those compounds thermoelectric can be synthesized by SHS by choosing single elemental as starting materials. However, the adiabatic temperature of all those compounds is dramatically lower than 1800 K. As an example, the well-known and important thermoelectric compounds $Bi_2Te_3$ and $Bi_2Se_3$ have their adiabatic temperature well below 1000 K. According to the criterion $T_{ad}\geq 1800$ K suggested by Merzhanov , the reaction leading to their formation should not have been self-sustaining. Obviously, the criterion fails in the case of compound semiconductors. $Bi_2Te_3$, $Bi_2Se_3$, $Cu_2Se$, PbS, PbSe, $Mg_2Sn$ and $Mg_2Si$ can be obtained after SHS directly. Hence, all compounds which can meet the new criterion specifying that the SHS process will proceed whenever the adiabatic temperature exceeds the melting point of the lower melting point component of the compact can be synthesized by SHS.

TABLE 1

Parameters of SHS for thermoelectric materials.

| Material system | Reaction | Molar enthalpy ($kJmol^{-1}$) | Specific Heat capacity ($JK^{-1}mol^{-1}$) | Adiabatic temperature ($T_{ad}$/K) | $T_{ad}/T_{m,L}$ |
|---|---|---|---|---|---|
| $Bi_2Te_3$ | $2Bi + 3Te \rightarrow Bi_2Te_3$ | $\Delta_f H^0_{298K}$: −78.659 | $107.989 + 55.229 \times 10^{-3}T$ | 860 | 1.58 |
| $Bi_2Se_3$ | $2Bi + 3Se \rightarrow Bi_2Se_3$ | $\Delta_f H^0_{298K}$: −139.955<br>$\Delta_m H^0_{995K}$: 85.772 | $86.818 + 48.953 \times 10^{-3}T$ | 995 | 2.01 |
| $Cu_2Se$ | $2Cu + Se \rightarrow Cu_2Se$ | $\Delta_f H^0_{298K}$: −66.107<br>$\Delta_t H^0_{395K}$: 6.820 | $58.576 + 77.404 \times 10^{-3}T$<br>84.098 | 1001 | 2.03 |
| PbS | $Pb + S \rightarrow PbS$ | $\Delta_f H^0_{298K}$: −98.324<br>$\Delta_m H^0_{1392K}$: 36.401 | $46.735 + 9.205 \times 10^{-3}T$<br>61.923 | 1427 | 3.68 |
| PbSe | $Pb + Se \rightarrow PbSe$ | $\Delta_f H^0_{298K}$: −99.998<br>$\Delta_m H^0_{1350K}$: 49.371 | $47.237 + 10.000 \times 10^{-3}T$ | 1350 | 2.73 |
| $Mg_2Sn$ | $2Mg + Sn \rightarrow Mg_2Sn$ | $\Delta_f H^0_{298K}$: −80.000 | $68.331 + 35.797 \times 10^{-3}T + 1.919 \times 10^5\ T^{-2}$ | 1053 | 2.01 |
| $Mg_2Si$ | $2Mg + Si \rightarrow Mg_2Si$ | $\Delta_f H^0_{298K}$: −79.496 | $107.989 + 55.229 \times 10 - T$ | 1282 | 1.39 |

Based on the success with the combustion synthesis of $Cu_2Se$, we apply the SHS technique to $Bi_2Te_3$, $Bi_2Se_3$, $Cu_2Se$, PbTe, PbS, PbSe, SnTe, $Mg_2Sn$ and $Mg_2Si$ compounds thermoelectric. In each case, high purity powders are used as a starting material and weighed according to the desired stoichiometry above. The powders are mixed in an agate mortar and are pressed into pellets. Each respective pellet is sealed in a silica tube under the pressure of $10^{-3}$ Pa. The pellets are locally ignited at the bottom by the flame of a torch.

FIG. 1 shows XRD pattern of the powder after SHS in embodiment example 1, which indicate that single phase

Embodiment Example 2

Embodiment Example 2.1

Based on the new criterion, the detailed synthesis procedure of $MnSi_{1.70}$ is as following.

(1) Elemental Mn, Si powder with high purity were Chosen as starting material.

(2) The adiabatic temperature can be calculated by using molar enthalpy of forming $MnSi_{1.70}$ and the molar heat capacity according to the following formula. The molar enthalpy of forming $MnSi_{1.70}$ at 298K $\Delta_f H_{298K}$ is 75.60$kJmol^{-1}$.

$$-\Delta_f H_{298K}=H_T^0-H_{298K}^0=\int_{298K}^{T_{ad}}CdT$$

Assuming the adiabatic temperature is lower than the molten point of $MnSi_{1.70}$ corresponding to 1425 K, there is no phase transition during the combustion processing. The above formula can be simplified as below.

$$-\Delta_f H_{298K}=H_T^0-H_{298K}^0=\int_{298K}^{T_{ad}}C_p dT$$

The molar specific heat capacity of $MnSi_{1.70}$ in solid state is $71.927+4.615\times10^{-3}T-13.067\times10^5T^{-2}JK^{-1}mol^{-1}$. Substitute the equitation with the heat capacity and molar enthalpy of forming $MnSi_{1.70}$. And solve the equation. The calculated adiabatic temperature can be obtained as 1314 K, which is lower than the molten point of $MnSi_{1.70}$ corresponding to 1425 K. it is consistent with the hypothesis. Hence the adiabatic temperature is 1314 K.

$$\Delta_f H^0_{298K} = -75.691kjmol^{-1} = -\int_{298K}^{T_{ad}}(71.927+4.615\times10^{-3}T-13.067\times10^5T^{-2})dT = -[71.927\times(T_{ad}-298)+0.5\times4.615\times(T_{ad}^2-298^2)+13.067\times10^5(T_{ad}^{-1}-1/298)]$$

(3) Since the molten point of Mn and Si is 1519 K, 1687 K respectively. The component with lower melting point is Mn. The ratio between the adiabatic temperature and the molten point of the component with lower molten point is 0.88. According to the new criterion for combustion synthesis, self propagating high temperature reaction between Mn and Si to form $MnSi_{1.70}$ cannot be self sustained.

Embodiment Example 2.2

Based on the new criterion, the detailed synthesis procedure of $Sb_2Te_3$ is as following.

(1) Elemental Sb, Te powder with high purity were Chosen as starting material.

(2) The adiabatic temperature can be calculated by using molar enthalpy of forming $Sb_2Te_3$ and the molar heat capacity according to the following formula. The molar enthalpy of forming $Sb_2Te_3$ at 298K $\Delta_f H_{298K}$ is 56.484 $kJmol^{-1}$.

$$-\Delta_f H_{298K} = H_T^0 - H_{298K}^0 = \int_{298K}^{T_{ad}} C dT$$

Assuming the adiabatic temperature is lower than the molten point of $Sb_2Te_3$ corresponding to 890.7 K, there is no phase transition during the combustion processing. The above formula can be simplified as below.

$$-\Delta_f H_{298K} = H_T^0 - H_{298K}^0 = \int_{298K}^{T_{ad}} C_p dT$$

The molar specific heat capacity of $Sb_2Te_3$ in solid state is $112.884+53.137\times10^{-3}T\ JK^{-1}lmol^{-1}$. Substitute the equitation with the heat capacity and molar enthalpy of forming $Sb_2Te_3$. And solve the equation. The calculated adiabatic temperature can be obtained as 702 K, which is lower than the molten point of $Sb_2Te_3$ corresponding to 890.7 K. it is consistent with the hypothesis. Hence the adiabatic temperature is 702 K.

$$\Delta_f H_{298K}^0 = -56.484 kJmol^{-1} = -\int_{298K}^{T_{ad}} (112.885 + 53.137\times10^{-3}T)dT = -[112.884\times(T_{ad}-298) + 0.5\times53.137\times10^{-3}\times(T_{ad}^2 - 298^2)]$$

(3) Since the molten point of Sb and Te is 903.755 K, 722.5 K respectively. The component with lower molten point is Te. The ratio between the adiabatic temperature and the molten point of the component with lower molten point is 0.98. According to the new criterion for combustion synthesis, self propagating high temperature reaction between Sb and Te to form $Sb_2Te_3$ cannot be self sustained.

Table 2 shows the molar enthalpy of forming $Sb_2Te_3$ and $MnSi_{1.70}$ at 298 K, specific heat capacity of $Sb_2Te_3$ and $MnSi_{170}$, adiabatic temperature $T_{ad}$ and the ratio between the adiabatic temperature and the molten point of the component with lower molten point. Since the calculated ratio $T_{ad}/T_{m,L}$ for both materials is less than the unity, i.e., the heat of reaction is too low to melt the lower melting point component. This impedes the reaction speed and prevents the reaction front to self-propagate.

In order to prove that $Sb_2Te_3$ cannot be synthesized by SHS, The experimental as below has been done. The detailed synthesis procedure is as below.

(1) Stoichiometric amounts $Sb_2Te_3$ of high purity single elemental Sb, Te powders were weighed and mixed in the agate mortar and then cold-pressed into a pellet (ϕ15×18 mm) with the pressure of 8 MPa holding for 10 min.

(2) The pellet obtained in step (1) was sealed in a silica tube under the pressure of $10^{-3}$ Pa and was initiated by point-heating a small part (usually the bottom) of the sample with hand torch. Although the reaction between Sb and Te was ignited at the bottom, the combustion wave cannot be self-propagated and go through the whole pellet.

(3) The different parts of the pellet (specifically the bottom and the top of the pellet) in step (2) were characterized by XRD.

The proof for $MnSi_{1.70}$ that cannot be synthesized by SHS is the same as that of $Sb_2Te_3$. The detailed synthesis procedure is as below.

(1) Stoichiometric amounts $MnSi_{1.70}$ of high purity single elemental Mn, Si powders were weighed and mixed in the agate mortar and then cold-pressed into a pellet.

(2) The pellet was sealed in a silica tube under the pressure of $10^{-3}$ Pa and was initiated by point-heating a small part (usually the bottom) of the sample with hand torch. Although the reaction between Mn and Si was ignited at the bottom, the combustion wave cannot be self-propagated and go through the whole pellet.

(3) The different parts of the pellet (specifically the bottom and the top of the pellet) in step (2) were characterized by XRD.

Figure 2:
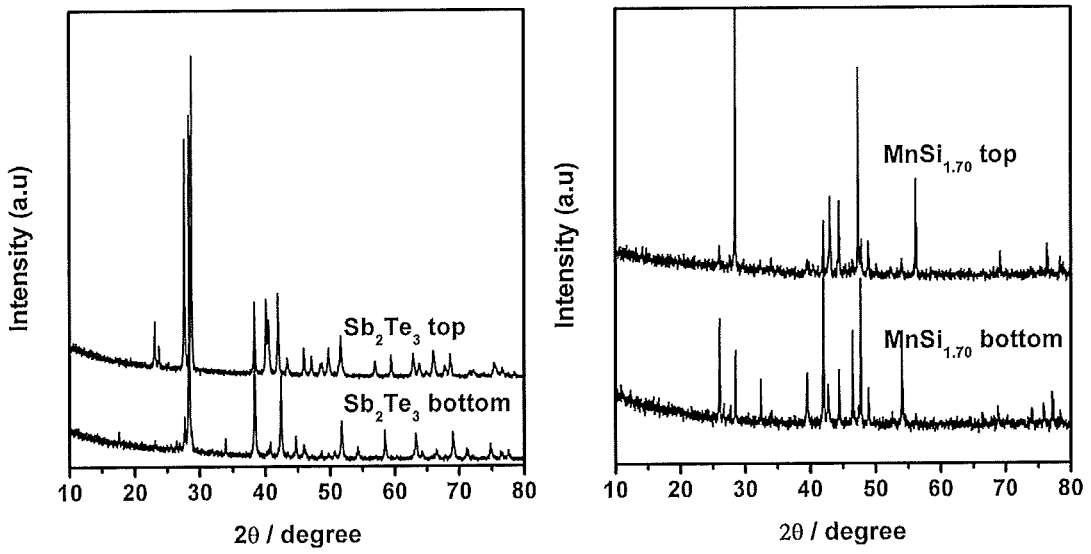
FIG. 2 shows Powder XRD pattern of $Sb_2Te_3$ and $MnSi_{1.70}$ pellets after SHS in different region for embodiment example 2.

FIG. 2 shows the XRD pattern of bottom part of the top part of the $MnSi_{1.70}$ and $Sb_2Te_3$ pellet. MnSi and $Sb_2Te_3$ compounds are observed after ignition by the torch indicating the reaction started. However at the top the pellets of the mixture none of compounds except single elemental Mn, Si, Sb, Te, is observed indicating that the reaction cannot be self-sustained after ignition.

Embodiment Example 3

Assessing available experimental data for high temperature ceramics and intermetallics, such as TiB, $ZrB_2$, $TiB_2$, TiSi, $ZrSi_2$, NiAl, CoAl, ZrC, TiC and $MoSi_2$, which can be synthesized by SHS and meet the criterion suggested by Merzhanov that the system will not be self-sustaining unless $T_{ad}$ reaches at least 1800 K. the adiabatic temperature and the ratio between adiabatic temperature and the molten point of the component with lower molten point are calculated as shown in table 3. The data indicate that the adiabatic temperature of all high temperature intermetallics (borides, carbides, silicates) is, indeed, more than 1800 K. Moreover, the ratio between adiabatic temperature and the molten point of the component with lower molten point of those high

TABLE 2

Thermodynamic parameters for $Sb_2Te_3$ and $MnSi_{1.70}$.

| Material system | Reaction | Molar enthalpy ($kJmol^{-1}$) | Specific Heat capacity ($JK^{-1}mol^{-1}$) | Adiabatic temperature ($T_{ad}$/K) | $T_{ad}/T_{m,L}$ |
|---|---|---|---|---|---|
| $Sb_2Te_3$ | $2Sb + 3Te \rightarrow Sb_2Te_3$ | $\Delta_f H^0_{298K}$: −56.484 | $112.884 + 53.137\times10^{-3}T$ | 702 | 0.98 |
| $MnSi_{1.70}$ | $Mn + 1.70Si \rightarrow MnSi_{1.70}$ | $\Delta_f H^0_{298K}$: −75.601 | $71.927 + 4.615\times10^{-3}T - 13.067\times10^5 T^{-2}$ | 1314 | 0.88 |

temperature intermetallics (borides, carbides, silicates) is larger than unit, which can meet the new criterion.

TABLE 3

Thermodynamic parameter for high temperature ceramics and intermetallics

| High temperature ceramics and intermetallics | Reaction | Adiabatic temperature ($T_{ad}$/K) | $T_{ad}/T_{mL}$ |
|---|---|---|---|
| TiB | Ti + B→TiB | 3350 | 2.00599 |
| $TiB_2$ | Ti + 2B→$TiB_2$ | 3190 | 1.91018 |
| ZrB2 | Zr + 2B→$ZrB_2$ | 3310 | 1.78437 |
| TiC | Ti + C→TiC | 3210 | 1.92216 |
| ZrC | Zr + C→ZrC | 3400 | 1.83288 |
| TiSi | Ti + Si→TiSi | 2000 | 1.1976 |
| NiAl | Ni + Al→NiAl | 1910 | 2.04497 |
| CoAl | Co + Al→CoAl | 1900 | 2.03426 |
| MoSi2 | Mo + 2Si→$MoSi_2$ | 1900 | 1.12626 |
| ZrSi2 | Zr + 2Si→$ZrSi_2$ | 2063 | 1.22288 |

Figure 3:
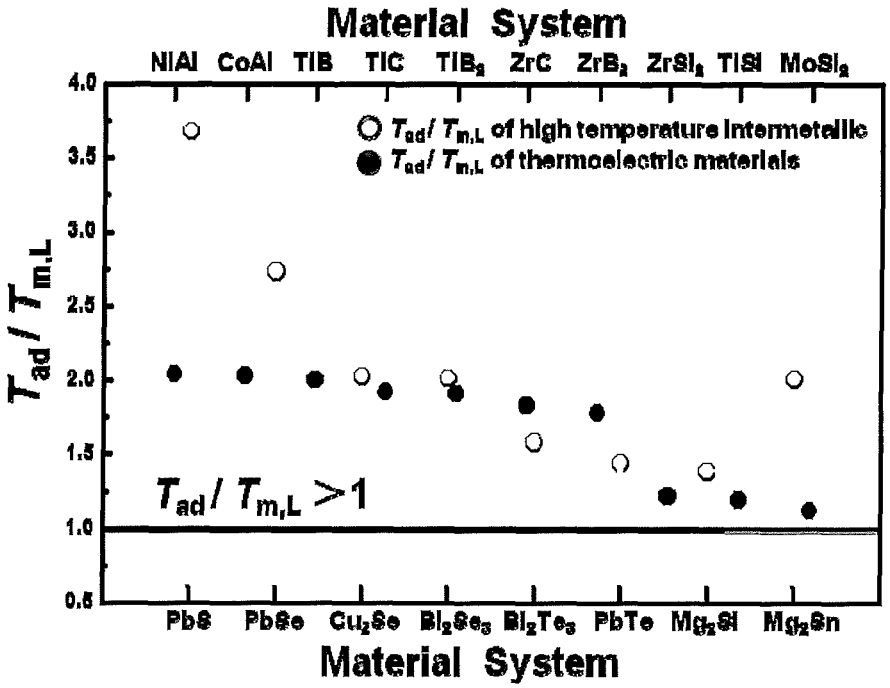
FIG. 3 shows the ratio of between $T_{ad}$ and $T_{mL}$ for compounds thermoelectrics PbS, PbSe, $Mg_2Si$, $Mg_2Sn$, $Cu_2Se$, $Bi_2Se_3$, PbTe, $Bi_2Te_3$ in embodiment example 1 and high temperature intermetallic and refractory in embodiment example 3.

FIG. 3 shows the the ratio between adiabatic temperature and the molten point of the component with lower molten point of the compounds in embodiment example 1 and the high temperature ceramics and intermetallics in embodiment example 3. It is very clear that the ratio between adiabatic temperature and the molten point of the component with lower molten point of those high temperature intermetallics (borides, carbides, silicates) is larger than unit, which can meet the new criterion.

Merzhanov suggested an empirical criterion that the system will not be self-sustaining unless $T_{ad}$ reaches at least 1800 K based on high temperature ceramics and intermetallics. However, the empirical criterion restricted the scope of the material can be synthesized by SHS. In contrast, the adiabatic temperature of thermoelectric semiconductors is dramatically lower than 1800 K. According to the criterion $T_{ad} \geq 1800$ K, the reaction leading to their formation should not have been self-sustaining. Moreover, at that high temperature above 1800 K most thermoelectric compounds would decompose due to high volatility of their constituent elements. It seems hopeless for thermoelectric materials to be synthesized by SHS. In this disclosure, SHS was applied to synthesize $Bi_2Te_3$, $Bi_2Se_3$, $Bi_2S_3$, $Cu_2Se$, PbS, PbSe, SnTe, $Mg_2Sn$ and $Mg_2Si$ compounds thermoelectric for the first time. However, we failed to synthesize $Sb_2Te_3$ and $MnSi_{1.70}$ by SHS. In order to find the new thermodynamics criterion, we examined the ratio formed by the relevant thermodynamic parameters: the adiabatic temperature, $T_{ad}$, divided by the melting temperature of the lower melting point component, $T_{m,L}$. For the SHS reaction to be self-sustaining, the value of $T_{ad}/T_{m,L}$ should be more than 1.

Embodiment Example 4

The detailed procedure of the ultra-fast preparation method of high performance $Cu_2Se$ thermoelectric material with nano pores is as following.

1) Stoichiometric amounts $Cu_2Se$ of high purity single elemental Cu, Se powders were weighed and mixed in the agate mortar. And then the mixed powder was loaded into a stainless steel die and cold-pressed into a pellet with the size of ϕ12 mm under the pressure of 10 MPa.
2) The pellet obtained in step 1) was sealed in a silica tube under the pressure of $10^{-3}$ Pa and was initiated by the hot plate with the temperature of 573 K at the bottom of the sample. Once started, turn off the hot plate, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Cu_2Se$ with nanostructures is obtained.
3) The obtained pellet $Cu_2Se$ in step 2) was crushed, hand ground into a fine powder, and then the fine powder was loaded into a graphite die with size of ϕ15 mm and was vacuum sintered by PAS. The parameter for spark plasma sintering is with the temperature of 973 K with the heating rate 80 K/min and the pressure of 30 MPa holding for 3 min. The densely bulks $Cu_2Se$ with nanostructure is obtained after PAS with the size of ϕ15×3 mm. the sample was cut into the right size for measurement and microstructure characterization by diamond saw.

Figure 4:
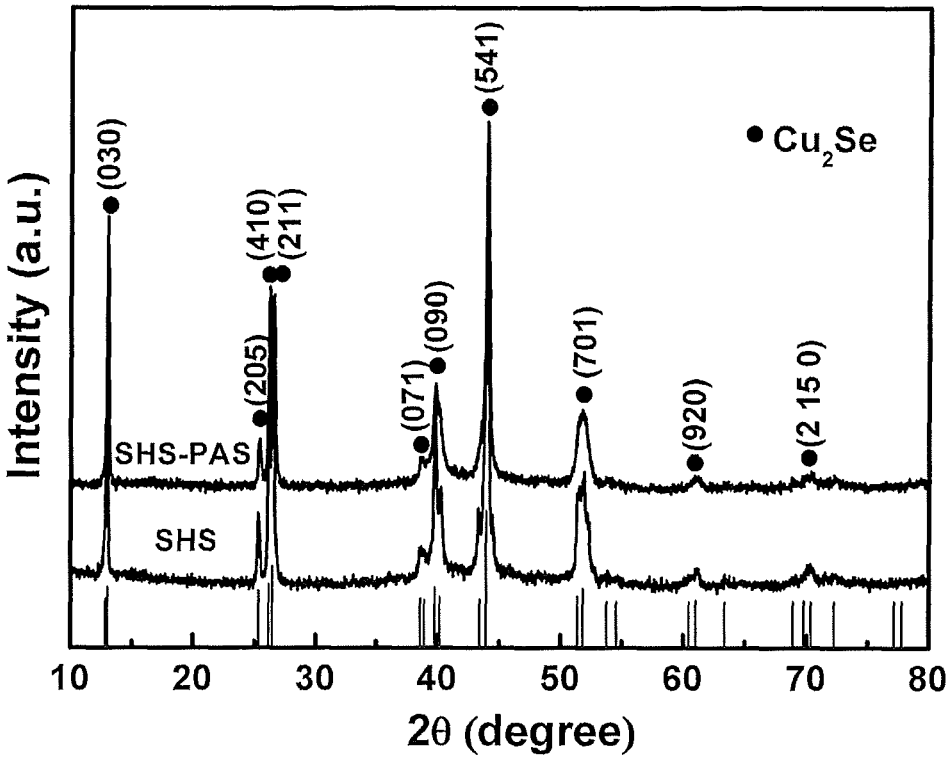
FIG. 4 shows XRD pattern of $Cu_2Se$ after SHS (in step 2) and after SHS-PAS (in step 3) of embodiment example 4.

FIG. 4 shows the powder XRD pattern of $Cu_2Se$ after SHS and after SHS-PAS. Single phase $Cu_2Se$ is obtained after SHS and after SHS-PAS.

Table 4 shows the actual composition of the powder in step 2) of embodiment example 4 and the bulks in step 3 of embodiment example 4 characterized by EPMA. The molar ratio between Cu and Se is ranged from 2.004:1 to 2.05:1. The actual composition is almost the same as the stoichiometric. This indicates that SHS-PAS technique can control the composition very precisely.

Figure 5:
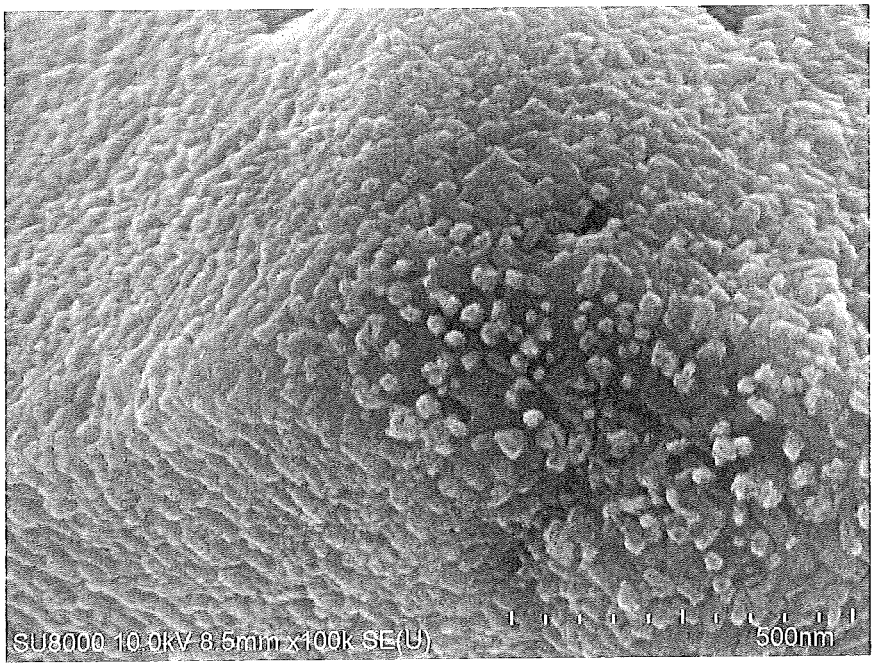
FIG. 5 shows FESEM image of $Cu_2Se$ after SHS (in step 2) of embodiment example 4
Figure 6:
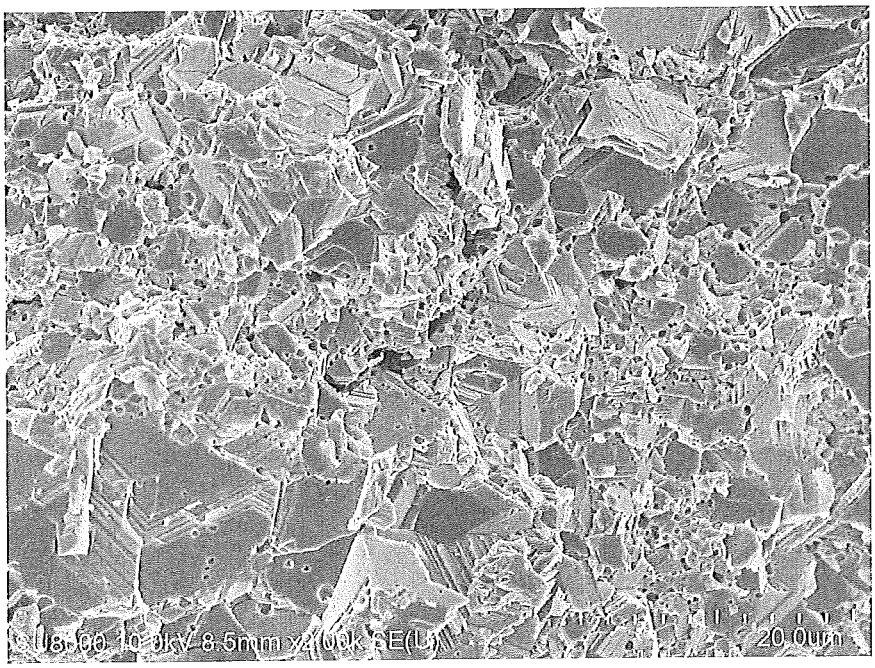
FIG. 6(*a*) and (*b*) show FESEM images of $Cu_2Se$ after SHS-PAS (in step 3) of embodiment example 4.
Figure 6:
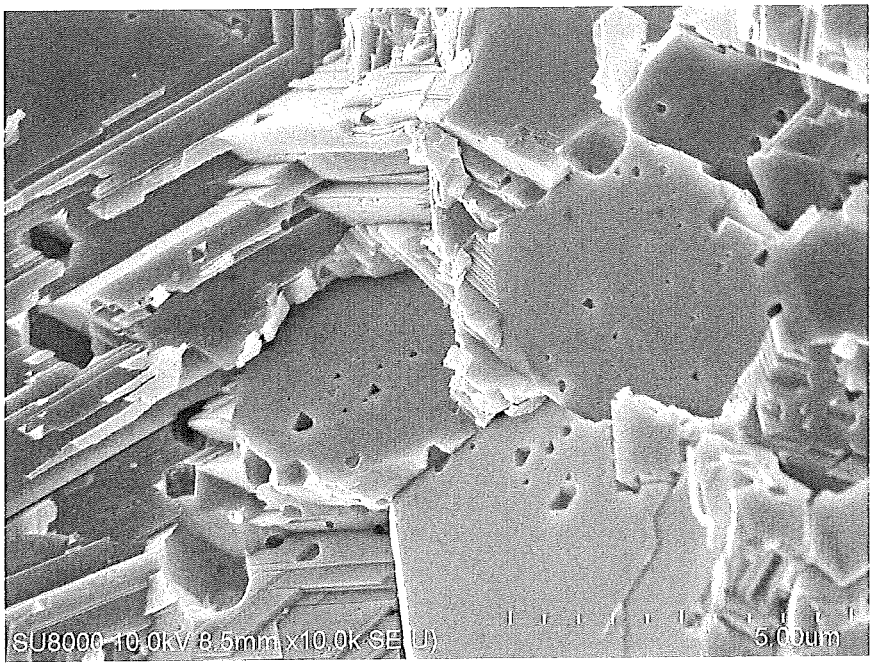

FIG. 5 shows the FESEM image of the fracture surface of the sample after SHS. Nano grains with the size of 20-50 nm distributes homogeneously on the grains in the micro-scale. FIG. 6 shows the FESEM image of the fracture surface of the sample after SHS-PAS. Lots of Nano pore with the size of 10-300 nm is observed.

Figure 7:
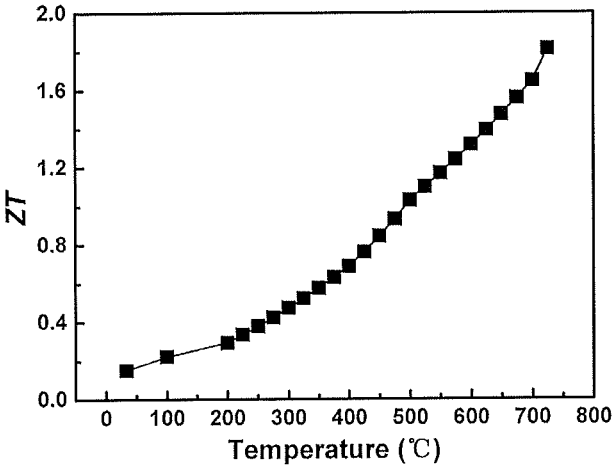
FIG. 7 shows the temperature dependence of ZT (in step 3) of embodiment example 4.

FIG. 7 show the temperature dependence of ZT for $Cu_2Se$ sample synthesized by SHS-PAS. The maximum ZT about 1.9 is attained at 1000 K, which is much higher than that reported in the reference.

TABLE 4

Nominal composition and actual composition for the powder after SHS and the bulk after SHS-PAS in the embodiment example 4.

| Sample | Nominal composition | Actual composition characterized by EPMA |
|---|---|---|
| Powder after SHS | $Cu_2Se$ | $Cu_{2.004}Se$ |
| Bulks after SHS-PAS | $Cu_2Se$ | $Cu_{2.05}Se$ |

Embodiment Example 5 A Method for Ultra-Fast Synthesis of High Thermoelectric Performance Half-Heusler

Embodiment Example 5.1

The detailed procedure of the ultra-fast preparation method of high performance ZrNiSn thermoelectric material is as following.

1) Stoichiometric amounts ZrNiSn of high purity single elemental Zr(2.5N), Ni(2.5N), Sn(2.8N) powders were weighed and mixed in the agate mortar with the weight about 5 gram. And then the mixed powder was loaded into a stainless steel die and cold-pressed into a pellet with the size of ϕ12 mm under the pressure of 6 MPa holding for 5 min.
2) The pellet obtained in step 1) was sealed in a silica tube under the pressure of $10^{-3}$ Pa and was initiated by the hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. The whole SHS process takes 2 seconds.

3) The obtained pellet ZrNiSn in step 2) was crushed, hand ground into a fine powder, and then the fine powder was loaded into a graphite die with size of ϕ15 mm and was vacuum sintered by PAS. The parameter for plasma activated sintering is with the temperature of 1163-1173 K with the heating rate 80-100 K/min and the pressure of 30 MPa holding for 5-7 min. The densely bulks ZrNiSn is obtained after PAS with the size of ϕ15×3 mm. the sample was cut into the right size for measurement and microstructure characterization by diamond saw.

Figure 8:
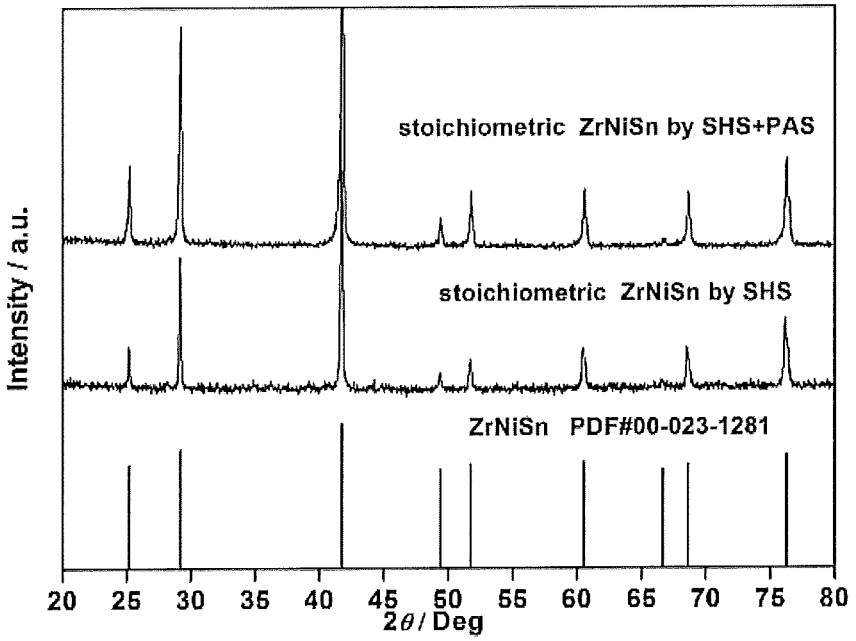
FIG. 8 shows XRD pattern of the powder in step 2 of embodiment example 5.1 and bulk in step 3 of embodiment example 5.1
Figure 9:
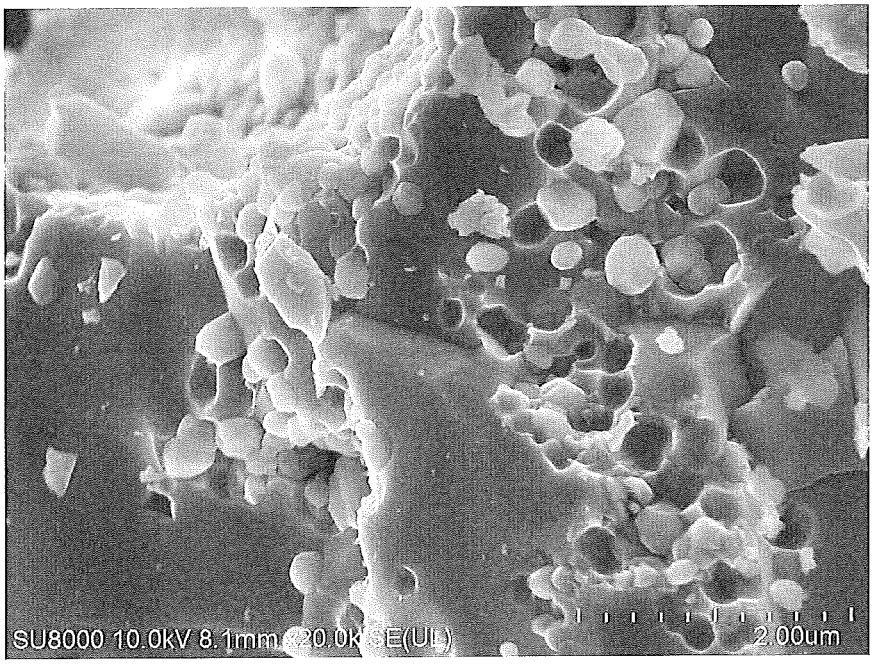
FIG. 9 shows the microstructure of the powder in step 2 of embodiment example 5.1.

The phase composition of above samples were characterized by XRD. FIG. 8 shows XRD pattern for the samples obtained in step 2) and in step 3) of embodiment example 5.1. Single phase ZrNiSn is obtained in seconds after SHS. After PAS, XRD pattern does not change. FIG. 9 shows the microstructure of the sample in step 2) of embodiment example 5.1. FESEM image shows that the sample is well crystallized with some nanostructures.

Embodiment Example 5.2

The detailed procedure of the ultra-fast preparation method of high performance $Ti_{0.5}Zr_{0.5}NiSn$ thermoelectric material is as following.

1) Stoichiometric amounts $Ti_{0.5}Zr_{0.5}NiSn$ of high purity single elemental Ti(4N), Zr(2.5N), Ni(2.5N), Sn(2.8N) powders were weighed and mixed in the agate mortar with the weight about 5 gram. And then the mixed powder was loaded into a stainless steel die and cold-pressed into a pellet with the size of ϕ12 mm under the pressure of 6 MPa holding for 5 min.
2) The pellet obtained in step 1) was sealed in a silica tube under the pressure of $10^{-3}$ Pa and was initiated by the hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. The whole SHS process takes 2 seconds.

Figure 10:
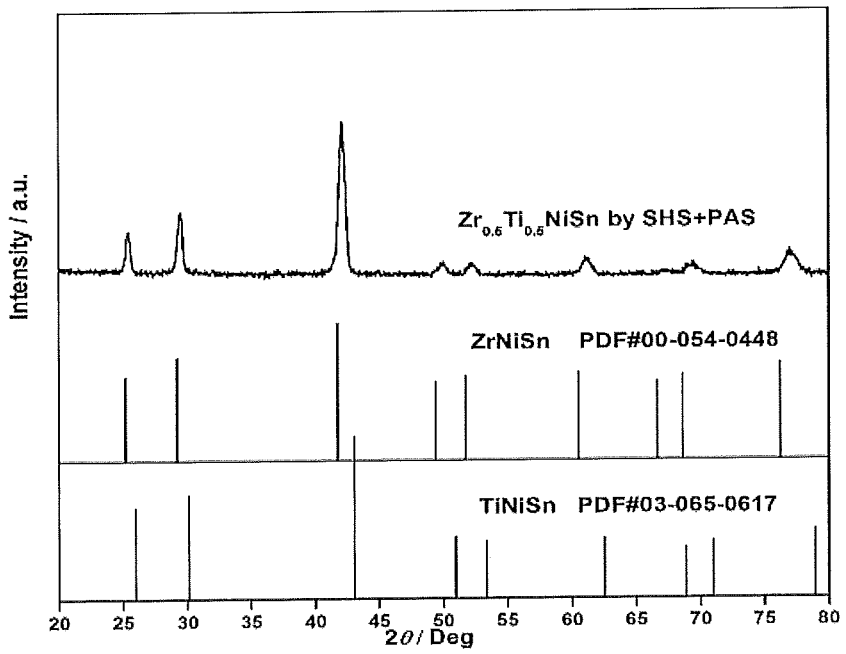
FIG. 10 shows XRD pattern of the powder in step 2 of embodiment example 5.2

The phase compositions of above samples were characterized by XRD. FIG. 10 shows XRD pattern for the samples obtained in step 2) of embodiment example 5.2. Single phase $Ti_{0.5}Zr_{0.5}NiSn$ solid solution is obtained in seconds after SHS.

Embodiment Example 5.3

The detailed procedure of the ultra-fast preparation method of high performance $ZrNiSn_{0.98}Sb_{0.02}$ thermoelectric material is as following.

1) Stoichiometric amounts $ZrNiSn_{0.98}Sb_{0.02}$ of high purity single elemental Zr(2.5N), Ni(2.5N), Sn(2.8N), Sb(5N) powders were weighed and mixed in the agate mortar with the weight about 5 gram. And then the mixed powder was loaded into a stainless steel die and cold-pressed into a pellet with the size of ϕ12 mm under the pressure of 6 MPa holding for 5 min.
2) The pellet obtained in step 1) was sealed in a silica tube under the pressure of $10^{-3}$ Pa and was initiated by the hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. The whole SHS process takes 2 seconds.
3) The obtained pellet $ZrNiSn_{0.98}Sb_{0.02}$ in step 2) was crushed, hand ground into a fine powder, and then the fine powder was loaded into a graphite die with size of ϕ15 mm and was vacuum sintered by PAS. The parameter for plasma activated sintering is with the temperature of 1163-1173 K with the heating rate 80-100 K/min and the pressure of 30 MPa holding for 5-7 min. The densely bulks $ZrNiSn_{0.98}Sb_{0.02}$ is obtained after PAS with the size of ϕ15×3 mm. The sample was cut into the right size for measurement and microstructure characterization by diamond saw.

Figure 11:
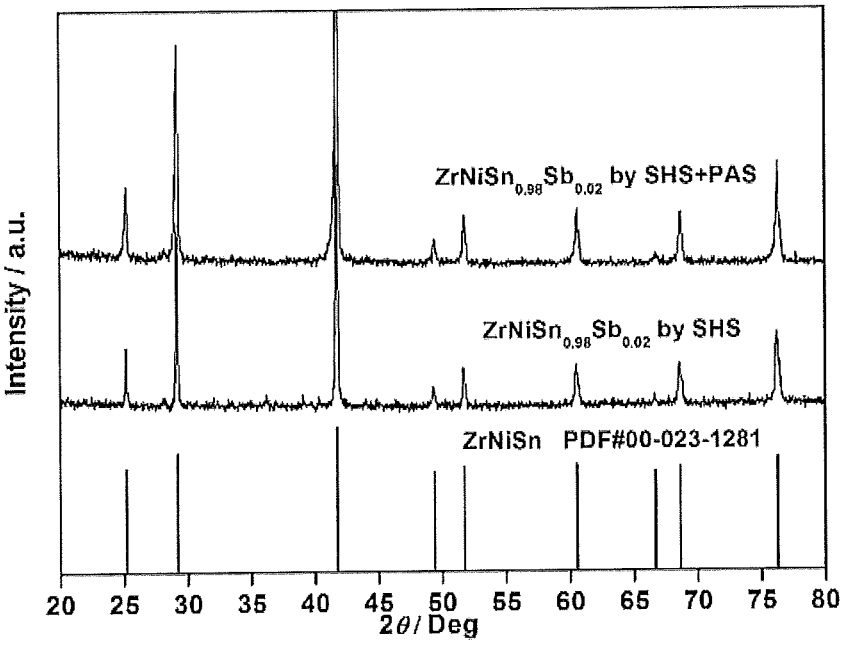
FIG. 11 shows the XRD pattern of the powder in step 2 of embodiment example 5.3 and bulk in step 3 of embodiment example 5.3
Figure 12:
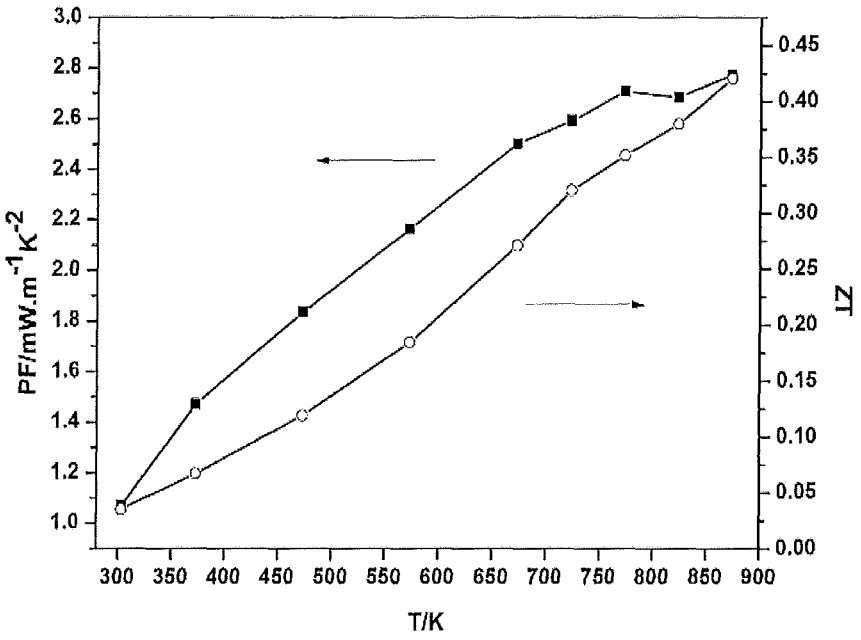
FIG. 12 shows the temperature dependence of power factor and ZT of bulks obtained in step 3 of embodiment example 5.3

The phase, microstructure and thermoelectric properties of above samples were characterized. FIG. 11 shows XRD pattern for the samples obtained in step 2) and in step 3) of embodiment example 5.3. Single phase ZrNiSn is obtained in seconds after SHS. After PAS, XRD pattern does not change. FIG. 12 shows the temperature dependence of power factor and ZT for sample in step 3) of embodiment example 5.3, which is comparable with the sample synthesized by induction melting with the same composition. At 873 K, the maximum ZT is 0.42.

Embodiment Example 6

The detailed procedure of the ultra-fast preparation method of high performance BiCuSeO thermoelectric material by SHS is as following.

1) Stoichiometric amounts BiCuSeO of high purity $Bi_2O_3$ (4N), Bi (2.5N), Cu (2.5N), Se (2.8N) powders were weighed and mixed in the agate mortar with the weight about 10 gram. And then the mixed powder was loaded into a stainless steel die and cold-pressed into a pellet with the size of ϕ12 mm under the pressure of 6 MPa holding for 5 min.
2) The pellet obtained in step 1) was sealed in a silica tube under the pressure of $10^{-3}$ Pa and was initiated by the hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. The whole SHS process takes 2 seconds.

Figure 13:
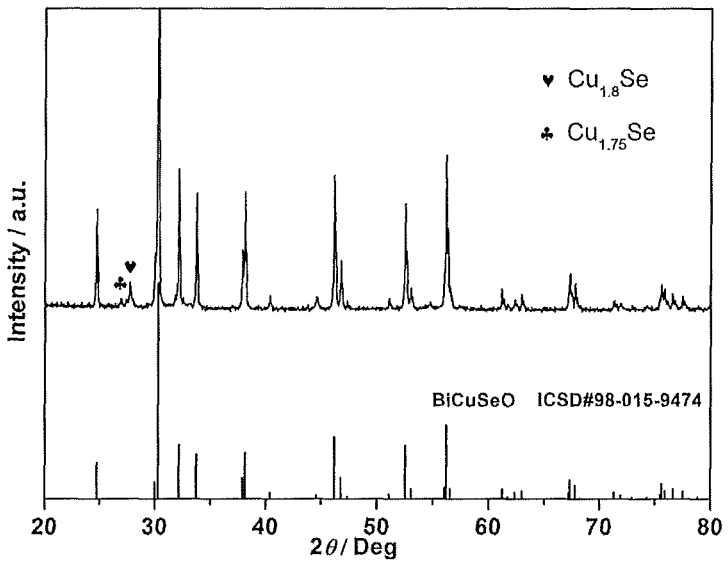
FIG. 13 shows the XRD pattern of the powder obtained in step 2 of embodiment example 6

The phase compositions of above samples were characterized by XRD. FIG. 13 shows XRD pattern for the samples obtained in step 2) of embodiment example 6. Almost Single phase BiCuSeO with trace of tiny amount $Cu_{1.75}Se$ is obtained after SHS.

Embodiment Example 7 A Method for Ultra-Fast Synthesis of n Type $Bi_2$l'e3_x$Se_x$ With High Thermoelectric Performance Embodiment Example 7.1

The detailed procedure of the ultra-fast preparation method of high performance n type $Bi_2Te_{3-x}Se_x$ thermoelectric material is as following.

1) Stoichiometric amounts $Bi_2Te_{2.7}Se_{0.3}$ of high purity single elemental Bi(4N), Te(4N), Se(4N) powders were weighed and mixed in the agate mortar with the weight about 25 gram. And then the mixed powder was loaded into a stainless steel die and cold-pressed into a pellet with the size of ϕ16 mm under the pressure of 10 MPa holding for 5 min.
2) The pellet obtained in step 1) was sealed in a silica tube under the pressure of $10^{-3}$ Pa and was initiated by hot plate with the temperature of 773 K at the bottom of the sample. Once started, turn off the hot plate, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Bi_2Te_{2.7}Se_{0.3}$ compounds is obtained after SHS.
3) The obtained pellet $Bi_2Te_{2.7}Se_{0.3}$ in step 2) was crushed, hand ground into a fine powder, and then the fine powder was loaded into a graphite die with size of ϕ15 mm and was vacuum sintered by PAS. The parameter for plasma activated sintering is with the temperature of 753 K with the heating rate 100 K/min and the pressure of 20 MPa holding for 5 min. The densely bulks $Bi_2Te_{2.7}Se_{0.3}$ is obtained after PAS with the size of ϕ15×2.5 mm. The sample was cut into the right size for measurement and microstructure characterization by diamond saw.

Figure 14:
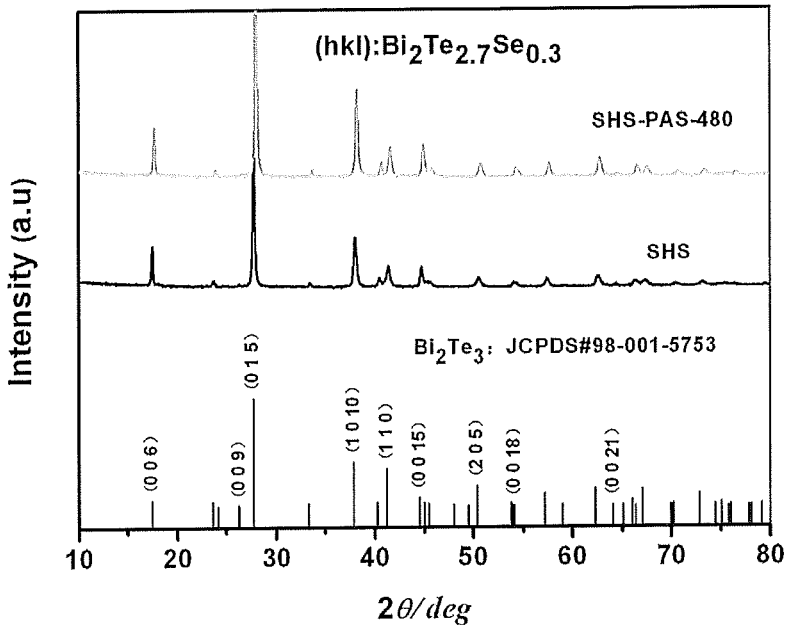
FIG. 14 shows the XRD pattern of the $Bi_2Te_{2.7}Se_{0.3}$ compound in step 2 of embodiment example 7.1 and $Bi_2Te_{2.7}Se_{0.3}$ bulk in step 3 of embodiment example 7.1

FIG. 14 shows XRD pattern for the samples obtained in step 2) and in step 3) of embodiment example 7.1. Single phase $Bi_2Te_{2.7}Se_{0.3}$ is obtained in seconds after SHS. After PAS, XRD pattern does not change.

Figure 15:
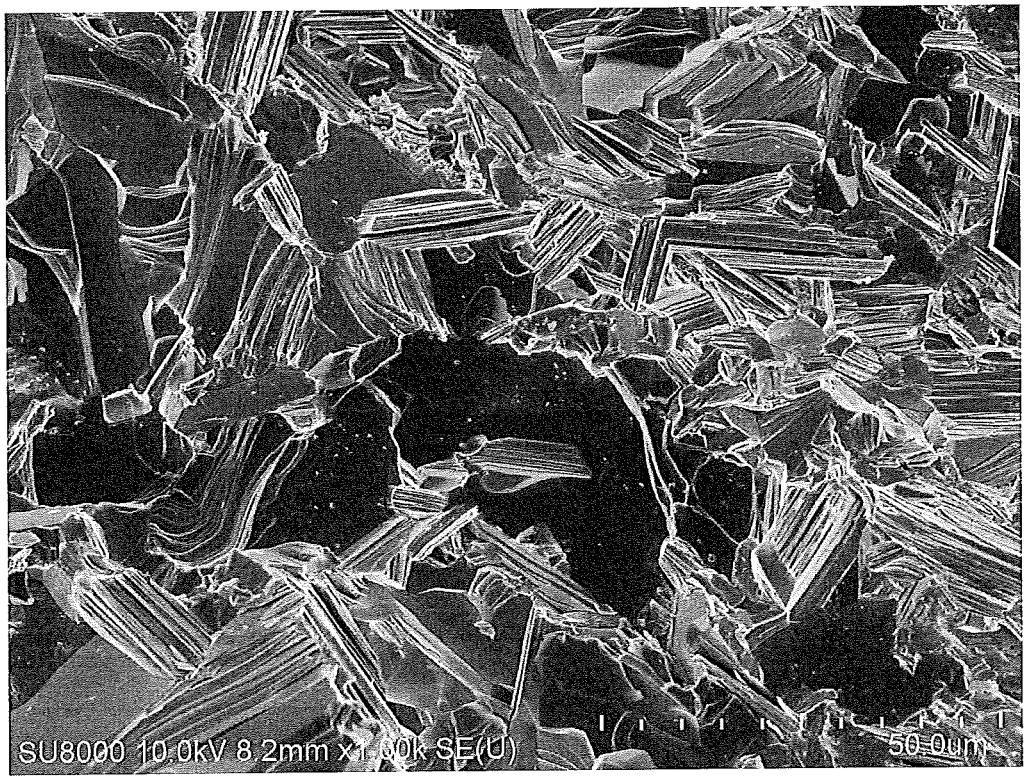
FIG. 15(*a*) shows FESEM image of $Bi_2Te_{2.7}Se_{0.3}$ after SHS-PAS (in step 3) of embodiment example 7.1.
Figure 15:
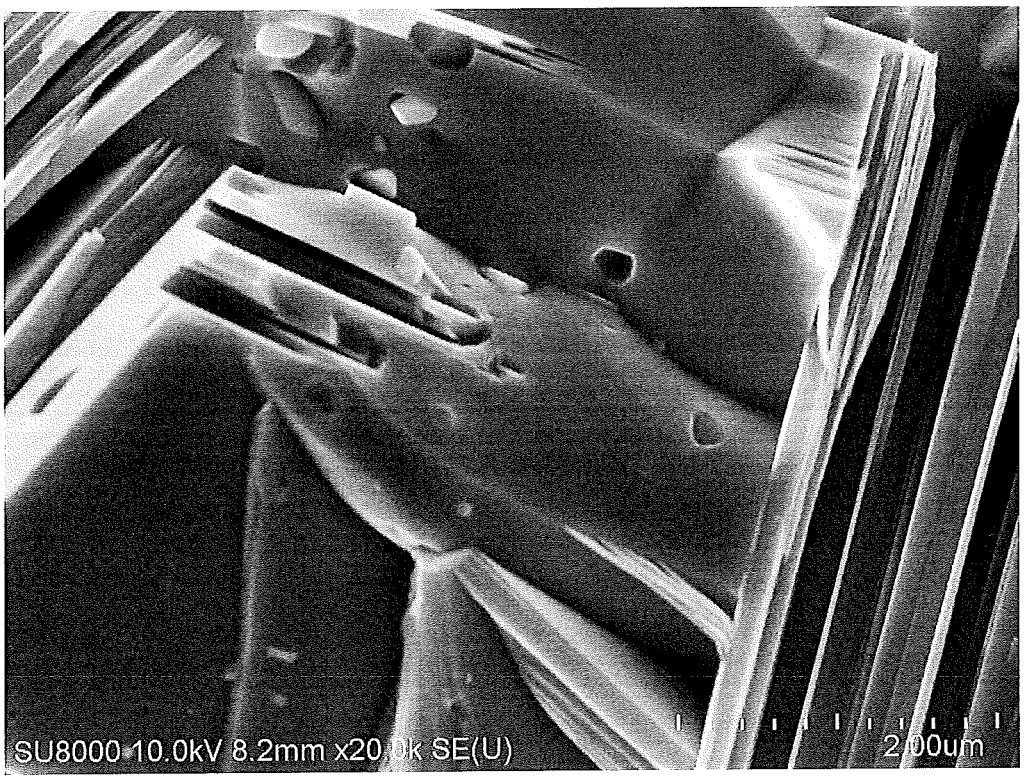

FIG. 15 shows the FESEM image of the sample in step 3) of embodiment example 7.1. FESEM image shows typical layer structure is obtained with random distributed grains, indicating no preferential orientation.

Figure 16:
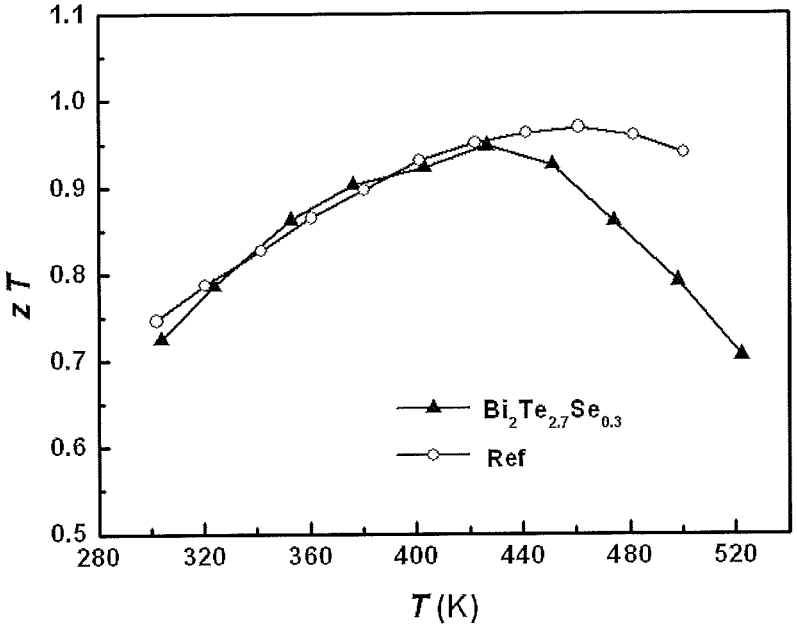
FIG. 16 shows temperature dependence of ZT for $Bi_2Te_{2.7}Se_{0.3}$ compound (in step 3) of embodiment example 7.1 and the data from the reference.

FIG. 16 shows the temperature dependence of ZT for $Bi_2Te_{2.7}Se_{0.3}$. In comparison with the sample with the composition of $Bi_{1.9}Sb_{0.1}Te_{2.55}Se_{0.45}$ in the reference (Shanyu Wang, J. Phys. D: Appl. Phys, 2010, 43, 335404) synthesized by Melting spinning combined with Spark plasma sintering. At 426 K, the maximum ZT of sample in step 3 of embodiment 7.1 is 0.95. At the temperature ranged from 300 K to 520 K, the average ZT value is larger than 0.7.

Embodiment Example 7.2

The detailed procedure of the ultra-fast preparation method of high performance n type $Bi_2Te_{3-x}Se_x$ thermoelectric material is as following.

1) Stoichiometric amounts $Bi_2Te_{2.7}Se_{0.3}$ of high purity single elemental Bi(4N), Te(4N), Se(4N) powders were weighed and mixed in the agate mortar with the weight about 25 gram. And then the mixed powder was loaded into a stainless steel die and cold-pressed into a pellet with the size of ϕ16 mm under the pressure of 10 MPa holding for 5 min.
2) The pellet obtained in step 1) was sealed in a silica tube under the pressure of $10^{-3}$ Pa and was initiated by global explosion at 773 K in the furnace for 3 min. And then the pellet was cool down to room temperature in the air. Single phase $Bi_2Te_{2.7}Se_{0.3}$ compounds is obtained after SHS.

Figure 17:
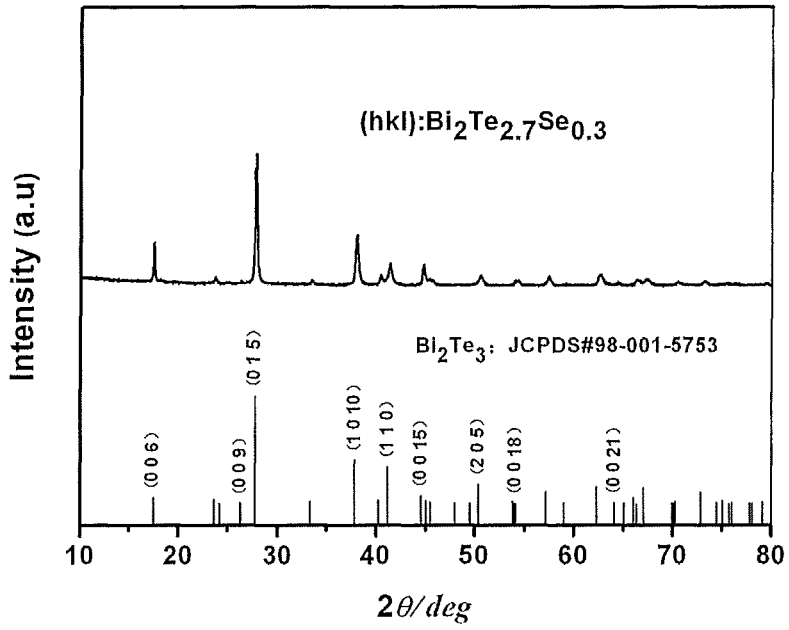
FIG. 17 shows the XRD pattern of the $Bi_2Te_{2.7}Se_{0.3}$ compound in step 2 of embodiment example 7.2

FIG. 17 shows XRD pattern for the samples obtained in step 2) of embodiment example 7.2. Single phase $Bi_2Te_{2.7}Se_{0.3}$ is obtained in seconds after global ignition.

Embodiment Example 7.3

The detailed procedure of the ultra-fast preparation method of high performance n type $Bi_2Te_{3-x}Se_x$ thermoelectric material is as following.

1) Stoichiometric amounts $Bi_2Te_2Se$ of high purity single elemental Bi(4N), Te(4N), Se(4N) powders were weighed and mixed in the agate mortar with the weight about 25 gram. And then the mixed powder was loaded into a stainless steel die and cold-pressed into a pellet with the size of ϕ16 mm under the pressure of 10 MPa holding for 5 min.
2) The pellet obtained in step 1) was sealed in a silica tube under the pressure of $10^{-3}$ Pa and was initiated by hot plate with the temperature of 773 K at the bottom of the sample. Once started, turn off the hot plate, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Bi_2Te_2Se$ compounds is obtained after SHS.

Figure 18:
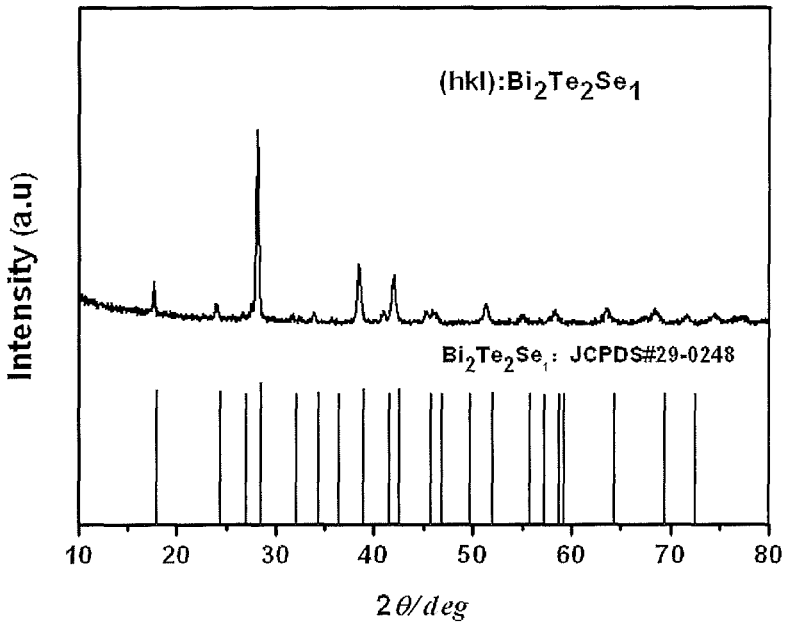
FIG. 18 shows the XRD pattern of the $Bi_2Te_2Se$ compound in step 2 of embodiment example 7.3

FIG. 18 shows the XRD pattern for the samples obtained in step 2) of embodiment example 7.3. Single phase $Bi_2Te_2Se$ is obtained in seconds after SHS.

Embodiment Example 8 A New Methods for Ultra-Fast Synthesis of $PbS_{1-x}Se_x$ With High Thermoelectric Performance Embodiment Example 8.1

The detailed procedure of the ultra-fast preparation method of high performance n type $PbS_{1-x}Se_x$ thermoelectric material is as following.

1) Stoichiometric amounts $PbS_{0.22}Se_{0.8}$ of high purity single elemental Pb(4N), S(4N), Se(4N) powders were weighed and mixed in the agate mortar with the weight about 4.5 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.
2) The pellet obtained in step 1) was initiated by hand torch at the bottom of the sample. Once started, move away the hand torches, a wave of exothermic reactions (combustion wave) passes through the remaining material as the liberated heat of fusion in one section is sufficient to maintain the reaction in the neighboring section of the compact. And then the pellet was cool down to room temperature in the air.
3) The obtained pellet in step 2) was crushed, hand ground into a fine powder for XRD characterization.

Figure 19:
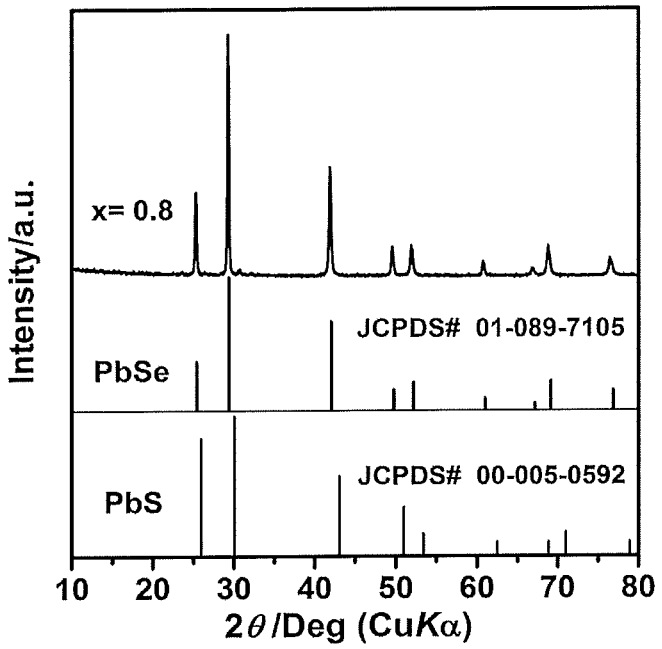
FIG. 19 shows the XRD pattern of powder after SHS in embodiment example 8.1

FIG. 19 shows XRD pattern for the samples obtained in step 3) of embodiment example 8.1. Single phase $PbS_{0.2}Se_{0.8}$ solid solution is obtained in seconds after SHS.

Embodiment Example 8.2

The detailed procedure of the ultra-fast preparation method of high performance n type $PbS_{1-x}Se_x$ thermoelectric material is as following.

1) Stoichiometric amounts $PbS_{0.42}Se_{0.6}$ of high purity single elemental Pb(4N), S(4N), Se(4N) powders were weighed and mixed in the agate mortar with the weight about 4.5 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder for XRD characterization.

Figure 20:
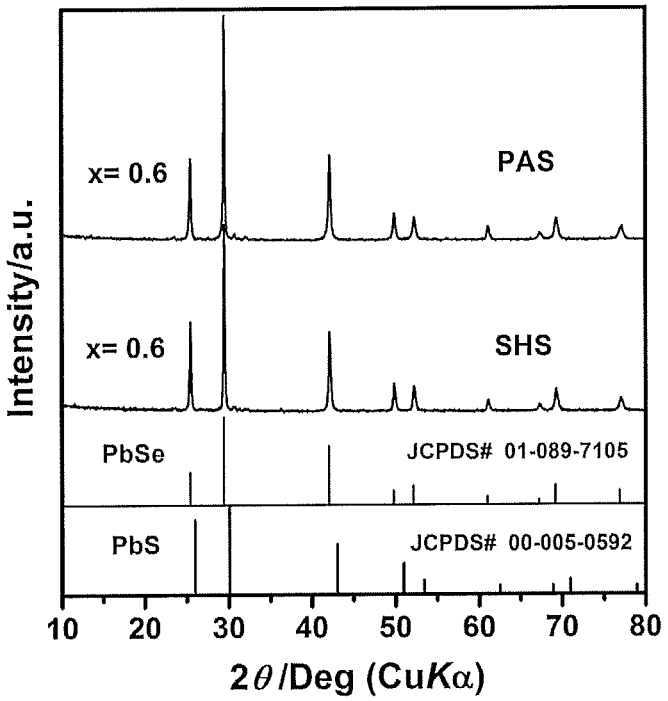
FIG. 20 shows the XRD pattern of powder after SHS and after SHS-PAS of embodiment example 8.2

FIG. 20 shows XRD pattern for the samples obtained in step 2) and in step 3) of embodiment example 8.2. Single phase $PbS_{0.4}Se_{0.6}$ is obtained in seconds after SHS. After PAS, XRD pattern does not change.

Embodiment Example 8.3

The detailed procedure of the ultra-fast preparation method of high performance n type $PbS_{1-x}Se_x$ thermoelectric material is as following.

1) Stoichiometric amounts $PbS_{0.62}Se_{0.4}$ of high purity single elemental Pb(4N), S(4N), Se(4N) powders were weighed and mixed in the agate mortar with the weight about 4.5 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder for XRD measurement.

Figure 21:
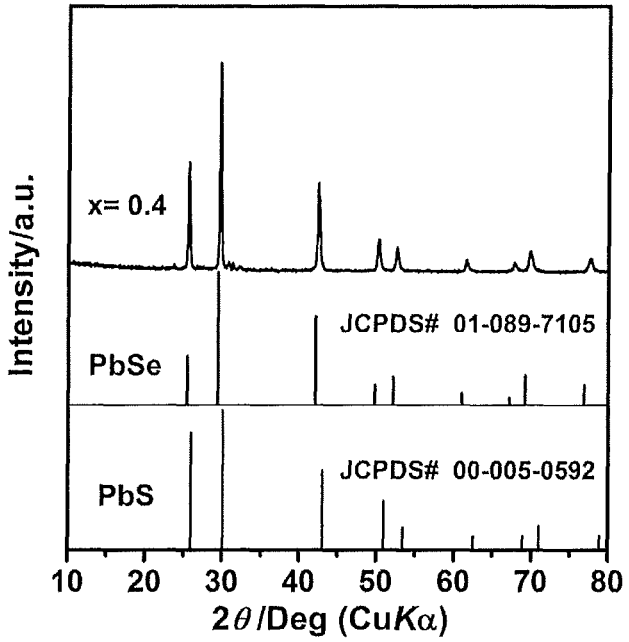
FIG. 21 shows the XRD pattern of powder after SHS in embodiment example 8.3

FIG. 21 shows XRD pattern for the samples obtained in step 3) of embodiment example 8.3. Single phase $PbS_{0.6}Se_{0.4}$ is obtained in seconds after SHS.

Embodiment Example 8.4

The detailed procedure of the ultra-fast preparation method of high performance n type $PbS_{1-x}Se_x$ thermoelectric material is as following.

1) Stoichiometric amounts $PbS_{0.82}Se_{0.2}$ of high purity single elemental Pb(4N), S(4N), Se(4N) powders were weighed and mixed in the agate mortar with the weight about 4.5 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder for XRD measurement.

Figure 22:
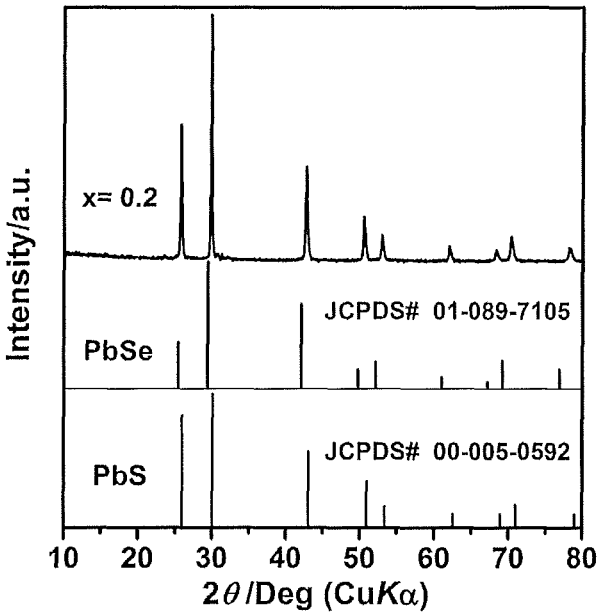
FIG. 22 shows the XRD pattern of powder after SHS in embodiment example 8.4

FIG. 22 shows XRD pattern for the samples obtained in step 3) of embodiment example 8.4. Single phase $PbS_{0.8}Se_{0.2}$ solid solution is obtained in seconds after SHS.

Embodiment Example 8.5

The detailed procedure of the ultra-fast preparation method of high performance n type $PbS_{1-x}Se_x$ thermoelectric material is as following.

1) Stoichiometric amounts $PbS_{1.02}$ of high purity single elemental Pb(4N), S(4N) powders were weighed and mixed in the agate mortar with the weight about 4.5 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder, and then the fine powder was loaded into a graphite die with size of ϕ15 mm and was vacuum sintered by PAS. The parameter for spark plasma sintering is with the temperature of 823 K with the heating rate 100 K/min and the pressure of 35 MPa holding for 7 min. The densely bulks PbS is obtained after PAS with the size of ϕ15 ×2.5 mm. The sample was cut into the right size for measurement and microstructure characterization by diamond saw.

Figure 23A:
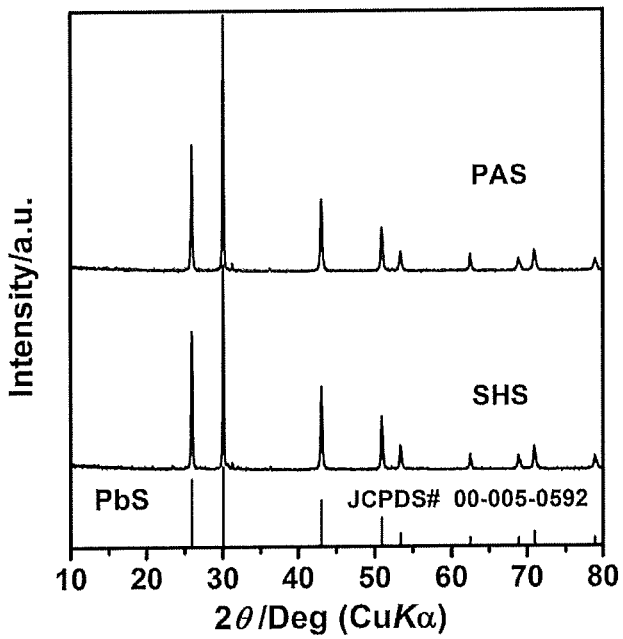
FIG. 23(*a*) shows the XRD pattern of powder after SHS and after SHS-PAS of embodiment example 8.5.
Figure 23B:
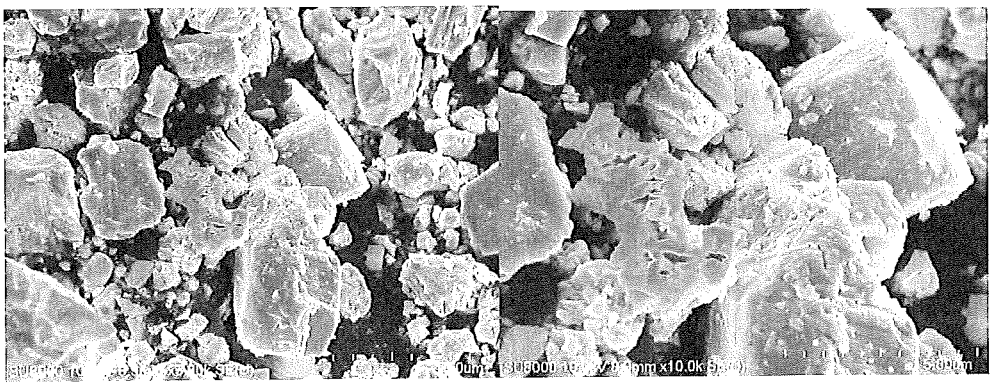
Figure 23C:
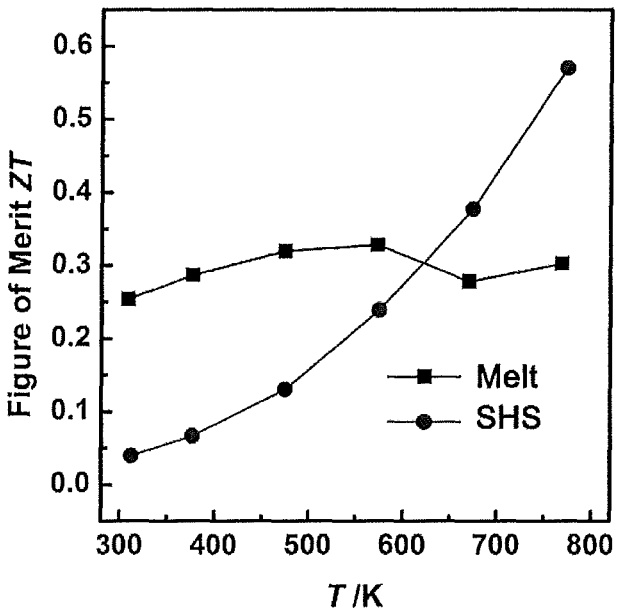

FIG. 23(*a*) shows XRD pattern for the samples obtained in step 2) and in step 3) of embodiment example 8.5. FIG. 23(*b*) shows FESEM image of the sample in step 2) of embodiment example 8.5. FIG. 23(*c*) shows temperature dependence of ZT for the sample synthesized by SHS-PAS and traditional melting method.

As shown in FIG. 23, Single phase PbS is obtained in seconds after SHS. The grain size distributes in very large scales. After PAS, Single phase PbS can be maintained. In comparison with the sample synthesized by traditional method, the average ZT above 600 K is much higher for the sample synthesized by SHS-PAS. At 875 K, the maximum ZT is 0.57, which is one time higher than the sample synthesized by traditional method.

Embodiment Example 9 A New Methods for Ultra-Fast Synthesis of $Mg_2Si$ With High Thermoelectric Performance Embodiment Example 9.1

The detailed procedure of the ultra-fast preparation method of high performance n type $Mg_2Si$ based thermoelectric material is as following.

1) Stoichiometric amounts $Mg_{2.04}Si_{0.996}Sb_{0.004}$ of high purity single elemental Mg (4N), Si (4N), Sb (6N) powders were weighed and mixed in the agate mortar with the weight about 2.1 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder, and then the fine powder was loaded into a graphite die with size of ϕ15 mm and was vacuum sintered by PAS. The parameter for spark plasma sintering is with the temperature of 1073 K with the heating rate 100 K/min and the pressure of 33 MPa holding for 7 min. The densely bulks $Mg_2Si_{0.996}Sb_{0.004}$ is obtained after PAS with the size of ϕ15×2.5 mm. The sample was cut into the right size for measurement and microstructure characterization by diamond saw.

Figure 24A:
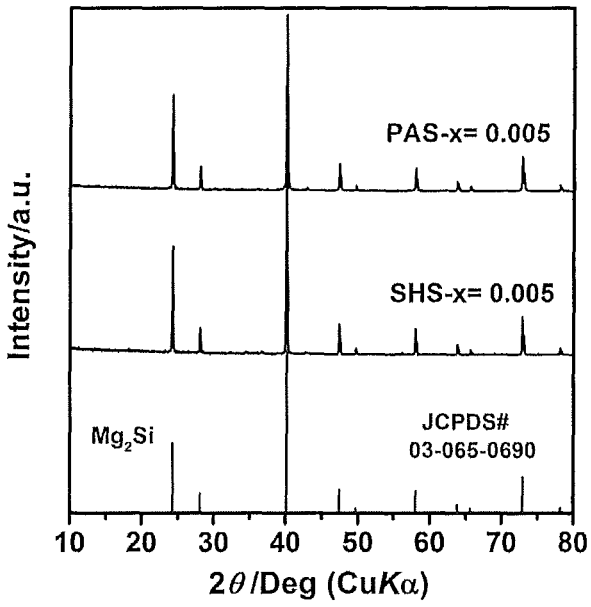
FIG. 24(*a*) shows the XRD pattern of powder after SHS and after SHS-PAS of embodiment example 9.1.
Figure 24B:
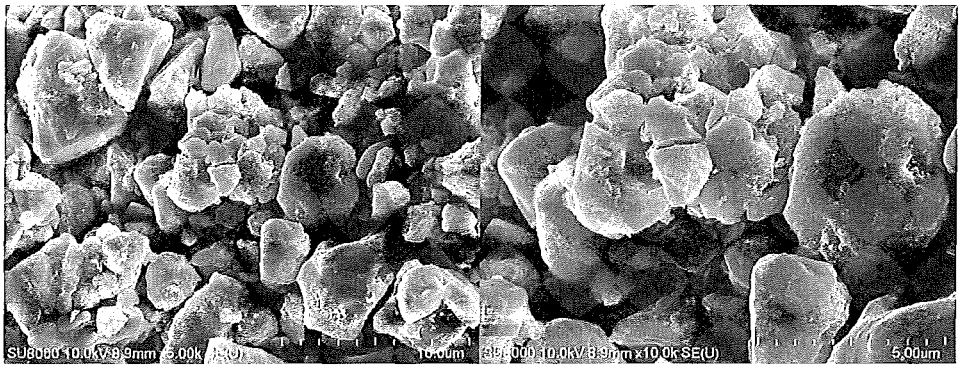
Figure 24C:
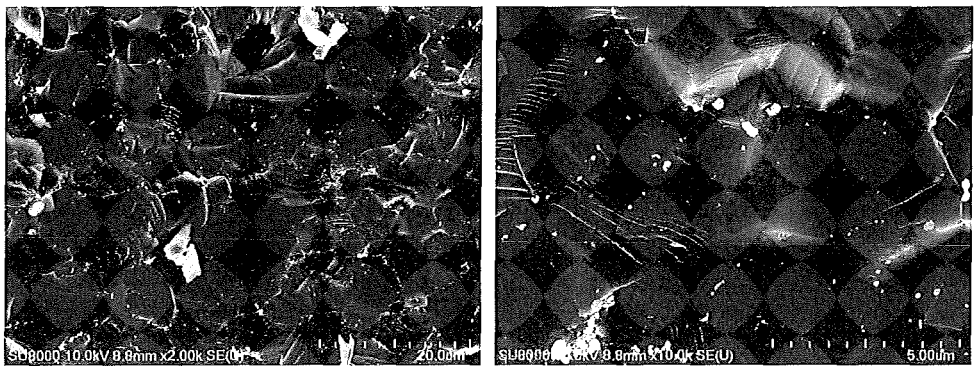

FIG. 24(*a*) shows XRD pattern for the samples obtained in step 2) and in step 3) of embodiment example 9.1. FIG. 24(*b*) shows FESEM image of the sample in step 2) of embodiment example 9.1. FIG. 24(*c*) shows FESEM image of the sample in step 3) of embodiment example 9.1. As shown in FIG. 24, Single phase $Mg_2Si$ is obtained in seconds after SHS. The grain size distributes in very large scales. After PAS, Single phase $Mg_2Si$ can be maintained. The relative density of sample is about 98%. Many cleavage planes (the transgranular fracture) can be seen in the cross section.

Embodiment Example 9.2

The detailed procedure of the ultra-fast preparation method of high performance n type $Mg_2Si$ based thermoelectric material is as following.

1) Stoichiometric amounts $Mg_{2.04}Si_{0.99}Sb_{0.01}$ of high purity single elemental Mg (4N), Si (4N), Sb (6N) powders were weighed and mixed in the agate mortar with the weight about 2.1 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder, and then the fine powder was loaded into a graphite die with size of ϕ15 mm and was vacuum sintered by PAS. The parameter for spark plasma sintering is with the temperature of 1073 K with the heating rate 100 K/min and the pressure of 33 MPa holding for 7 min. The densely bulks $Mg_2Si_{0.99}Sb_{0.01}$ is obtained after PAS with the size of ϕ15×2.5 mm. The sample was cut into the right size for measurement and microstructure characterization by diamond saw.

Figure 25A:
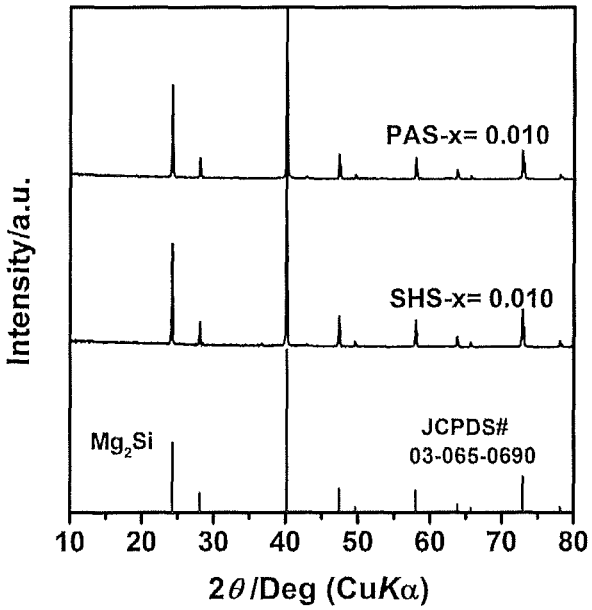
FIG. 25(*a*) shows the XRD pattern of powder after SHS and after SHS-PAS of embodiment example 9.2.
Figure 25B:
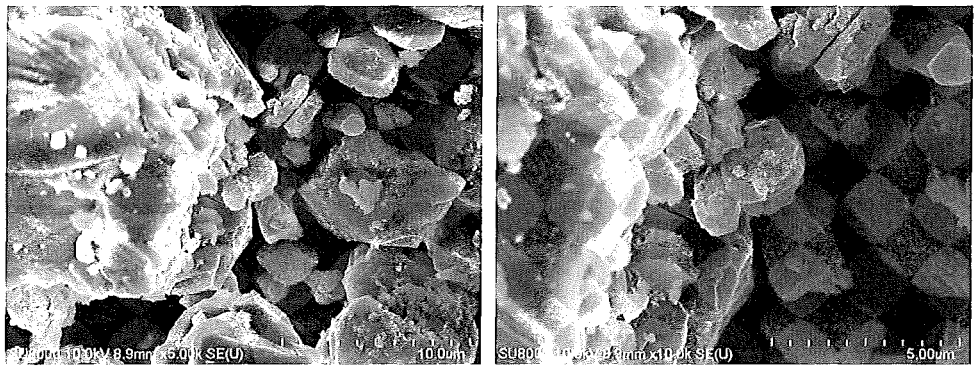
Figure 25C:
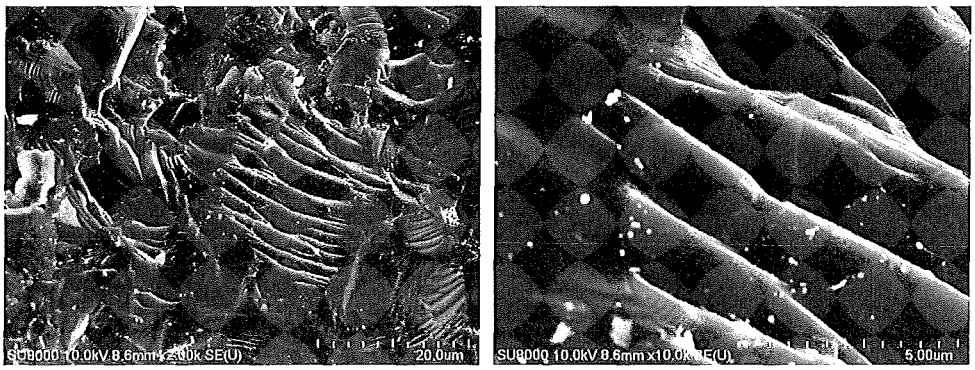

FIG. 25(*a*) shows XRD pattern for the samples obtained in step 2) and in step 3) of embodiment example 9.2. FIG. 25(*b*) shows FESEM image of the sample in step 2) of embodiment example 9.2. FIG. 25(*c*) shows FESEM image of the sample in step 3) of embodiment example 9.2. As shown in FIG. 25, Single phase $Mg_2Si$ is obtained in seconds after SHS. The grain size distributes in very large scales. After PAS, Single phase $Mg_2Si$ can be maintained. The relative density of sample is about 98%. Many cleavage planes (the transgranular fracture) can be seen in the cross section.

Embodiment Example 9.3

The detailed procedure of the ultra-fast preparation method of high performance n type $Mg_2Si$ based thermoelectric material is as following.

1) Stoichiometric amounts $Mg_{2.04}Si_{0.98}Sb_{0.02}$ of high purity single elemental Mg (4N), Si (4N), Sb (6N) powders were weighed and mixed in the agate mortar with the weight about 2.1 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder, and then the fine powder was loaded into a graphite die with size of ϕ15 mm and was vacuum sintered by PAS. The parameter for spark plasma sintering is with the temperature of 1073 K with the heating rate 100 K/min and the pressure of 33 MPa holding for 7 min. The densely bulks $Mg_2Si_{0.98}Sb_{0.02}$ is obtained after PAS with the size of ϕ15×2.5 mm. The sample was cut into the right size for measurement and microstructure characterization by diamond saw.

Figure 26A:
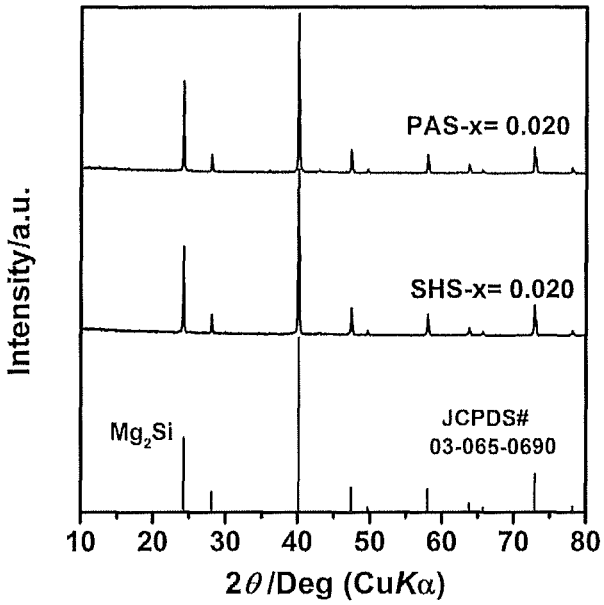
FIG. 26(*a*) shows the XRD pattern of powder after SHS and after SHS-PAS of embodiment example 9.3.
Figure 26B:
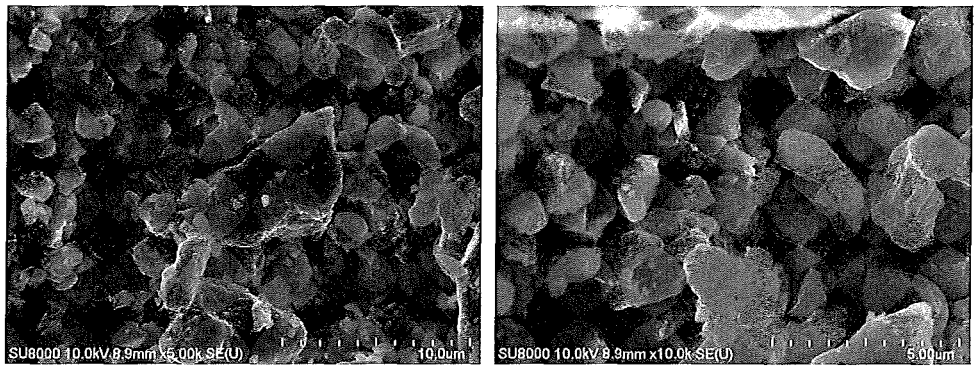
Figure 26C:
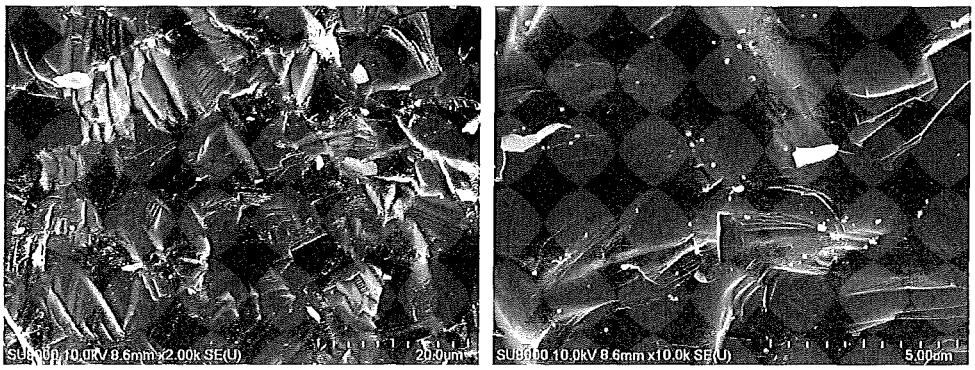

FIG. 26(*a*) shows XRD pattern for the samples obtained in step 2) and in step 3) of embodiment example 9.3. FIG. 26(*b*) shows FESEM image of the sample in step 2) of embodiment example 9.3. FIG. 26(*c*) shows FESEM image of the sample in step 3) of embodiment example 9.3. As shown in FIG. 26, Single phase $Mg_2Si$ is obtained in seconds after SHS. The grain size distributes in very large scales. After PAS, Single phase $Mg_2Si$ can be maintained. The relative density of sample is about 98%. Many cleavage planes (the transgranular fracture) can be seen in the cross section.

Embodiment Example 9.4

The detailed procedure of the ultra-fast preparation method of high performance n type $Mg_2Si$ based thermoelectric material is as following.

1) Stoichiometric amounts $Mg_{2.04}Si_{0.975}Sb_{0.025}$ of high purity single elemental Mg (4N), Si (4N), Sb (6N) powders were weighed and mixed in the agate mortar with the weight about 2.1 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.

2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.

3) The obtained pellet in step 2) was crushed, hand ground into a fine powder, and then the fine powder was loaded into a graphite die with size of ϕ15 mm and was vacuum sintered by PAS. The parameter for spark plasma sintering is with the temperature of 1073 K with the heating rate 100 K/min and the pressure of 33 MPa holding for 7 min. The densely bulks $Mg_2Si_{0.975}Sb_{0.025}$ is obtained after PAS with the size of ϕ15×2.5 mm. The sample was cut into the right size for measurement and microstructure characterization by diamond saw.

Figure 27A:
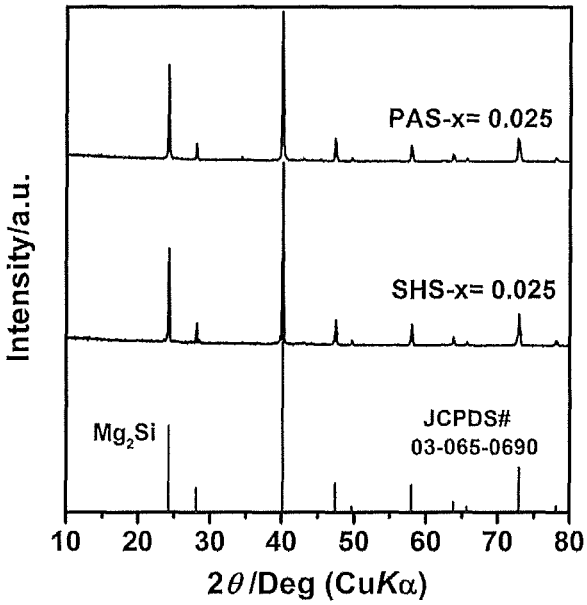
FIG. 27(*a*) shows the XRD pattern of powder after SHS and after SHS-PAS of embodiment example 9.4.
Figure 27B:
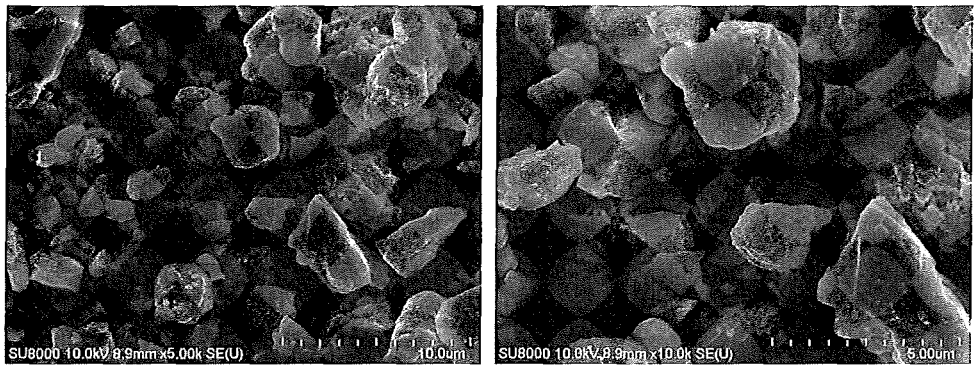
Figure 27C:
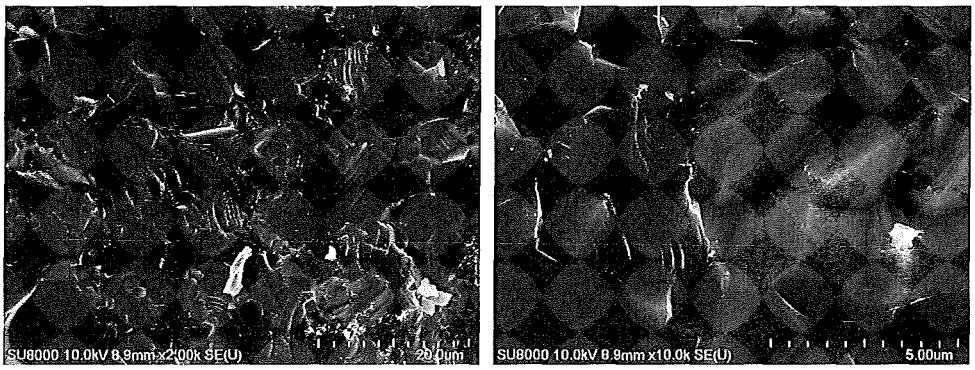
Figure 28A:
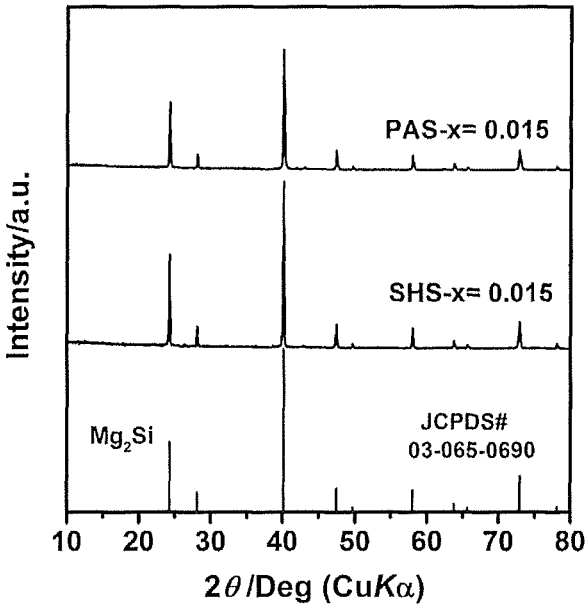
FIG. 28(*a*) shows the XRD pattern of powder after SHS and after SHS-PAS of embodiment example 9.5.
Figure 28B:
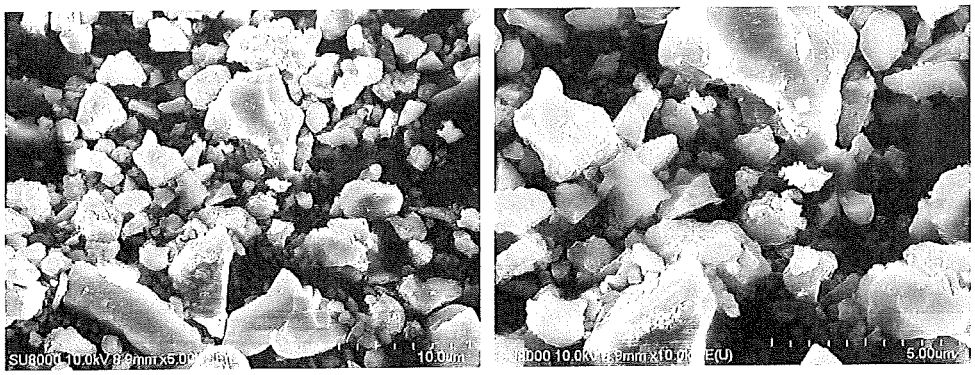
Figure 28C:
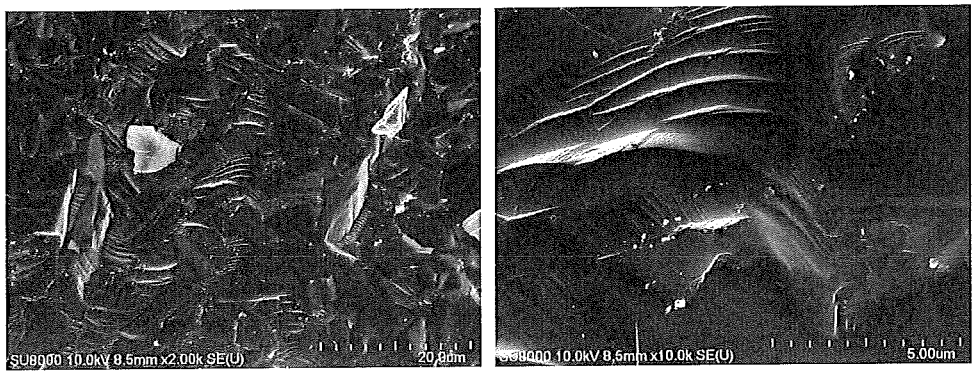
Figure 28D:
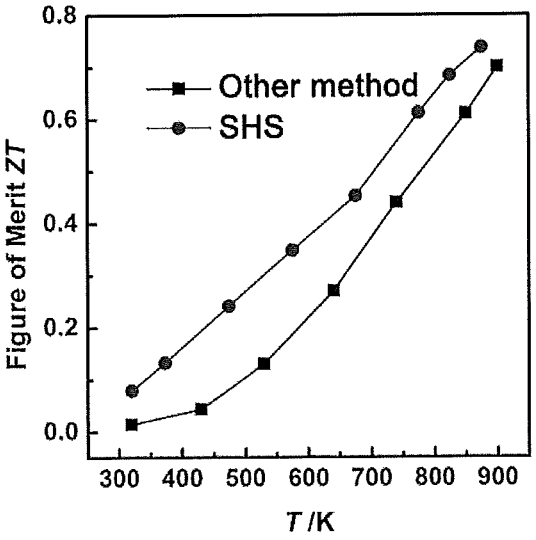

FIG. 27(*a*) shows XRD pattern for the samples obtained in step 2) and in step 3) of embodiment example 9.4. FIG. 27(*b*) shows FESEM image of the sample in step 2) of embodiment example 9.4. FIG. 27(*c*) shows FESEM image of the sample in step 3) of embodiment example 9.4. As shown in FIG. 27, Single phase $Mg_2Si$ is obtained in seconds after SHS. The grain size distributes in very large scales. After PAS, Single phase $Mg_2Si$ can be maintained. The relative density of sample is about 98%. Many cleavage planes (the transgranular fracture) can be seen in the cross section.

Embodiment Example 9.5

The detailed procedure of the ultra-fast preparation method of high performance n type $Mg_2Si$ based thermoelectric material is as following.

1) Stoichiometric amounts $Mg_{2.04}Si_{0.985}Sb_{0.015}$ of high purity single elemental Mg (4N), Si (4N), Sb (6N) powders were weighed and mixed in the agate mortar with the weight about 2.1 gram. And then the mixed powder was loaded into a stainless steel die and cold-pressed into a pellet with the size of ϕ10 mm under the pressure of 5 MPa holding for 5 min, and then increase the pressure to 8 MPa holding for 10 min.
2) The pellet obtained in step 1) was initiated by hand torch at the bottom of the sample in the air. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air.
3) The obtained pellet in step 2) was crushed, hand ground into a fine powder, and then the fine powder was loaded into a graphite die with size of ϕ15 mm and was vacuum sintered by PAS. The parameter for spark plasma sintering is with the temperature of 1073 K with the heating rate 100 K/min and the pressure of 33 MPa holding for 7 min. The densely bulks $Mg_2Si_{0.985}Sb_{0.015}$ is obtained after PAS with the size of ϕ15×2.5 mm. The sample was cut into the right size for measurement and microstructure characterization by diamond saw.

FIG. 28(*a*) shows XRD pattern for the samples obtained in step 2) and in step 3) of embodiment example 9.5. FIG. 28(*b*) shows FESEM image of the sample in step 2) of embodiment example 9.5. FIG. 28(*c*) shows FESEM image of the sample in step 3) of embodiment example 9.5. FIG. 28(*d*) shows temperature dependence of ZT for $Mg_2Si_{0.985}Sb_{0.015}$ synthesized by SHS-PAS and traditional method in the reference (J. Y. Jung, K. H. Park, I. H. Kim, Thermoelectric Properties of Sb-doped $Mg_2Si$ Prepared by Solid-State Synthesis. IOP Conference Series: Materials Science and Engineering 18, 142006 (2011).). As shown in FIG. 28, Single phase $Mg_2Si$ is obtained in seconds after SHS. The grain size distributes in very large scales. After PAS, Single phase $Mg_2Si$ can be maintained. The relative density of sample is about 98%. Many cleavage planes (the transgranular fracture) can be seen in the cross section. The maximum ZT for the sample synthesized by SHS-PAS is 0.73, which is the best value for Sb doped $Mg_2Si$.

Embodiment Example 10 A Methods for Ultra-Fast Synthesis of $Cu_aMSn_bSe_4$ Powder Embodiment Example 10.1

Here we choose Sb as M, and a is equal to 3. b is equal to 0. The Stoichiometric of the compound is $Cu_3SbSe_4$.

The detailed procedure of the ultra-fast preparation method of $Cu_3SbSe_4$ thermoelectric material is as following.

1) Stoichiometric amounts $Cu_3Sb_{1.01}Se_4$ of high purity single elemental Cu (4N), Se (4N), Sb (6N) powders were weighed and mixed in the agate mortar with the weight about 5 gram.
2) And then the mixed powder was loaded into a stainless steel die and cold-pressed into a pellet with the size of ϕ10 mm under the pressure of 10-15 MPa holding for 5 min.
3) The pellet obtained in step 2) was initiated by putting the sealed quartz tube into the furnace for 30 s which was holding at 573 K. And then the pellet was cool down to room temperature in the air.

Figure 29:
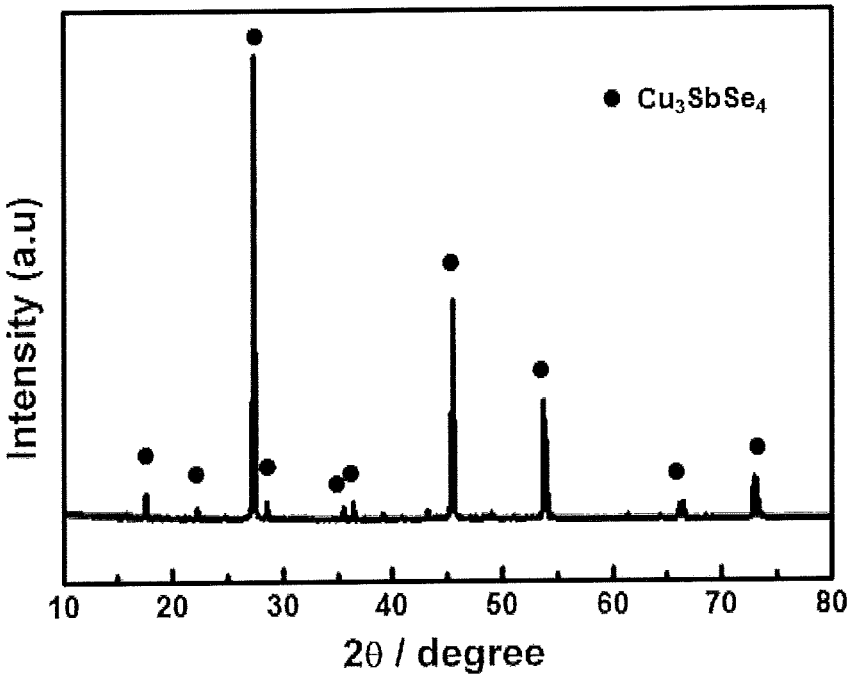
FIG. 29 shows the XRD pattern of $Cu_3SbSe_4$ powder after SHS in step 3 of embodiment example 10.1.

FIG. 29 shows XRD pattern for the samples obtained in step 3) of embodiment example 10.1. Single phase $Cu_3SbSe_4$ is obtained in 30 seconds after SHS.

Embodiment Example 10.2

Here we choose Sb as M, and a is equal to 3. b is equal to 0. The Stoichiometric of the compound is $Cu_3SbSe_4$.

The detailed procedure of the ultra-fast preparation method of $Cu_3SbSe_4$ thermoelectric material is as following.

1) Stoichiometric amounts $Cu_3Sb_{1.01}Se_4$ of high purity single elemental Cu (4N), Se (4N), Sb (6N) powders were weighed and mixed in the agate mortar with the weight about 5 gram.
2) And then the mixed powder was loaded into a stainless steel die and cold-pressed into a pellet with the size of ϕ10 mm under the pressure of 10-15 MPa holding for 5 min.
3) The pellet obtained in step 2) was initiated by putting the sealed quartz tube into the furnace for 30 s which was holding at 773 K. And then the pellet was cool down to room temperature in the air.

Figure 30:
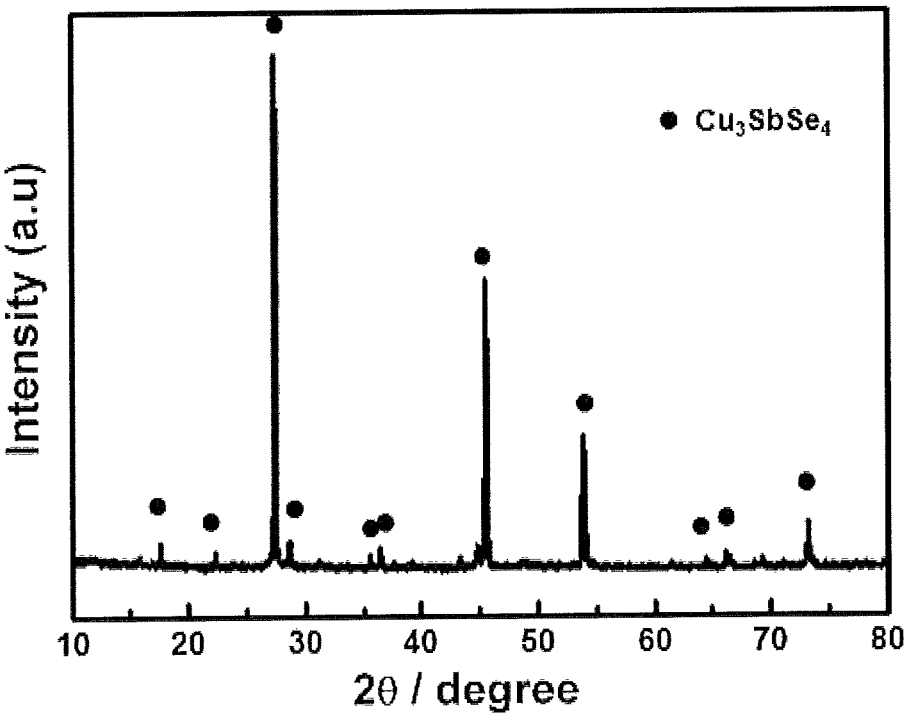
FIG. 30 shows the XRD pattern of $Cu_3SbSe_4$ powder after SHS in step 3 of embodiment example 10.2.

FIG. 30 shows XRD pattern for the samples obtained in step 3) of embodiment example 10.2. Single phase $Cu_3SbSe_4$ is obtained in 30 seconds after SHS.

Embodiment Example 10.3

Here we choose Zn as M, and a is equal to 2. b is equal to 1. The Stoichiometric of the compound is $Cu_2ZnSnSe_4$.

The detailed procedure of the ultra-fast preparation method of $Cu_2ZnSnSe_4$ thermoelectric material is as following.

1) Stoichiometric amounts $Cu_2ZnSnSe_4$ of high purity single elemental Cu (4N), Se (4N), Zn (4N), Sn (4N) powders were weighed and mixed in the agate mortar with the weight about 5 gram.

2) And then the mixed powder was loaded into a stainless steel die and cold-pressed into a pellet with the size of ϕ10 mm under the pressure of 10-15 MPa holding for 5 min.
3) The pellet obtained in step 2) was initiated by putting the sealed quartz tube into the furnace for 1 min which was holding at 573 K. And then the pellet was cool down to room temperature in the air.

Figure 31:
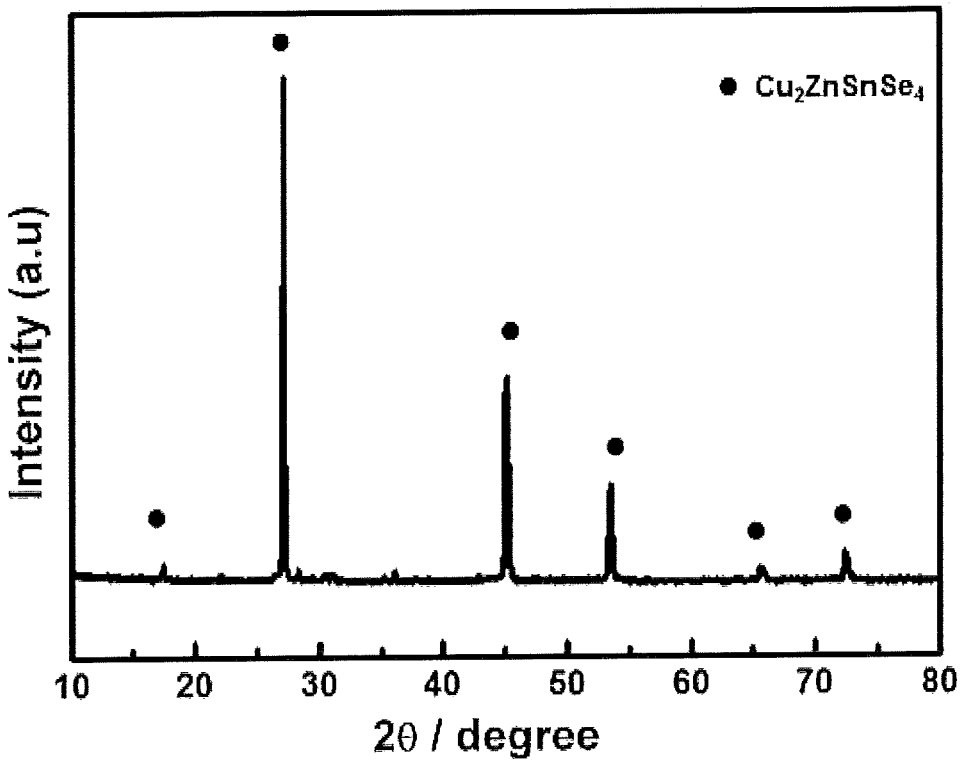
FIG. 31 shows the XRD pattern of $Cu_2ZnSnSe_4$ powder after SHS in step 3 of embodiment example 10.3.

FIG. 31 shows XRD pattern for the samples obtained in step 3) of embodiment example 10.3. Single phase $Cu_2ZnSnSe_4$ is obtained in 60 seconds after SHS.

Embodiment Example 10.4

Here we choose Zn as M, and a is equal to 2. b is equal to 1. The Stoichiometric of the compound is $Cu_2ZnSnSe_4$.

The detailed procedure of the ultra-fast preparation method of $Cu_2ZnSnSe_4$ thermoelectric material is as following.

1) Stoichiometric amounts $Cu_2ZnSnSe_4$ of high purity single elemental Cu (4N), Se (4N), Zn (4N), Sn (4N) powders were weighed and mixed in the agate mortar with the weight about 5 gram.
2) And then the mixed powder was loaded into a stainless steel die and cold-pressed into a pellet with the size of ϕ10 mm under the pressure of 10-15 MPa holding for 5 min.
3) The pellet obtained in step 2) was initiated by putting the sealed quartz tube into the furnace for 1 min which was holding at 773 K. And then the pellet was cool down to room temperature in the air.

Figure 32:
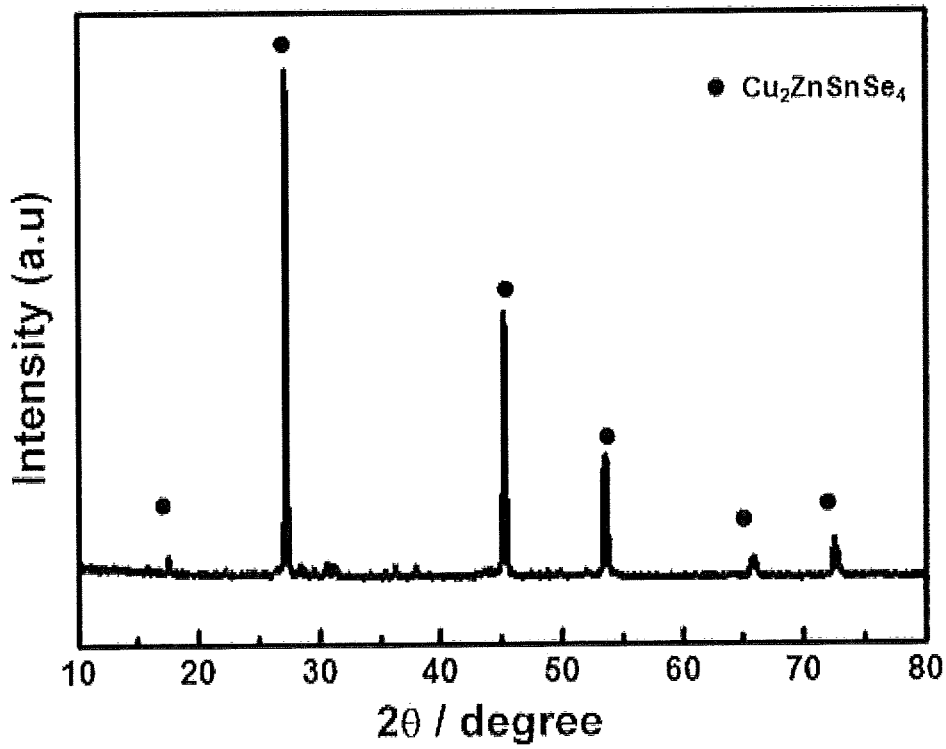
FIG. 32 shows the XRD pattern of $Cu_2ZnSnSe_4$ powder after SHS in step 3 of embodiment example 10.4.

FIG. 32 shows XRD pattern for the samples obtained in step 3) of embodiment example 10.4. Single phase $Cu_2ZnSnSe_4$ is obtained in 60 seconds after SHS.

Embodiment Example 10.5

Here we choose Cd as M, and a is equal to 2. b is equal to 1. The Stoichiometric of the compound is $Cu_2CdSnSe_4$.

The detailed procedure of the ultra-fast preparation method of $Cu_2CdSnSe_4$ thermoelectric material is as following.

1) Stoichiometric amounts $Cu_2ZnSnSe_4$ of high purity single elemental Cu (4N), Se (4N), Cd (4N), Sn (4N) powders were weighed and mixed in the agate mortar with the weight about 5 gram.
2) And then the mixed powder was loaded into a stainless steel die and cold-pressed into a pellet with the size of ϕ10 mm under the pressure of 10-15 MPa holding for 5 min.
3) The pellet obtained in step 2) was initiated by putting the sealed quartz tube into the furnace for 1 min which was holding at 573 K. And then the pellet was cool down to room temperature in the air.

Figure 33:
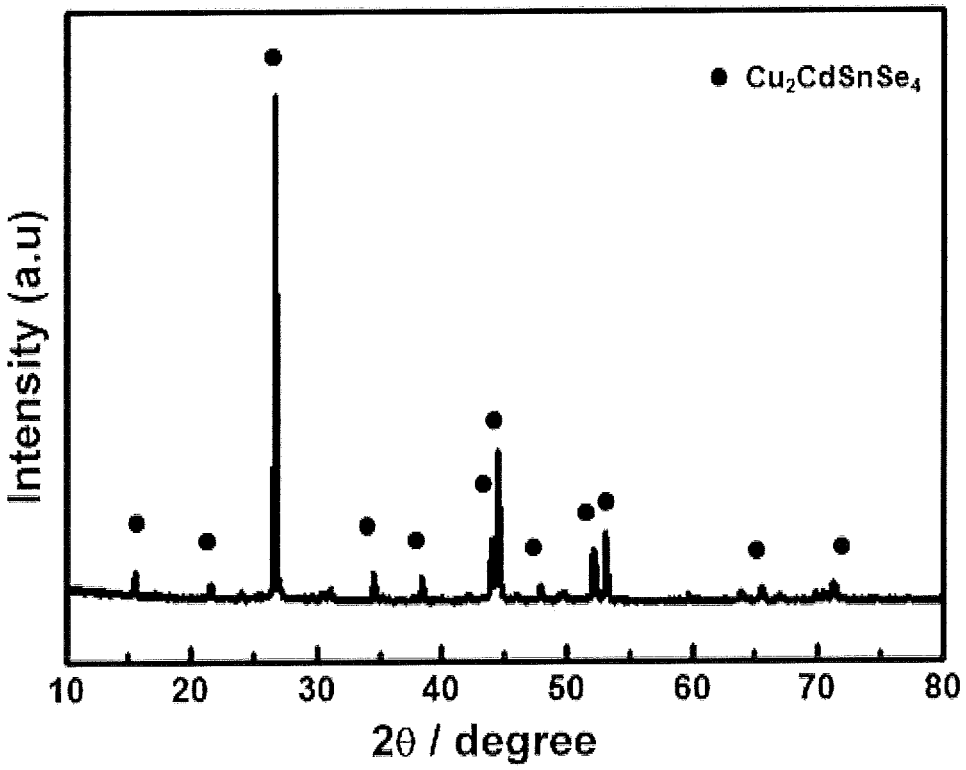
FIG. 33 shows the XRD pattern of $Cu_2CdSnSe_4$ powder after SHS in step 3 of embodiment example 10.5.

FIG. 33 shows XRD pattern for the samples obtained in step 3) of embodiment example 10.5. Single phase $Cu_2CdSnSe_4$ is obtained in 60 seconds after SHS.

Embodiment Example 10.6

Here we choose Sb as M, and a is equal to 3. b is equal to 0. The Stoichiometric of the compound is $Cu_3SbSe_4$.

The detailed procedure of the ultra-fast preparation method of $Cu_3SbSe_4$ thermoelectric material is as following.

1) Stoichiometric amounts $Cu_3Sb_{1.02}Se_4$ of high purity single elemental Cu (4N), Se (4N), Sb (6N) powders were weighed and mixed in the agate mortar with the weight about 5 gram.
2) And then the mixed powder was loaded into a stainless steel die and cold-pressed into a pellet with the size of ϕ10 mm under the pressure of 10-15 MPa holding for 5 min.
3) The pellet obtained in step 2) was initiated by putting the sealed quartz tube into the furnace for 30 s which was holding at 573 K. And then the pellet was cool down to room temperature in the air.

Figure 34:
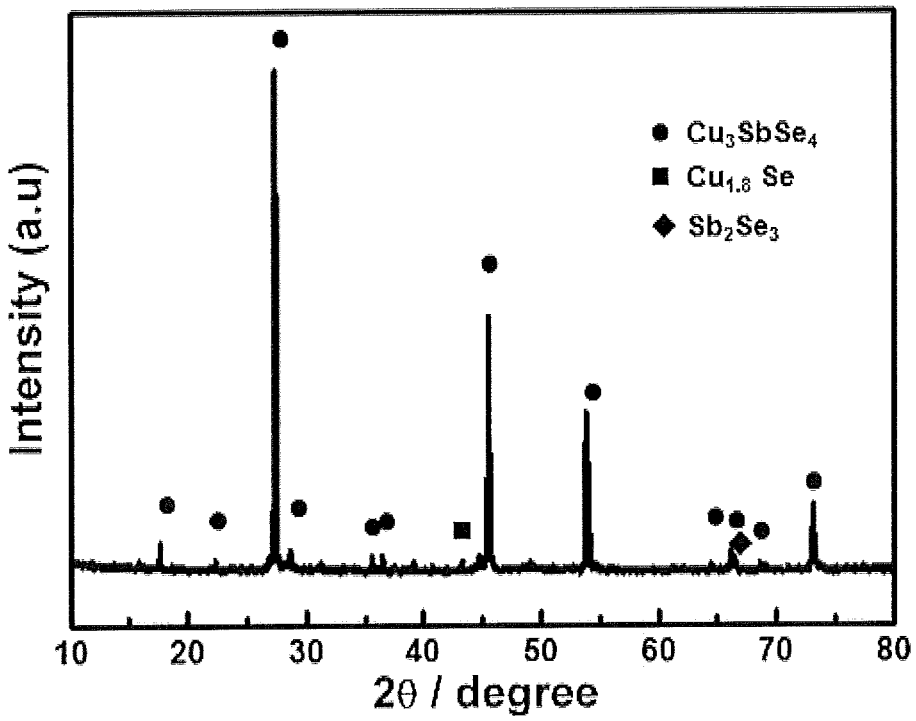
FIG. 34 shows the XRD pattern of $Cu_3SbSe_4$ powder after SHS in step 3 of embodiment example 10.6.

FIG. 34 shows XRD pattern for the samples obtained in step 3) of embodiment example 10.6. Single phase $Cu_3SbSe_4$ is obtained in 30 seconds after SHS.

Embodiment Example 11 A Methods for Ultra-Fast Synthesis of $Cu_2SnSe_3$ Powder

Embodiment Example 11.1

The detailed procedure of the ultra-fast preparation method of $Cu_2SnSe_3$ thermoelectric material is as following.

1) Stoichiometric amounts $Cu_{2.02}SnSe_{3.03}$ of high purity single elemental Cu (4N), Se (4N), Sn (4N) powders were weighed and mixed in the agate mortar with the weight about 5 gram.
2) And then the mixed powder was loaded into a stainless steel die and cold-pressed into a pellet with the size of ϕ10 mm under the pressure of 10 MPa holding for 5 min. and then the pellet was load into the quartz tube.
3) The pellet obtained in step 2) was initiated by putting the sample into the furnace for 30 s which was holding at 573 K. And then the pellet was cool down to room temperature in the air.

Figure 35:
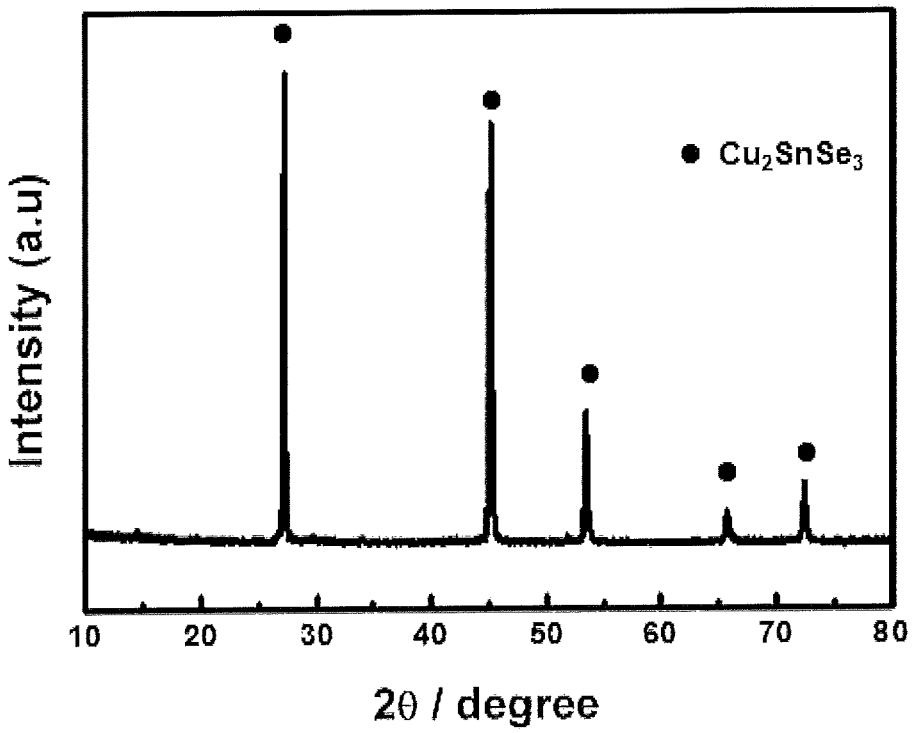
FIG. 35 shows the XRD pattern of $Cu_2SnSe_3$ powder after SHS in step 2 of embodiment example 11.1

FIG. 35 shows XRD pattern for the samples obtained in step 3) of embodiment example 11.1. Single phase $Cu_2SnSe_3$ is obtained in 30 seconds after SHS.

Embodiment Example 11.2

The detailed procedure of the ultra-fast preparation method of high thermoelectric performance $Cu_2SnSe_3$ is as following.

1) Stoichiometric amounts $Cu_{2.02}SnSe_{3.03}$ of high purity single elemental Cu (4N), Se (4N), Sn (4N) powders were weighed and mixed in the agate mortar with the weight about 5 gram. And then the mixed powder was loaded into a stainless steel die and cold-pressed into a pellet with the size of ϕ10 mm under the pressure of 10 MPa holding for 5 min. and then the pellet was load into the quartz tube.
2) The pellet obtained in step 2) was initiated by putting the sample into the furnace for 30 s which was holding at 573 K. And then the pellet was cool down to room temperature in the air.
3) The obtained pellet in step 2) was crushed, hand ground into a fine powder, and then the fine powder was loaded into a graphite die with size of ϕ15 mm and was vacuum sintered by PAS. The parameter for spark plasma sintering is with the temperature of 803 K with the heating rate 60 K/min and the pressure of 35 MPa holding for 6 min. The densely bulks $Cu_2SnSe_3$ is obtained after PAS with the size of ϕ15×2.5 mm. The sample was cut into the right size for measurement and microstructure characterization by diamond saw.

Figure 36:
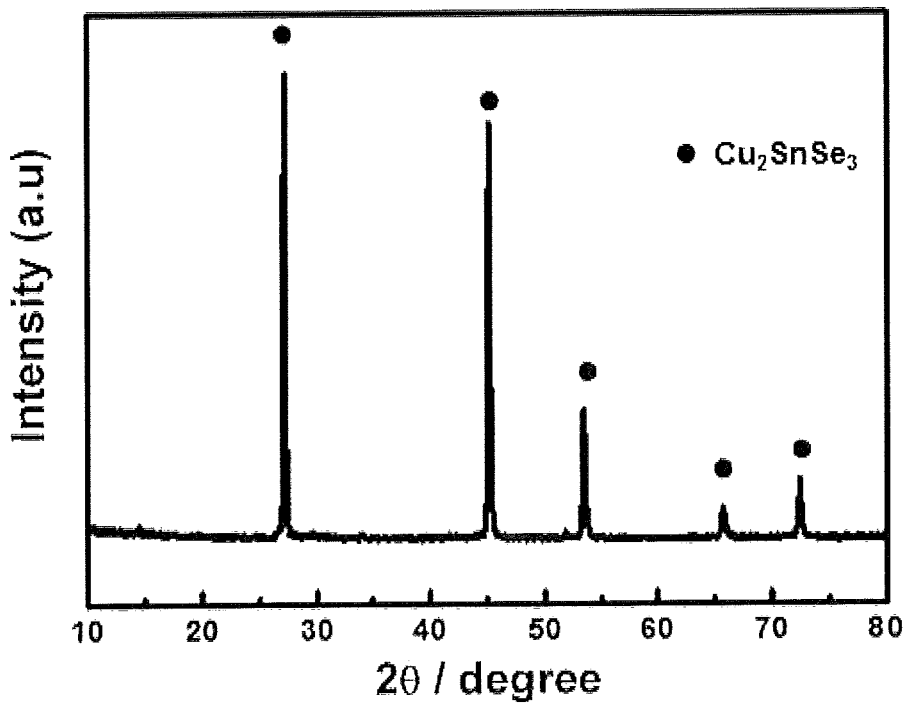
FIG. 36 shows the XRD pattern of $Cu_2SnSe_3$ powder after SHS in step 2 of embodiment example 11.2

FIG. 36 shows XRD pattern for the samples obtained in step 2) of embodiment example 11.2. Single phase $Cu_2SnSe_3$ is obtained in 30 seconds after SHS.

Figure 37:
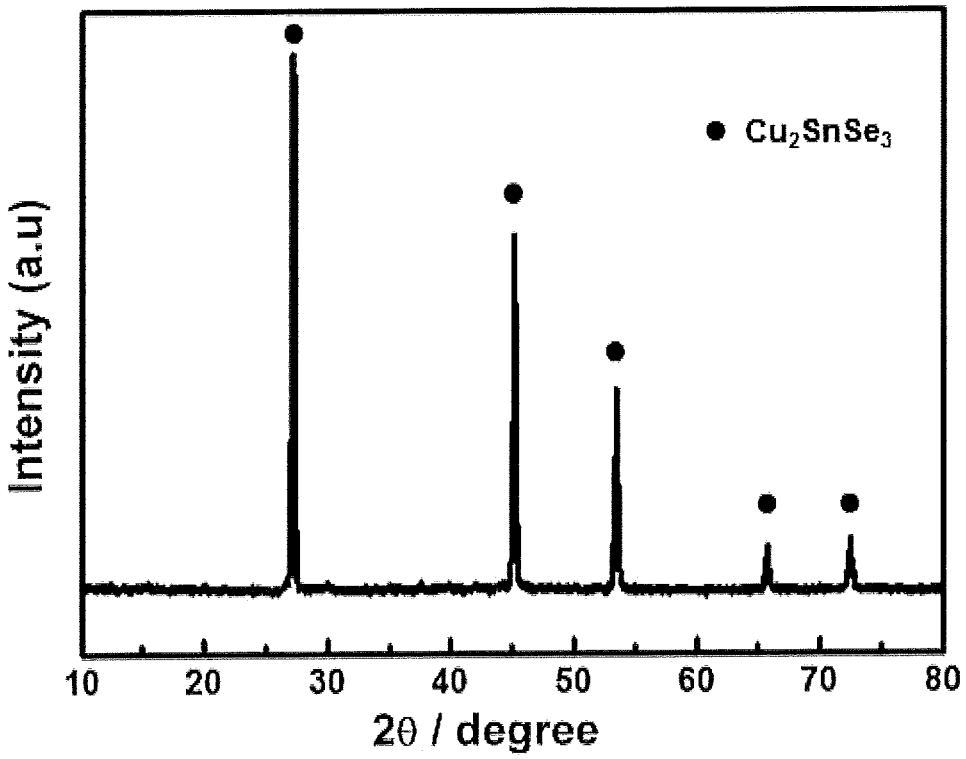
FIG. 37 shows the XRD pattern of $Cu_2SnSe_3$ powder after SHS-PAS of embodiment example 11.2

FIG. 37 shows XRD pattern for the samples obtained in step 3) of embodiment example 11.2. Single phase $Cu_2SnSe_3$ can be maintained after PAS.

Figure 38:
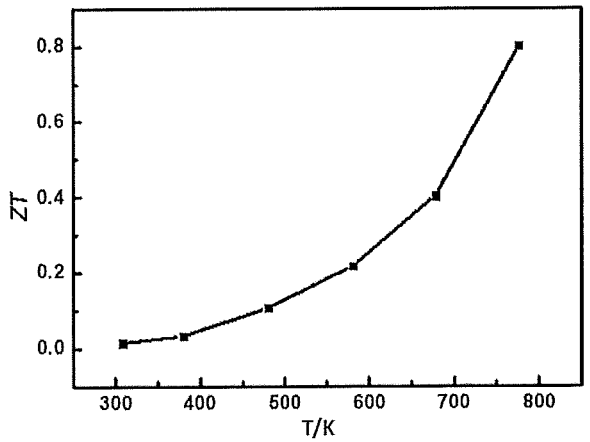
FIG. 38 shows the temperature dependence of ZT for $Cu_2SnSe_3$ in embodiment example 11.2

FIG. 38 shows the temperature dependence of ZT for $Cu_2SnSe_3$. The maximum ZT is 0.8.

Embodiment Example 11.3

The detailed procedure of the ultra-fast preparation method of high thermoelectric performance $Cu_2SnSe_3$ is as following.

1) Stoichiometric amounts $Cu_{2.02}SnSe_{3.03}$ of high purity single elemental Cu (4N), Se (4N), Sn (4N) powders were weighed and mixed in the agate mortar with the weight about 5 gram. And then the mixed powder was loaded into a stainless steel die and cold-pressed into a pellet with the size of ϕ10 mm under the pressure of 10 MPa holding for 5 min. and then the pellet was load into the quartz tube.
2) The pellet obtained in step 2) was initiated by putting the sample into the furnace for 30 s which was holding at 1273 K. Once the pellet was ignited, move the quartz tube away from the furnace. The combustion wave was self-propagating through the whole pellet. And then the pellet was cool down to room temperature in the air.

Figure 39:
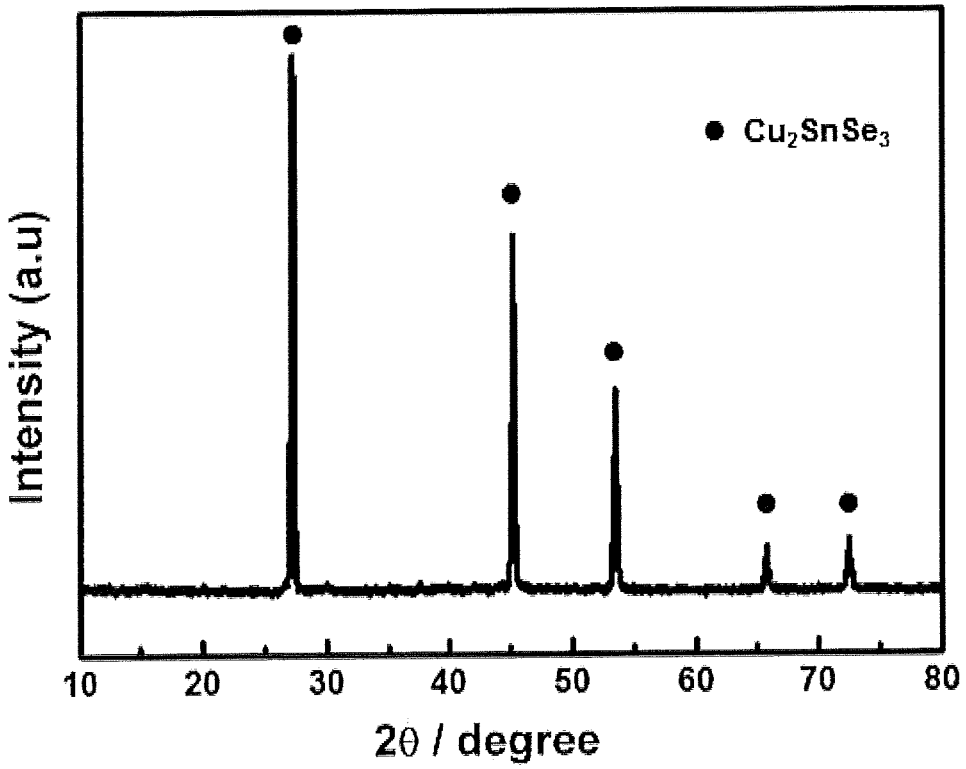
FIG. 39 shows the XRD pattern of $Cu_2SnSe_3$ powder after SHS in embodiment example 11.3

FIG. 39 shows XRD pattern for the samples obtained in step 2) of embodiment example 11.3. Single phase $Cu_2SnSe_3$ is obtained in 30 seconds after SHS.

Embodiment Example 12 A Methods for Ultra-Fast Synthesis of $CoSb_3$ Based Thermoelectric Material Embodiment Example 12.1

The detailed procedure of the ultra-fast preparation method of $CoSb_3$ based thermoelectric material is as following.

1) Stoichiometric amounts $Co_{3.5}Ni_{0.5}Sb_{12}$ of high purity single elemental Co (4N), Ni (4N), Sb (6N) powders were weighed and mixed in the agate mortar with the weight about 4 gram. And then the mixed powder was loaded into a stainless steel die and cold-pressed into a pellet with the size of ϕ10 mm under the pressure of 4 MPa holding for 5 min.
2) The pellet obtained in step 1) was sealed in a silica tube under the pressure of $10^{-3}$ Pa and was initiated by hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Co_{3.5}Ni_{0.5}Sb_{12}$ compounds is obtained after SHS.
3) The obtained pellet $Co_{3.5}Ni_{0.5}Sb_{12}$ in step 2) was crushed, hand ground into a fine powder, and then the fine powder was loaded into a graphite die with size of ϕ16 mm and was vacuum sintered by PAS. The parameter for spark plasma sintering is with the temperature of 923 K with the heating rate 100 K/min and the pressure of 40 MPa holding for 8 min. The densely bulks $Co_{3.5}Ni_{0.5}Sb_{12}$ is obtained after PAS with the size of ϕ15×2.5 mm. The sample was cut into the right size for measurement and microstructure characterization by diamond saw.

Figure 40A:
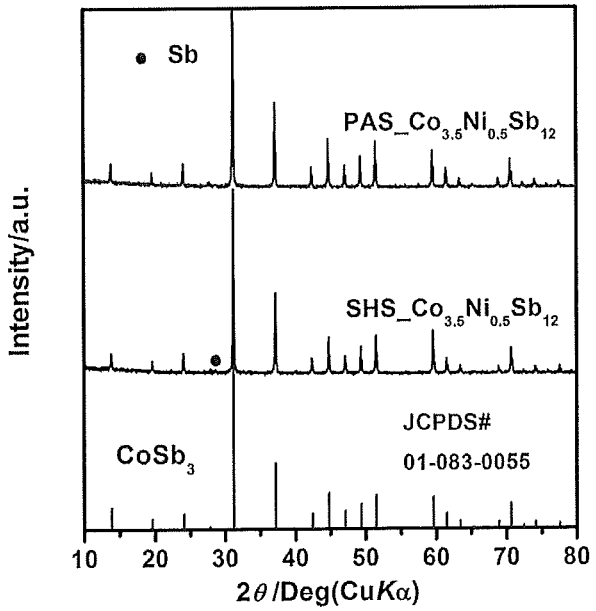
FIG. 40(*a*) shows the XRD pattern of powder after SHS and after SHS-PAS of embodiment example 12.1.
Figure 40B:
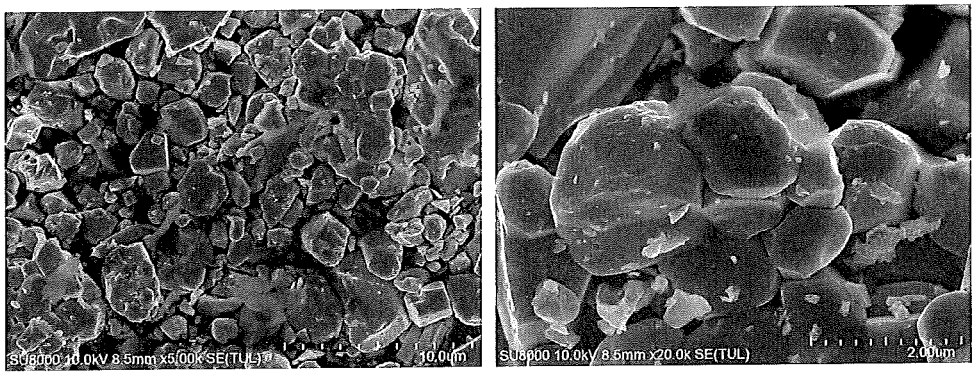
Figure 40C:
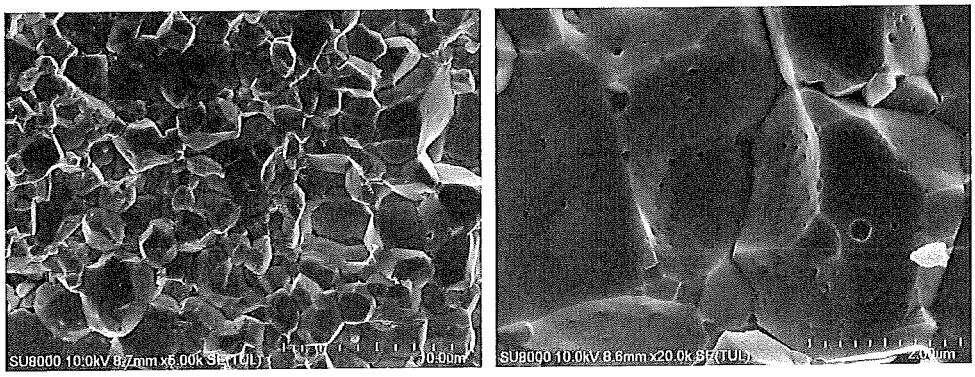

FIG. 40(*a*) shows XRD pattern for the samples obtained in step 2) and in step 3) of embodiment example 12.1. FIG. 40(*b*) shows the FESEM image of the sample in step 2) of embodiment example 12.1. FIG. 40(*c*) shows the FESEM image of the sample in step 3) of embodiment example 12.1. As shown in FIG. 40, Single phase $CoSb_3$ with trace of tiny amount of Sb is obtained in a very short time after SHS. After PAS, Single phase $CoSb_3$ is obtained. The pore with the size of 20 nm-100 nm is observed between the grain boundaries. The relative density of the sample is no less than 98%.

Embodiment Example 12.2

The detailed procedure of the ultra-fast preparation method of $CoSb_3$ based thermoelectric material is as following.

1) Stoichiometric amounts $Co_{3.8}Fe_{0.2}Sb_{12}$ of high purity single elemental Co (4N), Fe(4N), Sb (6N) powders were weighed and mixed in the agate mortar with the weight about 4 gram. And then the mixed powder was loaded into a stainless steel die and cold-pressed into a pellet with the size of ϕ10 mm under the pressure of 4 MPa holding for 5 min.
2) The pellet obtained in step 1) was sealed in a silica tube under the pressure of $10^{-3}$ Pa and was initiated by hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Co_{3.8}Fe_{0.2}Sb_{12}$ compounds is obtained after SHS.
3) The obtained pellet $Co_{3.8}Fe0.2Sb_{12}$ in step 2) was crushed, hand ground into a fine powder, and then the fine powder was loaded into a graphite die with size of ϕ16 mm and was vacuum sintered by PAS. The parameter for spark plasma sintering is with the temperature of 923 K with the heating rate 100 K/min and the pressure of 40 MPa holding for 8 min. The densely bulks $Co_{3.8}Fe_{0.2}Sb_{12}$ is obtained after PAS with the size of ϕ15×2.5 mm. The sample was cut into the right size for measurement and microstructure characterization by diamond saw.

Figure 41A:
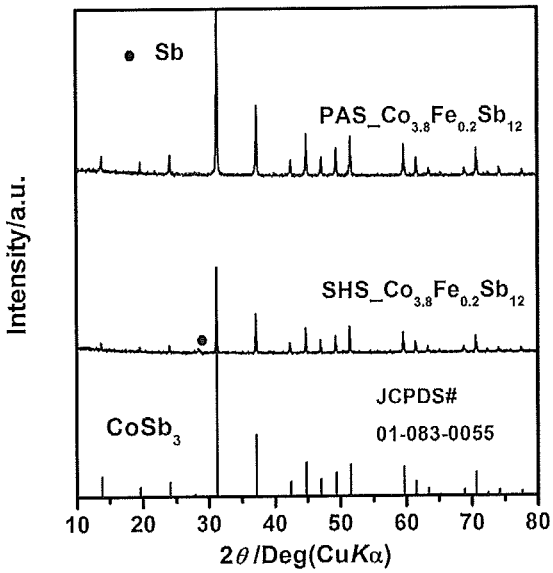
FIG. 41(*a*) shows the XRD pattern of powder after SHS and after SHS-PAS of embodiment example 12.2.
Figure 41B:
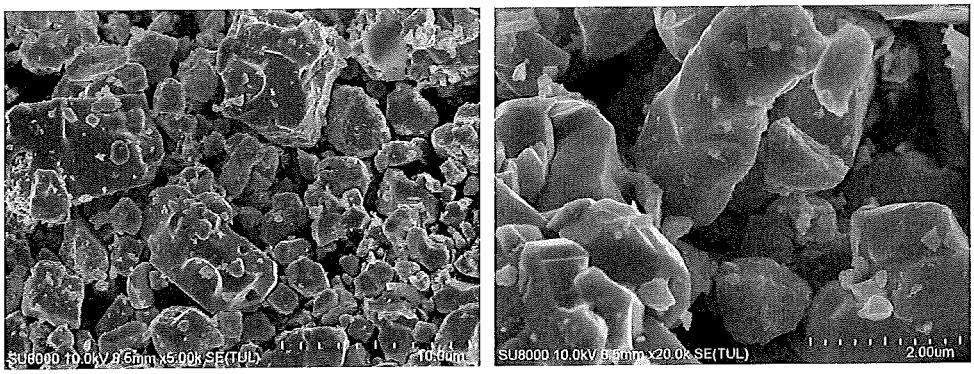
Figure 41C:
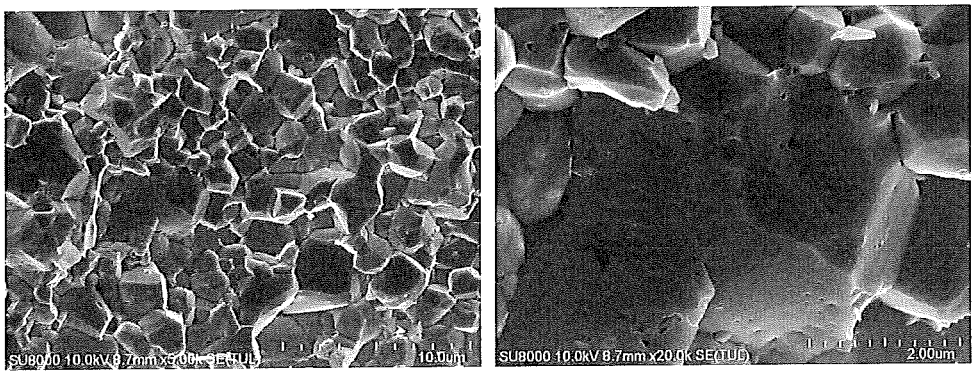

FIG. 41(*a*) shows XRD pattern for the samples obtained in step 2) and in step 3) of embodiment example 12.2. FIG. 41(*b*) shows the FESEM image of the sample in step 2) of embodiment example 12.2. FIG. 41(*c*) shows the FESEM image of the sample in step 3) of embodiment example 12.2. As shown in FIG. 41, Single phase $CoSb_3$ with trace of tiny amount of Sb is obtained in a very short time after SHS. After PAS, Single phase $CoSb_3$ is obtained. The pore with the size of 20 nm-100 nm is observed between the grain boundaries. The relative density of the sample is no less than 98%.

Embodiment Example 12.3

The detailed procedure of the ultra-fast preparation method of $CoSb_3$ based thermoelectric material is as following.

1) Stoichiometric amounts $Co_4Sb_{11.8}Te_{0.2}$ of high purity single elemental Co (4N), Te(6N), Sb (6N) powders were weighed and mixed in the agate mortar with the weight about 4 gram. And then the mixed powder was loaded into a stainless steel die and cold-pressed into a pellet with the size of ϕ10 mm under the pressure of 4 MPa holding for 5 min.
2) The pellet obtained in step 1) was sealed in a silica tube under the pressure of $10^{-3}$ Pa and was initiated by hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Co_4Sb_{11.8}Te_{0.2}$ compounds is obtained after SHS.

3) The obtained pellet $Co_4Sb_{11.8}Te_{0.2}$ in step 2) was crushed, hand ground into a fine powder, and then the fine powder was loaded into a graphite die with size of ϕ16 mm and was vacuum sintered by PAS. The parameter for spark plasma sintering is with the temperature of 923 K with the heating rate 100 K/min and the pressure of 40 MPa holding for 8 min. The densely bulks $Co_4Sb_{11.8}Te_{0.2}$ is obtained after PAS with the size of ϕ15×2.5 mm. The sample was cut into the right size for measurement and microstructure characterization by diamond saw.

Figure 42A:
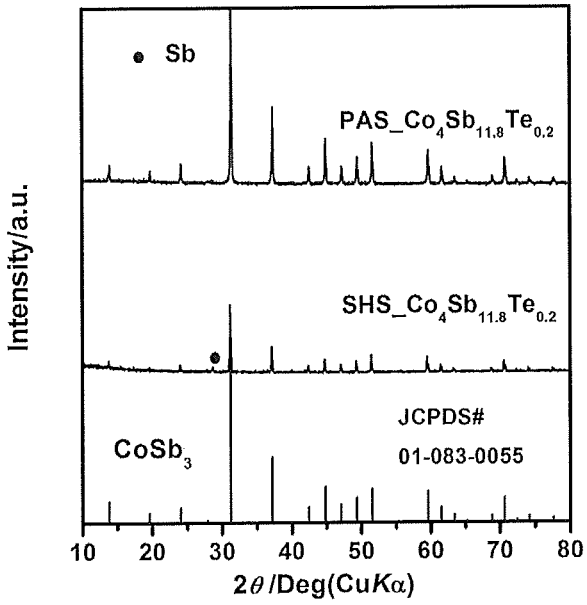
FIG. 42(*a*) shows the XRD pattern of powder after SHS and after SHS-PAS of embodiment example 12.3.
Figure 42B:
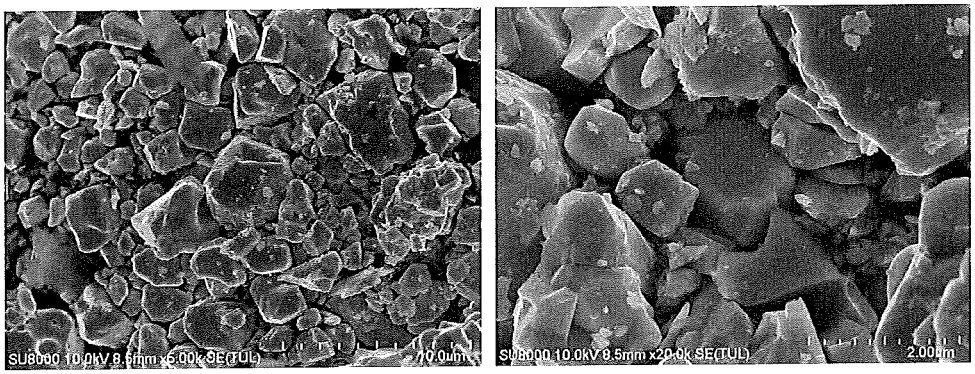
Figure 42C:
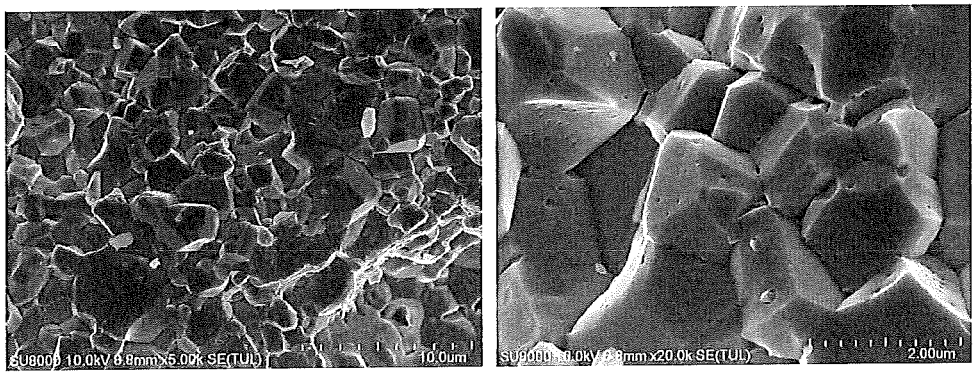

FIG. 42(*a*) shows XRD pattern for the samples obtained in step 2) and in step 3) of embodiment example 12.3. FIG. 42(*b*) shows the FESEM image of the sample in step 2) of embodiment example 12.3. FIG. 42(*c*) shows the FESEM image of the sample in step 3) of embodiment example 12.3. As shown in FIG. 42, Single phase $CoSb_3$ with trace of tiny amount of Sb is obtained in a very short time after SHS. After PAS, Single phase $CoSb_3$ is obtained. The pore with the size of 20 nm-100 nm is observed between the grain boundaries. The relative density of the sample is no less than 98%.

Embodiment Example 12.4

The detailed procedure of the ultra-fast preparation method of $CoSb_3$ based thermoelectric material is as following.

1) Stoichiometric amounts $Co_4Sb_{11.6}Te_{0.4}$ of high purity single elemental Co (4N), Te(6N), Sb (6N) powders were weighed and mixed in the agate mortar with the weight about 4 gram. And then the mixed powder was loaded into a stainless steel die and cold-pressed into a pellet with the size of ϕ10 mm under the pressure of 4 MPa holding for 5 min.

2) The pellet obtained in step 1) was sealed in a silica tube under the pressure of $10^{-3}$ Pa and was initiated by hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Co_4Sb_{11.6}Te_{0.4}$ compounds is obtained after SHS.

3) The obtained pellet $Co_4Sb_{11.6}Te_{0.4}$ in step 2) was crushed, hand ground into a fine powder, and then the fine powder was loaded into a graphite die with size of ϕ16 mm and was vacuum sintered by PAS. The parameter for spark plasma sintering is with the temperature of 923 K with the heating rate 100 K/min and the pressure of 40 MPa holding for 8 min. The densely bulks $Co_4Sb_{11.6}Te_{0.4}$ is obtained after PAS with the size of ϕ15×2.5 mm. The sample was cut into the right size for measurement and microstructure characterization by diamond saw.

Figure 43A:
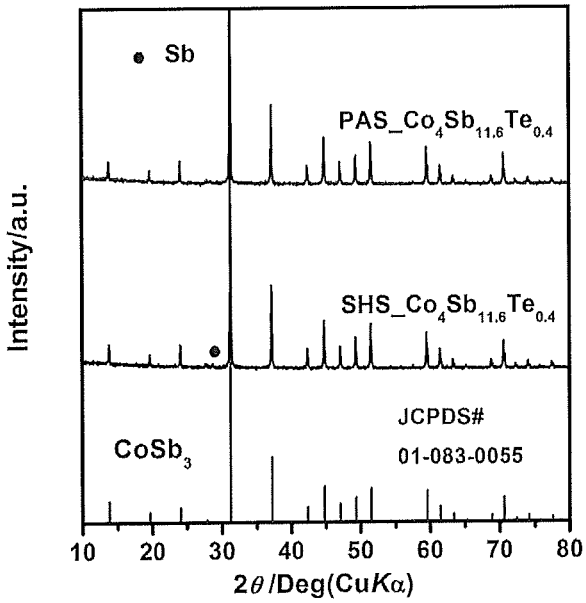
FIG. 43(*a*) shows the XRD pattern of powder after SHS and after SHS-PAS of embodiment example 12.4.
Figure 43B:
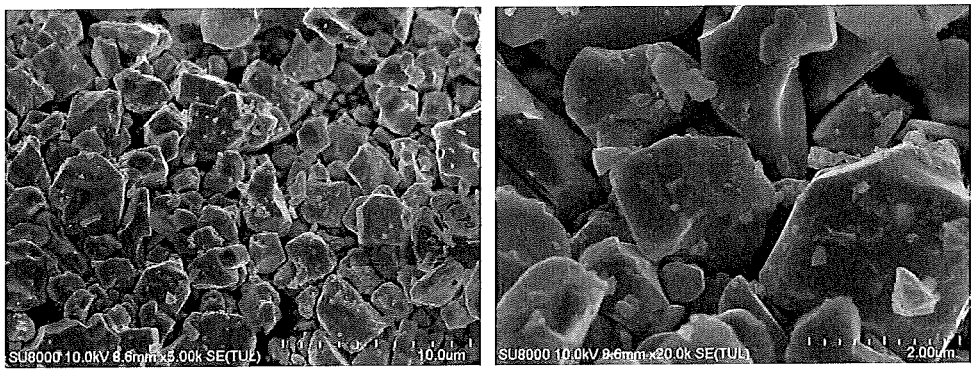
Figure 43C:
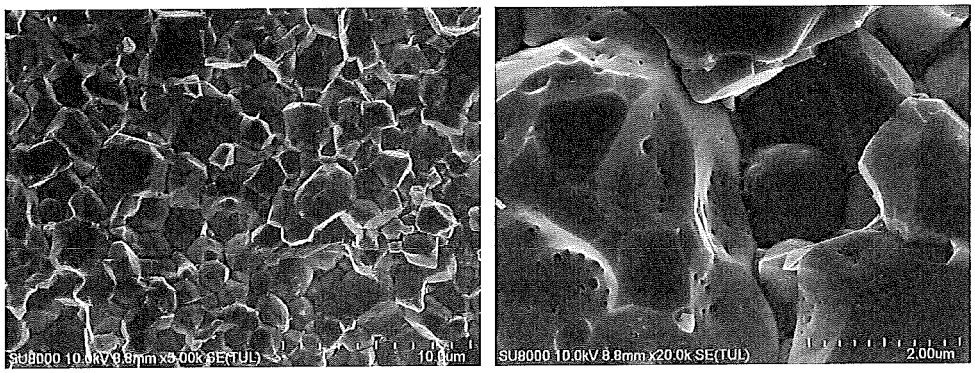

FIG. 43(*a*) shows XRD pattern for the samples obtained in step 2) and in step 3) of embodiment example 12.4. FIG. 43(*b*) shows the FESEM image of the sample in step 2) of embodiment example 12.4. FIG. 43(*c*) shows the FESEM image of the sample in step 3) of embodiment example 12.4. As shown in FIG. 43, Single phase $CoSb_3$ with trace of tiny amount of Sb is obtained in a very short time after SHS. After PAS, Single phase $CoSb_3$ is obtained. The pore with the size of 20 nm-100 nm is observed between the grain boundaries. The relative density of the sample is no less than 98%.

Embodiment Example 12.5

The detailed procedure of the ultra-fast preparation method of $CoSb_3$ based thermoelectric material is as following.

1) Stoichiometric amounts $Co_4Sb_{11.4}Te_{0.6}$ of high purity single elemental Co (4N), Te(6N), Sb (6N) powders were weighed and mixed in the agate mortar with the weight about 4 gram. And then the mixed powder was loaded into a stainless steel die and cold-pressed into a pellet with the size of ϕ10 mm under the pressure of 4 MPa holding for 5 min.

2) The pellet obtained in step 1) was sealed in a silica tube under the pressure of $10^{-3}$ Pa and was initiated by hand torch at the bottom of the sample. Once started, move away from the hand torch, a wave of exothermic reactions (combustion wave) passes through the remaining material as the liberated heat of fusion in one section is sufficient to maintain the reaction in the neighboring section of the compact. And then the pellet was cool down to room temperature in the air. Single phase $Co_4Sb_{11.4}Te_{0.6}$ compounds is obtained after SHS.

3) The obtained pellet $Co_4Sb_{11.4}Te_{0.6}$ in step 2) was crushed, hand ground into a fine powder, and then the fine powder was loaded into a graphite die with size of ϕ16 mm and was vacuum sintered by PAS. The parameter for spark plasma sintering is with the temperature of 923 K with the heating rate 100 K/min and the pressure of 40 MPa holding for 8 min. The densely bulks $Co_4Sb_{11.4}Te_{0.6}$ is obtained after PAS with the size of ϕ15×2.5 mm. The sample was cut into the right size for measurement and microstructure characterization by diamond saw.

Figure 44A:
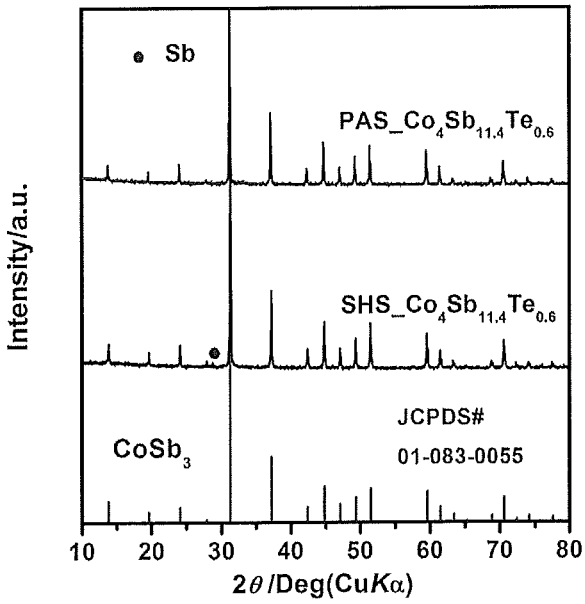
FIG. 44(*a*) shows the XRD pattern of powder after SHS and after SHS-PAS of embodiment example 12.5.
Figure 44B:
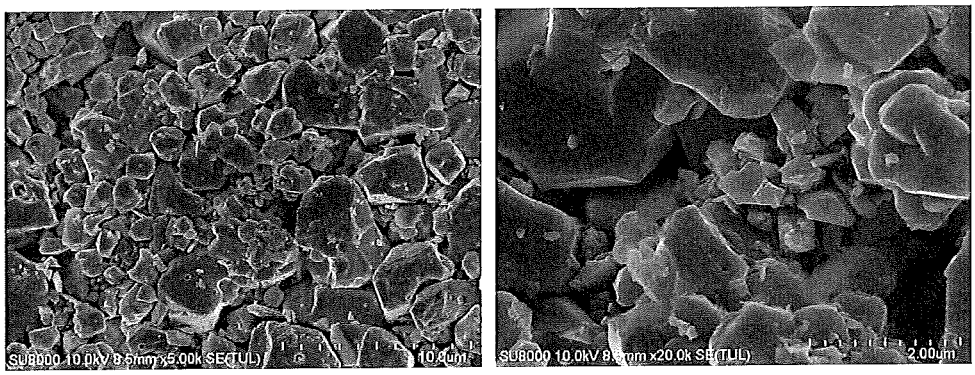
Figure 44C:
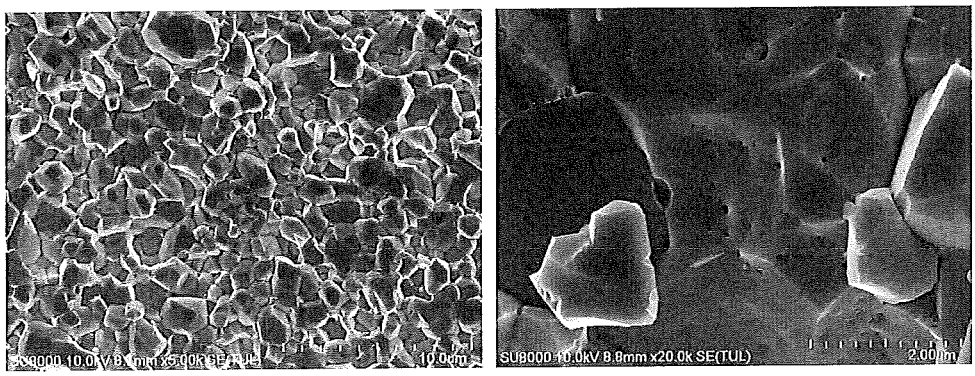

FIG. 44(*a*) shows XRD pattern for the samples obtained in step 2) and in step 3) of embodiment example 12.5. FIG. 44(*b*) shows the FESEM image of the sample in step 2) of embodiment example 12.5. FIG. 44(*c*) shows the FESEM image of the sample in step 3) of embodiment example 12.5. As shown in FIG. 43, Single phase $CoSb_3$ with trace of tiny amount of Sb is obtained in a very short time after SHS. After PAS, Single phase $CoSb_3$ is obtained. The pore with the size of 20 nm-100 nm is observed between the grain boundaries. The relative density of the sample is no less than 98%.

Figure 45A:
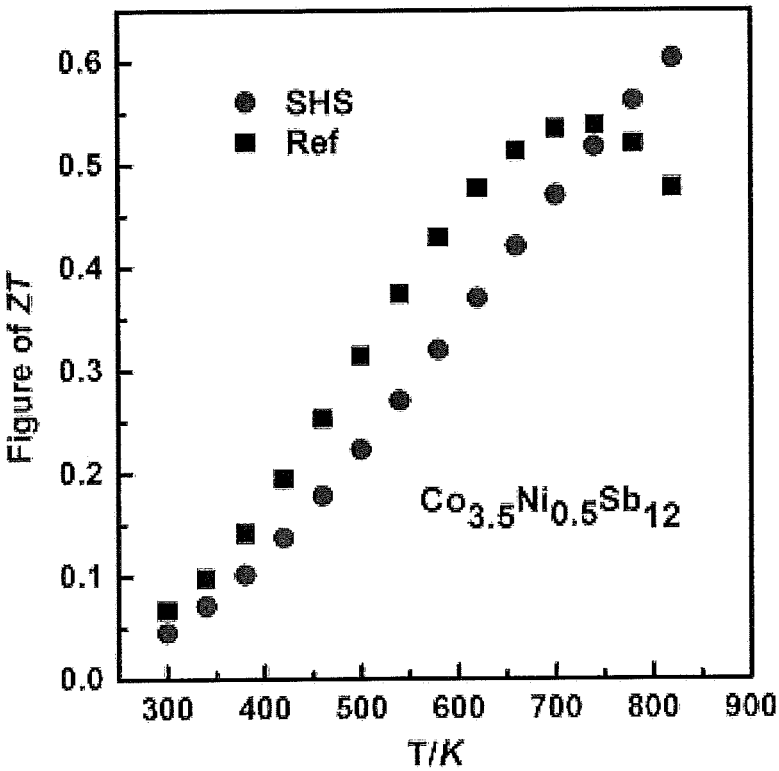
FIG. 45(*a*) shows the temperature dependence of ZT for $Co_{3.5}Ni_{0.5}Sb_{12}$ in step 3 of embodiment example 12.1 compared with the data from reference.(in the reference, the sample synthesized by Melt-annealing and PAS. It takes about 240 h)

FIG. 45*a* shows the temperature dependence of ZT for $Co_{3.5}Ni_{0.5}Sb_{12}$ in step 3 of example 12.1 compared with the data from reference (in the reference, the sample synthesized by Melt-annealing and PAS. It takes about 240 h). The maximum ZT for $Co_{3.5}Ni_{0.5}Sb_{12}$ synthesized by SHS-PAS is 0.68, which is the best result obtained for this composition.

Figure 45B:
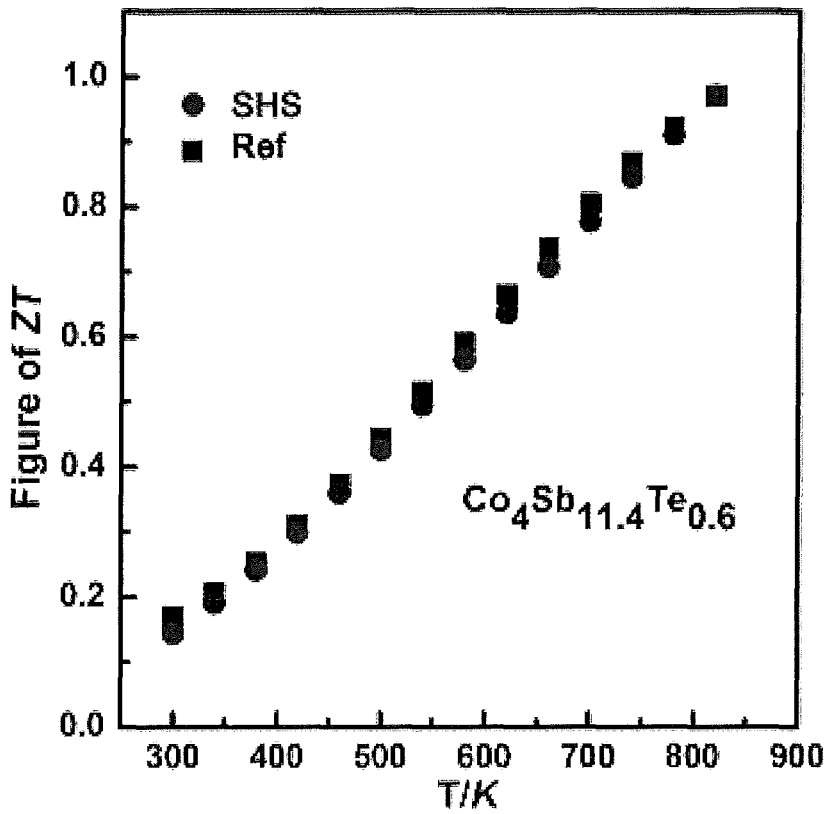

FIG. 45(*b*) shows the temperature dependence of ZT for $Co_4Sb_{11.4}Te_{0.6}$ in step 3 of example 12.5 compared with the data from reference (In the reference, the sample is synthesized by Melt-annealing and PAS. It takes about 168 h). The maximum ZT for $Co_{3.5}Ni_{0.5}Sb_{12}$ synthesized by SHS-PAS is 0.98, which is the best result obtained for this composition.

We claim:

1. A synthesis method for preparing Half-Heusler thermoelectric materials, comprising (1) preparing appropriate amounts of single elemental powders A, B and X in a 1:1:1 stoichiometric ratio, mixing the powders in an agate mortar and then cold-pressing into a pellet, (2) sealing the pellet in a silica tube under a pressure of $10^{-3}$ Pa, (3) initiating a synthesis by point-heating a small part of the pellet, (4) cooling down the pellet to room temperature in air or quenching the pellet in salt water, (5) crushing the pellet into fine powder, and (6) sintering the fine powder by plasma activated sintering (PAS).

2. The synthesis method according to claim 1, wherein A is an element selected from elements in IIIB, IVB, and VB columns of the periodic table; B is an element selected from elements in VIIIB column of the periodic table; X is an element selected from elements in IIIA, IVA, VA columns of the periodic table; and the sintering is performed with a temperature above 850° C. and a pressure from about 30 MPa to about 50 MPa.

3. The synthesis method according to claim 1, wherein element A is selected from one of the following: Ti, Zr, Hf, Sc, Y, La, V, Nb, and Ta; element B is selected from one of the following: Fe, Co, Ni, Ru, Rh, Pd, and Pt; and X is selected from one of the following: Sn, Sb, and Bi.

* * * * *